US005691108A

United States Patent [19]

Hirano et al.

[11] Patent Number: 5,691,108

[45] Date of Patent: Nov. 25, 1997

[54] METHOD FOR DEVELOPING SILVER HALIDE PHOTOGRAPHIC LIGHT-SENSITIVE MATERIAL

[75] Inventors: Mitsunori Hirano; Kouta Fukui, both of Kanagawa, Japan

[73] Assignee: Fuji Photo Film Co., LTD., Kanagawa, Japan

[21] Appl. No.: 736,425

[22] Filed: Oct. 24, 1996

[30] Foreign Application Priority Data

Oct. 24, 1995 [JP] Japan ..... HEI 7-298801
Dec. 21, 1995 [JP] Japan ..... HEI 7-349037

[51] Int. Cl.[6] ..... G03C 5/315

[52] U.S. Cl. ..... 430/264; 430/465; 430/488

[58] Field of Search ..... 430/264, 465, 430/488

[56] References Cited

U.S. PATENT DOCUMENTS

| | | | |
|---|---|---|---|
| 5,108,872 | 4/1992 | Inoue et al. | 430/264 |
| 5,405,732 | 4/1995 | Shimizu et al. | 430/465 |
| 5,441,847 | 8/1995 | Fukawa et al. | 430/488 |
| 5,478,697 | 12/1995 | Sakai | 430/264 |

*Primary Examiner*—Hoa Van Le
*Attorney, Agent, or Firm*—Sughrue, Mion, Zinn, Macpeak & Seas, PLLC

[57] ABSTRACT

A process for developing a silver halide photographic light-sensitive material is disclosed, comprising processing, after exposure, a silver halide photographic light-sensitive material which comprises a support having thereon at least one light-sensitive silver halide emulsion layer, the emulsion layer or other hydrophilic colloid layer containing a hydrazine-base nucleating agent having an anionic group in the vicinity of the hydrazine group or a nonionic group of forming an intramolecular hydrogen bond with the hydrogen atom of the hydrazine, or containing at least one hydrazine nucleating agent selected from the compounds represented by formula (I), and a nucleating accelerator, with a developer having a pH of from 9.0 to 11.0 and containing:

(1) from 0.2 to 0.75 mol/l of a dihydroxybenzene-base developing agent, (2) from 0.001 to 0.06 mol/l of a 1-phenyl-3-pyrazolidone-base or p-aminophenol-base auxiliary developing agent, (3) from 0.3 to 1.2 mol/l of free sulfite ions, and (4) a compound represented by formula (II);

wherein the replenishing amount of the developer is 225 ml/m$^2$ or less.

3 Claims, No Drawings

METHOD FOR DEVELOPING SILVER HALIDE PHOTOGRAPHIC LIGHT-SENSITIVE MATERIAL

FIELD OF THE INVENTION

The present invention relates to a method for developing a silver halide black-and-white photographic light-sensitive material at a pH of less than 11.0 to form an ultrahigh contrast image, more specifically, the present invention relates to a development method in which the replenishing amount of the developer is reduced.

BACKGROUND OF THE INVENTION

In the field of graphic arts, in order to obtain good halftone images, letters or line works, a system for forming an ultrahigh contrast photographic image having an image area and a non-image area which are clearly discriminated, is required.

The ultrahigh contrast photographic image has been formed for years using a special developer called a lith developer. In the system using this lith developer, it is essential to maintain the concentration of free sulfite ions in the developer very low so as to exert the capabilities. The sulfite ion has a function as a preservative of the developer and therefore, the lith developer is bound to problems such as lack of stability and outstanding deterioration by aging.

To add a hydrazine compound to a silver halide photographic emulsion or a developer is known, for example, in U.S. Pat. Nos. 3,730,727 (where a developer uses a combination of an ascorbic acid and a hydrazine), 3,227,552 (where a hydrazine is used as an auxiliary developer for obtaining a direct color positive image), 3,386,831 (where a β-monophenylhydrazine of an aliphatic carboxylic acid is added as a stabilizer of a silver halide light-sensitive material) and 2,419,975, and Mees, *The Theory of Photographic Process,* 3rd ed., page 281 (1966).

Among these, U.S. Pat. No. 2,419,975 discloses a high contrast negative image obtained by adding a hydrazine compound, where a hydrazine compound is added to a silver chlorobromide emulsion and the development is performed with a developer having a high pH of 12.8, thereby achieving an extremely high contrast photographic property such that the γ value exceeds 10. However, a strong alkali developer having a pH near to 13 is prone to air oxidation, unstable and not endurable in storage or use for a long period of time.

A means for developing a silver halide light-sensitive material containing a hydrazine compound with a developer having a lower pH is being attempted to form a high contrast image.

JP-A-1-179939 (the term "JP-A" as used herein means an "unexamined published Japanese patent application") and JP-A-1-179940 describe a processing method of developing a light-sensitive material containing a nucleation development accelerator having an adsorbing group to silver halide emulsion grains and a nucleating agent having the same adsorbing group with a developer having a pH of 11.0 or less. However, when the compound having an adsorbing group is added to a silver halide emulsion, if the addition amount exceeds a certain limit, the compound impairs light sensitivity, inhibits development or prevents action of other useful adsorbing additives and therefore, the use amount is restricted and satisfactory contrast cannot be achieved.

JP-A-60-140343 discloses that contrast is increased by adding an amine to a silver halide photographic light-sensitive material. However, in the case of development with a developer having a pH of less than 11.0, satisfactory contract cannot be obtained.

JP-A-56-106244 discloses that contrast is accelerated by adding an amino compound to a developer having a pH of from 10 to 12. However, when a developer containing an amine is used, there arise problems of an odor of the solution, stains due to adhesion of the solution to instruments used or environmental pollution by the solution discharged and accordingly, it is demanded to incorporate an amine into a light-sensitive material, however, none of light-sensitive materials containing an amine has succeeded in exhibiting satisfactory performance.

U.S. Pat. Nos. 4,998,604 and 4,994,365 disclose a hydrazine compound having an ethylene oxide repeating unit and a hydrazine compound having a pyridinium group. However, as is seen in Examples of these patent publications, the contrast is not satisfactory and it is difficult to achieve high contrast and necessary Dmax under practical development conditions.

In order to obtain an ultrahigh contrast image using a stable developer having a pH of less than 11.0, various investigations have been made and it has been found that an ultrahigh contrast image can be obtained by using a hydrazine nucleating agent and a specific quaternary onium salt nucleation accelerator in combination in the light-sensitive material. However, even in this method, the developer must be replenished in an amount of approximately from 320 to 450 ml for processing 1 $m^2$ of a silver halide photographic material. Accordingly, a method of reducing the replenishing amount and a stable processing method are being demanded. When the replenishing amount is reduced, another problem arises such that silver sludge increases in the development tank and adheres to the light-sensitive material.

It is known to reduce change in the photographic performance by reducing change in the pH value of the developer and JP-B-3-5730 (the term "JP-B" as used herein means an "examined Japanese patent publication") discloses that the photographic performance is stabilized by increasing buffering ability of the developer. However, when a silver halide photographic light-sensitive material is processed using a developer increased in the buffering ability in an automatic developing machine, uneven development is disadvantageously readily caused.

To supply a developer as a solid processing agent is known and JP-A-61-259921 describes elevation of stability of the developer as a solid processing agent. Further, JP-A-5-265147 describes a processing method of supplying a developer for processing a hydrazine-containing light-sensitive material, as a solid processing agent and discloses that black peppers are improved.

SUMMARY OF THE INVENTION

An object of the present invention is to provide a development method of a silver halide black-and-white photographic light-sensitive material, in which a sufficiently high contrast negative image can be obtained, change in the photographic performance is small even when the replenishing amount of the developer is reduced, generation of uneven development is suppressed, and stable performance can be always ensured.

The object of the present invention can be attained by a method for developing a silver halide photographic light-sensitive material comprising processing, after exposure, a silver halide photographic light-sensitive material which comprises a support having thereon at least one light-sensitive silver halide emulsion layer, the emulsion layer or another hydrophilic colloid layer containing (i-1) a hydrazine-base nucleating agent having, in the vicinity of the hydrazine group, an anionic group or a nonionic group which forms an intramolecular hydrogen bond with the hydrogen atom of the hydrazine, or (i-2) at least one hydrazine nucleating agent selected from the compounds represented by the following formula (I), and (ii) a nucleating accelerator, with a developer having a pH of from 9.0 to 11.0 and containing:

(1) from 0.2 to 0.75 mol/l of a dihydroxybenzene-base developing agent, (2) from 0.001 to 0.06 mol/l of a 1-phenyl-3-pyrazolidone-base or p-aminophenol-base auxiliary developing agent, (3) from 0.3 to 1.2 mol/l of free sulfite ions, and (4) a compound represented by the following formula (II): wherein the silver halide photographic light-sensitive material is processed in a replenishing amount of 225 ml/m$^2$ or less;

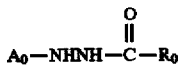

(I)

wherein $R_0$ represents a difluoromethyl group or a monofluoromethyl group, and $A_0$ represents an aromatic group, provided that $A_0$ contains, as a substituent, at least one of a non-diffusible group, an adsorption accelerating group to silver halide, an alkylthio group, an arylthio group, a heterocyclic thio group, a quaternary ammonium group, a nitrogen-containing heterocyclic group containing a quaternized nitrogen atom, an alkoxy group containing an ethyleneoxy or propyleneoxy unit, a saturated heterocyclic group having a sulfide bond or a disulfide bond, and a combination thereof;

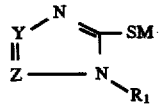

(II)

wherein Y and Z each represents N or $CR_2$ (wherein $R_2$ represents an alkyl group or an aryl group), $R_1$ represents an alkyl, aryl or heterocyclic group substituted by at least one selected from the group consisting of —$SO_3M$, —COOM, —OH, —$NHSO_2R_3$, —$SO_2NR_3R_4$ and —$NR_5CONR_3R_4$, or a group comprising an alkyl, aryl or heterocyclic group bonded through a linking group, $R_3$, $R_4$ and $R_5$ each represents a hydrogen atom or a lower alkyl group having from 1 to 4 carbon atoms, and M represents a hydrogen atom, an alkali metal atom, a quaternary ammonium or a quaternary phosphonium.

DETAILED DESCRIPTION OF THE INVENTION

The hydrazine-base nucleating agent for use in the present invention is described below.

The hydrazine-base nucleating agent for use in the present invention is a hydrazine derivative having, in the vicinity of the hydrazine group, an anionic group or a nonionic group which forms an intramolecular hydrogen bond with the hydrogen atom of the hydrazine, or a hydrazine derivative represented by formula (I). The former is described below.

Specific examples of the anionic group include a carboxylic acid, a sulfonic acid, a sulfinic acid, a phosphoric acid, a phosphonic acid and a salt thereof. The term "in the vicinity of the hydrazine group" as used herein means that a bonding chain formed of from 2 to 5 atoms comprising at least one selected from a carbon atom, a nitrogen atom, an oxygen atom and a sulfur atom intervenes between the nitrogen atom close to the anionic group in the hydrazine and the anionic group.

The vicinity is preferably such that a bonding chain formed of from 2 to 5 atoms comprising at least one selected from a carbon atom and a nitrogen atom intervenes, more preferably such that a bonding chain formed of 2 or 3 carbon atoms intervenes.

The nonionic group which forms an intramolecular hydrogen bond with the hydrogen of the hydrazine is a group which forms a hydrogen bond with the hydrogen atom of the hydrazine by the action of its lone pair to form (by forming) a 5- to 7-membered ring, and has at least one oxygen, nitrogen, sulfur or phosphorus atom. Examples of the nonionic group include an alkoxy group, an amino group, an alkylthio group, a carbonyl group, a carbamoyl group, an alkoxycarbonyl group, a urethane group, a ureido group, an acyloxy group and an acylamino group.

Of these, an anionic group is preferred and a carboxylic acid or a salt thereof is most preferred. The nucleating agent for use in the present invention is preferably represented by the following formula (A), (B) or (C):

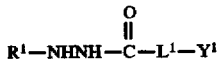

(A)

wherein $R^1$ represents an alkyl group, an aryl group or a heterocyclic group, $L^1$ represents a divalent linking group having an electron withdrawing group, $Y^1$ represents an anionic group or a nonionic group which forms an intramolecular hydrogen bond with the hydrogen of the hydrazine;

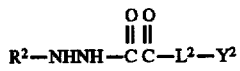

(B)

wherein $R^2$ represents an alkyl group, an aryl group or a heterocyclic group, $L^2$ represents a divalent linking group, and $Y^2$ represents an anionic group or a nonionic group which forms an intramolecular hydrogen bond with the hydrogen of the hydrazine;

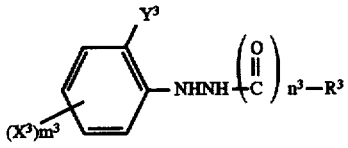

(C)

wherein $X^3$ represents a group capable of substituting to a benzene ring, $R^3$ represents an alkyl group, an alkenyl group, an alkynyl group, an aryl group, a heterocyclic group, an alkoxy group or an amino group, $Y^3$ represents an anionic group or a nonionic group of forming an intramolecular hydrogen bond with hydrogen of the hydrazine, $m^3$ represents 0 an integer of from 1 to 4, and $n^3$ represents 1 or 2, provided that when $n^3$ is 1, $R^3$ has an electron withdrawing group.

Formulae (A), (B) and (C) are described in more detail below.

The alkyl group represented by $R^1$ or $R^2$ is a linear, branched or cyclic alkyl group having from 1 to 16, preferably from 1 to 12 carbon atoms, and examples thereof include methyl, ethyl, propyl, isopropyl, t-butyl, allyl, propargyl, 2-butenyl, 2-hydroxyethyl, benzyl, benzhydryl, trityl, 4-methylbenzyl, 2-methoxyethyl, cyclopentyl, 2-acetamidoethyl.

The aryl group represented by $R^1$ or $R^2$ is an aryl group having from 6 to 24, preferably from 6 to 12 carbon atoms, and examples thereof include phenyl, naphthyl, p-alkoxyphenyl, p-sulfonamidophenyl, p-ureidophenyl and p-amidophenyl. The heterocyclic group represented by $R^1$ or $R^2$ is a 5- or 6-membered, saturated or unsaturated heterocyclic group having from 1 to 5 carbon atoms and containing one or more oxygen atom, nitrogen atom or sulfur atom. The number of hetero atoms and the kind of elements constituting the ring may be single or plural. Examples thereof include 2-furyl, 2-thienyl and 4-pyridyl.

$R^1$ and $R^2$ each is preferably an aryl group, an aromatic heterocyclic group or an aryl-substituted methyl group, more preferably an aryl group (e.g., phenyl, naphthyl). $R^1$ and $R^2$ each may be substituted by a substituent and examples of the substituent include an alkyl group, an aralkyl group, an alkoxy group, an alkyl-substituted amino group, an aryl-substituted amino group, an amide group, a sulfonamide group, a ureido group, a urethane group, an aryloxy group, a sulfamoyl group, a carbamoyl group, an aryl group, an alkylthio group, an arylthio group, a sulfonyl group, a sulfinyl group, a hydroxy group, a halogen atom, a cyano group, a sulfo group, a carboxyl group and a phosphoric acid amide group. These groups each may be further substituted. Among these, a sulfonamide group, a ureido group, an amide group, an alkoxy group and a urethane group are preferred, and a sulfonamide group and a ureido group are more preferred. These groups may be combined with each other to form a ring, if possible.

The alkyl group, the aryl group and the heterocyclic group represented by $R^3$ include those described for $R^1$. The alkenyl group represented by $R^3$ has from 2 to 18, preferably from 2 to 10 carbon atoms, and examples thereof include vinyl, and 2-styryl. The alkynyl group represented by $R^3$ has from 2 to 18, preferably from 2 to 10 carbon atoms, and examples thereof include ethynyl and phenylethynyl. The alkoxy group represented by $R^3$ is a linear, branched or cyclic alkoxy group having from 1 to 16, preferably from 1 to 10 carbon atoms, and examples thereof include methoxy, isopropoxy and benzyloxy. The amino group represented by $R^3$ is an amino group having from 0 to 16, preferably from 1 to 10 carbon atoms, and examples thereof include ethylamino, benzylamino and phenylamino. When $n^3$ is 1, $R^3$ is preferably an alkyl group, an alkenyl group or an alkynyl group, and when $n^3$ is 2, $R^3$ is preferably an amino group or an alkoxy group.

The electron withdrawing group which may be present in $R^3$ has a Hammett's $\sigma_m$ of 0.2 or more, preferably 0.3 or more, and examples thereof include a halogen atom (e.g., fluorine, chlorine, bromine), a cyano group, a sulfonyl group (e.g., methanesulfonyl, benzenesulfonyl), a sulfinyl group (e.g., methanesulfinyl), an acyl group (e.g., acetyl, benzoyl), an oxycarbonyl group (e.g., methoxycarbonyl), a carbamoyl group (e.g., N-methylcarbamoyl), a sulfamoyl group (e.g., methylsulfamoyl), a halogen-substituted alkyl group (e.g., trifluoromethyl), a heterocyclic group (e.g., 2-benzoxazolyl, pyrrolo) and a quaternary onium group (e.g., triphenyl phosphonium, trialkylammonium, pyridinium). Examples of $R^3$ having an electron withdrawing group include trifluoromethyl, difluoromethyl, pentafluoroethyl, cyanomethyl, methanesulfonylmethyl, acetylethyl, trifluoromethylethynyl and ethoxycarbonylmethyl.

$L^1$ and $L^2$ each represents a divalent linking group and examples thereof include an alkylene group, an alkenylene group, an alkynylene group, an arylene group, a divalent heterocyclic group and a combination of these groups linked through —O—, —S—, —NH—, —CO—, —$SO_2$— or a combination thereof. $L^1$ and $L^2$ each may be substituted by a group described above as the substituent of $R^1$. Examples of the alkylene group include methylene, ethylene, trimethylene, propylene, 2-buten-1,4-yl and 2-butin-1,4-yl. Examples of the alkenylene group include vinylene. Examples of the alkynylene include ethynylene. Examples of the arylene group include phenylene. Examples of the divalent heterocyclic group include furan- 1,4-diyl. $L^1$ is preferably an alkylene group, an alkenylene group, an alkynylene group or an arylene group, more preferably an alkylene group, most preferably an alkylene group having a chain length of from 2 to 3 carbon atoms. $L^2$ is preferably an alkylene group, an arylene group, —NH-alkylene-, —O-alkylene- or —NH-arylene-, more preferably —NH-alkylene- or —O-alkylene.

Examples of the electron withdrawing group of $L^1$ include those described above as the electron withdrawing group of $R^3$. Examples of $L^1$ include tetrafluoroethylene, fluoromethylene, hexafluorotrimethylene, perfluorophenylene, difluorovinylene, cyanomethylene and methanesulfonylethylene.

$Y^1$, $Y^2$ and $Y^3$, which are already described above, each is an anionic group or a nonionic group which forms a hydrogen bond with the hydrogen atom of the hydrazine by the action of its lone pair to form a 5- to 7-membered ring. More specifically, examples of the anionic group include a carboxylic acid, a sulfonic acid, a sulfinic acid, a phosphoric acid, a phosphonic acid and a salt thereof. Examples of the salt include an alkali metal ion (e.g., sodium potassium), an alkaline earth metal ion (e.g., calcium, magnesium), an ammonium (e.g., ammonium, triethylammonium, tetrabutylammonium, pyridinium) and a phosphonium (e.g., tetraphenylphosphonium). The nonionic group is a group having at least one of an oxygen atom, a nitrogen atom, a sulfur atom and a phosphorus atom, and examples thereof include an alkoxy group, an amino group, an alkylthio group, a carbonyl group, a carbamoyl group, an alkoxycarbonyl group, a urethane group, a ureido group, an acyloxy group and an acylamino group. $Y^1$, $Y^2$ and $Y^3$ each is preferably an anionic group, more preferably a carboxylic acid or a salt thereof.

Examples and preferred examples of the group capable of substituting to the benzene ring of $X^3$ include those described above as the substituent of $R^1$ in formula (A). When $m^3$ is 2 or greater, they may be the same or different.

$R^1$ to $R^3$ and $X^3$ each may have a non-diffusible group for use in a photographic coupler or may have an adsorption accelerating group to silver halide. The non-diffusible group has from 8 to 30 carbon atoms, preferably from 12 to 25 carbon atoms. Preferred examples of the adsorption accelerating group to silver halide include thioamides (e.g., thiourethane, thioureido, thioamide), mercaptos (e.g., heterocyclic mercapto such as 5-mercaptotetrazole, 3-mercapto-1,2,4-triazole, 2-mercapto-1,3,4-thiadiazole and 2-mercapto-1,3,4-oxadiazole, alkylmercapto, arylmercapto) and a 5- or 6-membered nitrogen-containing heterocyclic ring capable of forming imino silver (e.g., benzotriazole). The compound having an adsorption accelerating group to silver halide also includes those having a structure such that an adsorbing group is protected and the protective group is removed upon development to increase adsoptivity to silver halide.

In formulae (A), (B) and (C), radicals resulting from removal of hydrogen atoms of respective two compounds may be combined with each other to form a bis form.

Among formulae (A), (B) and (C), formulae (A) and (B) are preferred, and formula (A) is more preferred. Further, Formulae (A), (B) and (C) are more preferably represented by the following formulae (D), (E) and (F), with formula (D) being most preferred.

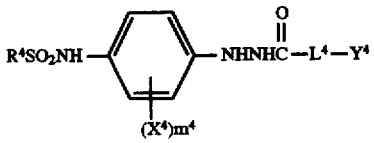

(D)

wherein $R^4$, $X^4$ and $m^4$ have the same meanings as $R^3$, $X^3$ and $m^3$ of formula (C), respectively, $L^4$ and $Y^4$ have the same meanings as $L^1$ and $Y^1$ of formula (A), respectively;

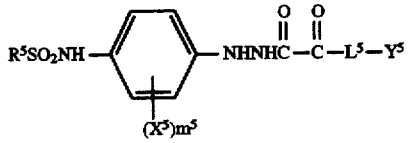

(E)

wherein $R^5$, $X^5$ and $m^5$ have the same meanings as $R^3$, $X^3$ and $m^3$ of formula (C), respectively, $L^5$ and $Y^5$ have the same meanings as $L^2$ and $Y^2$ of formula (B), respectively;

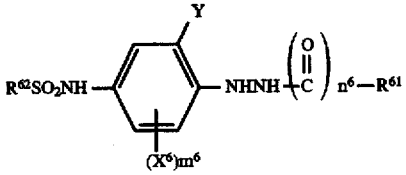

(F)

wherein $R^{61}$, $R^{62}$, $X^6$, $m^6$, $n^6$ and Y have the same meanings as $R_3$, $R^3$, $X^3$, $m^3$, $n^3$ and $Y^3$ of formula (C), respectively.

Specific examples of the nucleating agent for use in the present invention are set forth below, however, the present invention is by no means limited thereto.

N-1

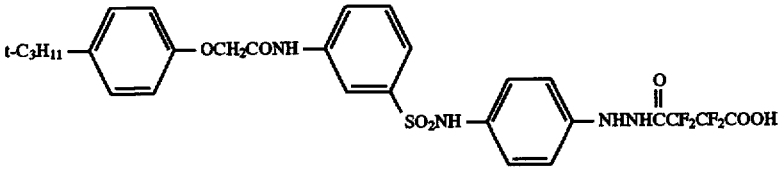

N-2

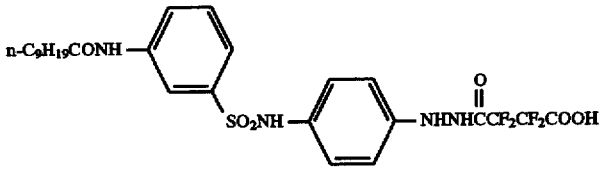

N-3

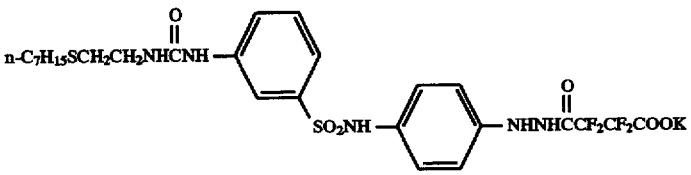

N-4

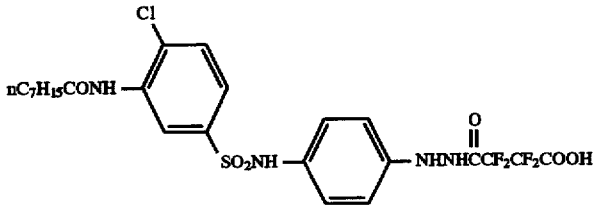

N-5

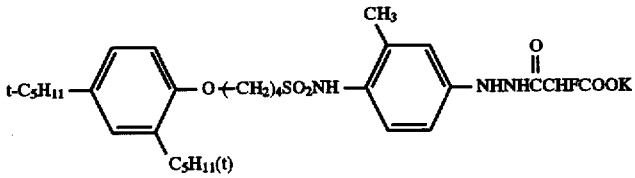

N-6

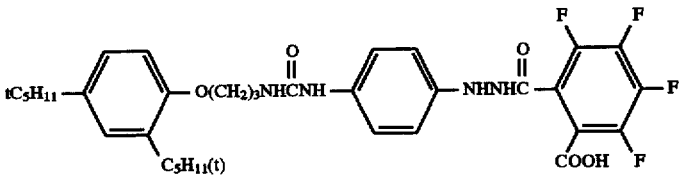

-continued
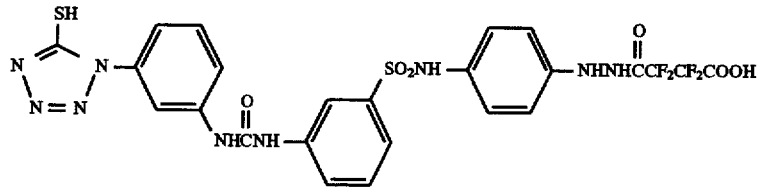
N-7
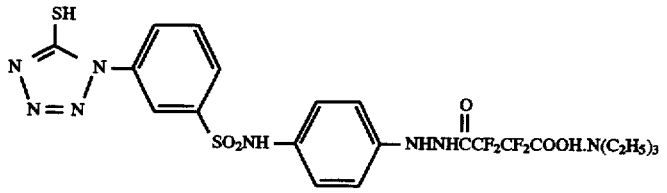
N-8
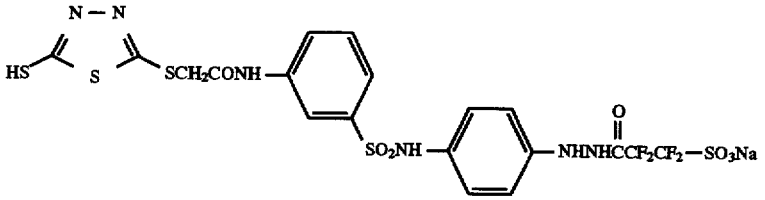
N-9
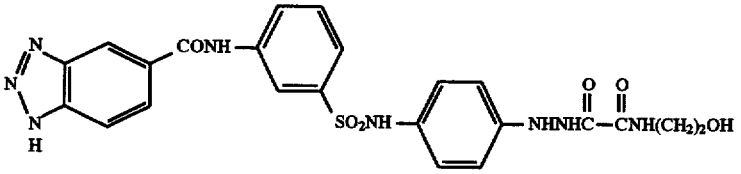
N-10
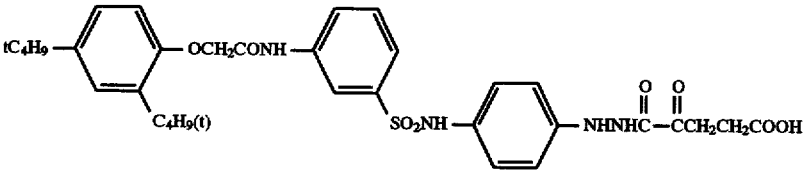
N-11
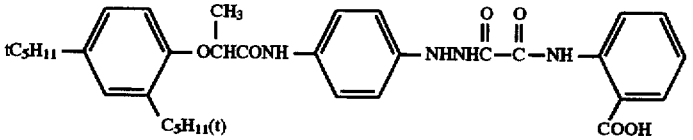
N-12
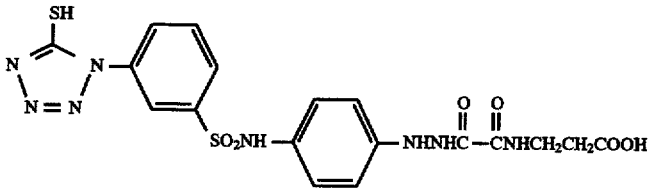
N-13
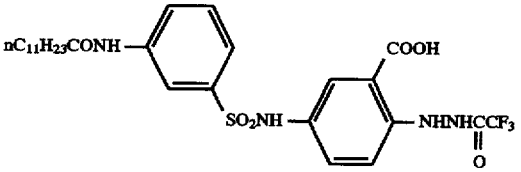
N-14

-continued
N-15
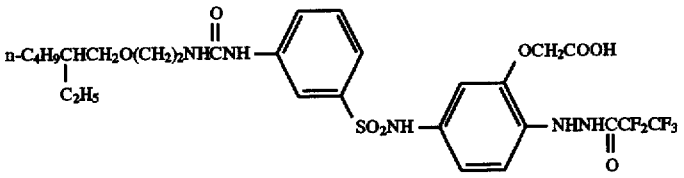
N-16
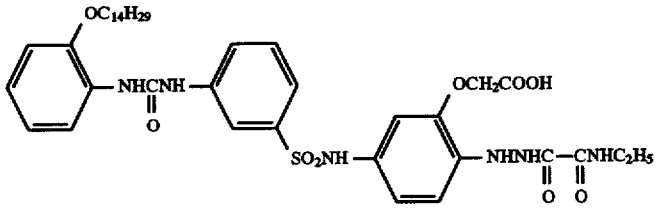
N-17
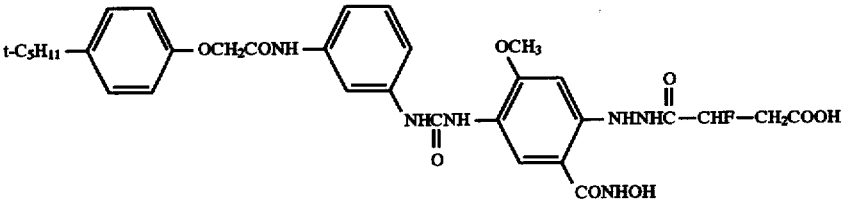
N-18
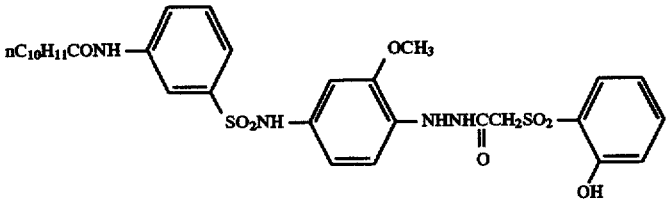
N-19
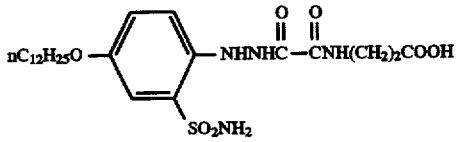
N-20
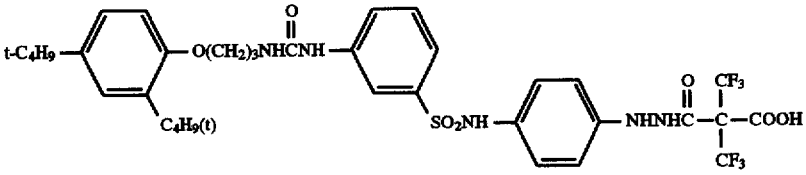
N-21
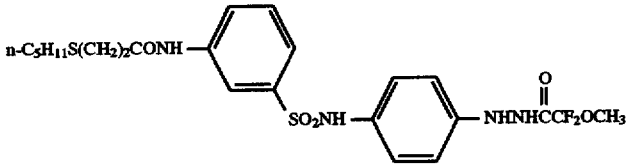
N-22
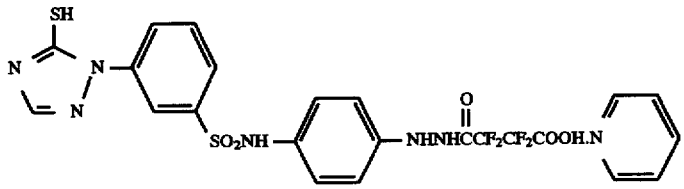

-continued
N-23
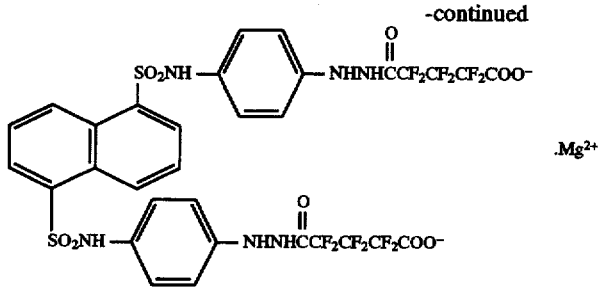
N-24
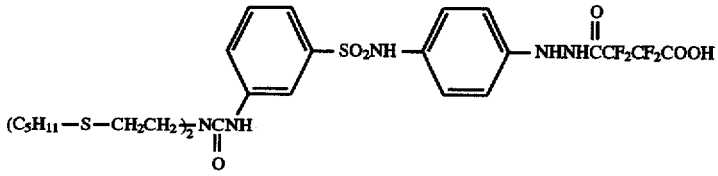
N-25
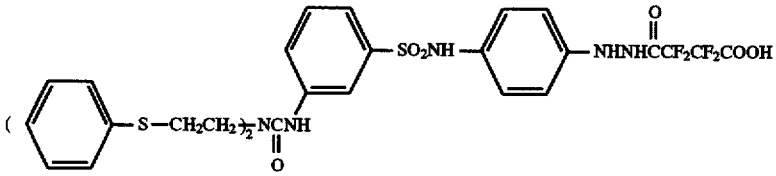
N-26
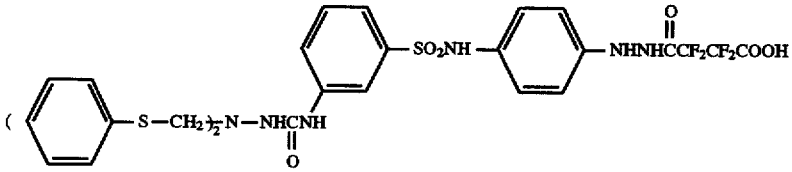
N-27
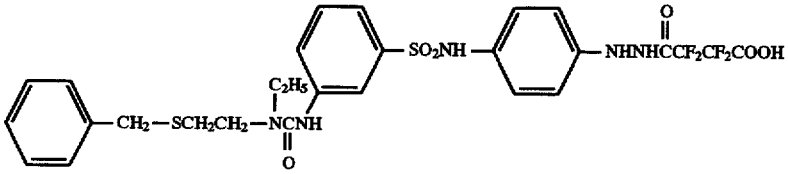
N-28
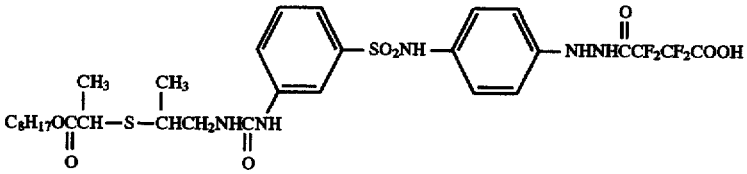
N-29
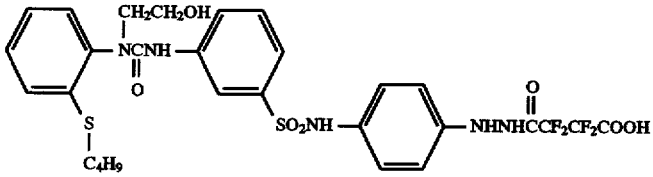
N-30
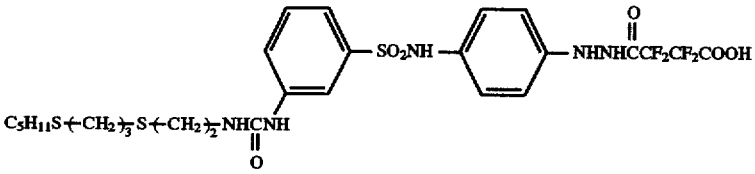

The hydrazine derivative represented by formula (I) described in detail below.

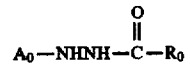

(I)

wherein $R_0$ represents a difluoromethyl group or a monofluoromethyl group, and $A_0$ represents an aromatic group, provided that at least one of substituents of $A_0$ is a non-diffusible group, an adsorption accelerating group to silver halide, an alkylthio group, an arylthio group, a heterocyclic thio group, a quaternary ammonium group, a nitrogen-containing heterocyclic group containing a quaternized nitrogen atom, an alkoxy group containing an ethyleneoxy or propyleneoxy unit, a saturated heterocyclic group having a sulfide bond or a disulfide bond, or a substituent containing at least one of these groups.

Among the compounds represented by formula (I), preferred are those represented by the following formula (1-a):

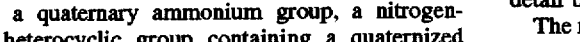

X1-(R3)$_{m3}$-(L2-R2)$_{m2}$-L1-A1-NHNH—CO—R1 (1-a)

wherein R1 represents a difluoromethyl group or a monofluoromethyl group, A1 represents a divalent aromatic group, R2 and R3 each represents a divalent aliphatic group or an aromatic group, L1 and L2 each represents a divalent linking group, m2 and m3 each independently represents 0 or 1, X1 represents a non-diffusible group, an adsorption accelerating group to silver halide, an alkylthio group, an arylthio group, a heterocyclic thio group, a quaternary ammonium group, a nitrogen-containing heterocyclic group containing a quaternized nitrogen atom, an alkoxy group containing an ethyleneoxy or propyleneoxy unit, or a saturated heterocyclic group containing a sulfide or disulfide bond.

Among the compounds represented by formula (1-a), preferred are those represented by the following formula (1-b):

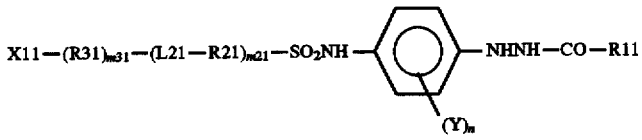

(1-b)

wherein X11, R11, $R_{21}$, $R_{31}$, L21, m21 and m31 have the same meanings as X1, $R_1$, $R_2$, $R_3$, L2, m2 and m3 in formula (1-a), respectively, Y represents a substituent, and n represents 0 or an integer of from 1 to 4.

The compound represented by formula (I) is described in detail below.

In formula (I), the aromatic group represented by $A_0$ includes a monocyclic or bicyclic aryl group and an aromatic heterocyclic group. Specific examples thereof include a benzene ring, a naphthalene ring, a pyridine ring, a quinoline ring, an isoquinoline ring, a pyrrole ring, a furan ring, a thiophene ring, a thiazole ring and an indole ring.

$A_0$ is preferably a group containing a benzene ring, more preferably a benzene ring.

$A_0$ may be substituted by a substituent and examples of the substituent include an alkyl group, an aralkyl group, an aryl group, an alkoxy group, an aryloxy group, a hydroxy group, an acyloxy group, an acyl group, an oxycarbonyl group, a carbamoyl group, an N-sulfonylcarbamoyl group, a carboxyl group, a substituted amino group, an acylamino group, a sulfonamide group, a ureido group, a urethane group, a sulfonylureido group, an alkylthio group, an arylthio group, a sulfonyl group, a sulfamoyl group, an acylsulfamoyl group, a carbamoylsulfamoyl group, a sulfo group, a cyano group, a halogen atom, a phosphinyloxy group, a phosphinylamino group, a sulfamoylamino group and an oxamoylamino group. These groups each may further be substituted.

Among these, a sulfonamide group, a ureido group, an acylamino group, a carbamoyl group, an alkoxy group, a substituted amino group, an alkyl group and an oxycarbonyl group are preferred, and a sulfonamide group and a ureido group are more preferred.

Specific groups as a substituent of $A_0$ are described in detail below.

The non-diffusible group means a non-diffusible group for photographic couplers, namely, a so-called a ballast group, and this is a group capable of preventing, upon adding the compound of the present invention to a specific silver halide emulsion layer, the compound from easily diffusing into other layers or a group capable of preventing, upon development, the compound from easily dissolving out into the developer. More specifically, the non-diffusible group has a total carbon atom number of from 8 or more, preferably from 8 to 16, and examples of the ballast group include an alkyl group, an aryl group, an alkoxy group, an aryloxy group, an oxycarbonyl group, a carbamoyl group, an acylamino group, a sulfonamide group, a carbonyloxy group, a ureido group, a sulfamoyl group, each having a total carbon atom number of 8 or more, and a group comprising a combination of these groups.

When $A_0$ has a ballast group, the total carbon atom number of $A_0$ inclusive of the ballast group is 14 or more.

Preferred examples of the adsorption accelerating group to silver halide include a thioamide group, a mercapto group and a 5- or 6-membered nitrogen-containing heterocyclic group having a disulfide bond. The thioamide adsorption accelerating group is a divalent group represented by —CS-amino- and the group may form a part of a ring structure or it may be an acyclic thioamide group. Useful thioamide adsorption accelerating groups are described, for example, in U.S. Pat. Nos. 4,030,925, 4,031,127, 4,080,207, 4,245,037, 4,255,511, 4,266,013 and 4,276,364, *Research Disclosure*, Vol. 151, No. 15162 (November, 1976) and ibid., Vol. 176, No. 17626 (December, 1978).

Specific examples of the cyclic thioamide group include a thioureido group, a thiourethane group and a dithiocarbamic acid ester, and specific examples of the cyclic thioamide group include 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione and banzothiazoline-2-thione. These may further be substituted. Examples of the mercapto group include an aliphatic mercapto group, an aromatic mercapto group and a heterocyclic mercapto group (when a nitrogen atom is present next to the carbon atom to which an —SH group is bonded, having the same meaning as the cyclic thioamide group in a tautomeric relation therewith, and specific examples of the group are the same as those described above).

The 5- or 6-membered nitrogen-containing heterocyclic group includes a 5- or 6-membered nitrogen-containing heterocyclic group consisting of a combination of nitrogen, oxygen, sulfur or carbon. Among these, preferred are benzotriazole, triazole, tetrazole, indazole, benzimidazole, imidazole, benzothiazole, thiazole, benzoxazole, oxazole, thiadiazole, oxadiazole and triazine. These may further be substituted an appropriate substituent. The adsorption accelerating group is preferably a cyclic thioamide group (namely, a mercapto-substituted nitrogen-containing heterocyclic ring such as a 2-mercaptothiadiazole group, a 3-mercapto-1,2,4-triazole group, a 5-mercaptotetrazole group, a 2-mercapto-1,3,4-oxadiazole group and a 2-mercaptobenzoxazole group) or a nitrogen-containing heterocyclic group capable of forming imino silver (e.g., benzotriazole group, benzimidazole group, indazole group).

The adsorption accelerating group of the present invention includes a precursor thereof. The precursor means an adsorption accelerating group with a precursor group and this adsorption accelerating group is first released by a developer upon development. In the developer, the group is decomposed by hydroxide ions or sulfite ions or by reacting with a developing agent.

Specific examples thereof include a carbamoyl group, a 1,3,3a,7-tetrazainden-4-yl group, a uracil group, an alkoxycarbonyl group and a 4-substituted 2,5-dihydroxyphenyl group with the 4-position being substituted by a ureido group, a sulfonamide group or an amide group.

The alkylthio group is a substituted or unsubstituted, branched, cyclic or linear alkylthio group having a total carbon atom number of from 1 to 18 and preferred examples of the substituent thereof include an aryl group, an alkoxy group (including an alkoxy group having an ethyleneoxy or propylene oxy repeating unit), a carboxyl group, a carbonyloxy group, an oxycarbonyl group, an acylamino group, a quaternary ammonium group, an alkylthio group, a heterocyclic group, a sulfonamide group and a ureido group.

Specific examples of the alkylthio group include the following groups.

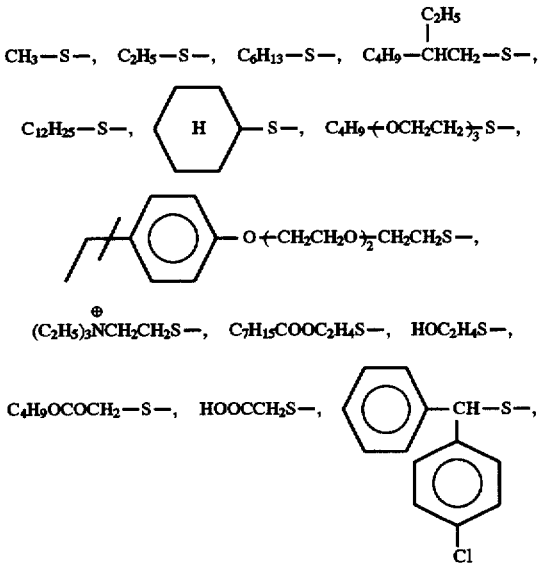

The arylthio group is a substituted or unsubstituted arylthio group having a total carbon atom number of from 6 to 18 and examples of the substituent include those described above as the substituent of $A_0$ in formula (I). The arylthio group is preferably a substituted or unsubstituted phenylthio group and specific examples thereof include a phenylthio group, a 4-τ-butylphenylthio group and a 4-dodecylphenylthio group.

The heterocyclic thio group is a substituted or unsubstituted, saturated or unsaturated heterocyclic thio group having a total carbon atom number of from 1 to 18 and includes 5- and 6-membered monocyclic heterocyclic rings containing one or more of an oxygen atom, a nitrogen atom or a sulfur atom. Specific examples thereof include a benzothiazolylthio group, a 1-phenyl-5-tetrazolylthio group, a 2-mercaptothiadiazolyl-4-thio group and a pyridyl-2-thio group.

The quaternary ammonium group means a quaternary aliphatic ammonium cation or a quaternary aromatic ammonium cation, with a counter anion thereof, and a cyclic quaternary ammonium group is also included. The total carbon number of the quaternary ammonium cation is preferably from 3 to 24.

Specific examples of the counter anion include a chloroanion, a bromoanion, an iodoanion, a sulfonic acid anion and a carboxylic acid anion, however, when the compound represented by formula (I) has a sulfo group or a carboxyl group, an inner salt may be formed.

When X represents a nitrogen-containing heterocyclic group containing a quaternized nitrogen atom, specific examples thereof include a pyridinium group, a quinolinium group, an isoquinolinium group, a phenanthrynium group, a triazolinium group, an imidazolinium group and a benzothiazolinium group.

These groups each may further be substituted by a substituent and preferred examples of the substituent include an alkyl group, an aryl group, an alkoxy group, an alkylcarbamoyl group, an amino group, an ammonium group and a heterocyclic group.

The alkoxy group containing an ethyleneoxy or propylene oxy unit is specifically an alkoxy group represented by $R_4—O(CH_2CH_2O)_p—$, $R_4—O\{CH_2CH(CH_3)O\}_p—$ or $R_4—O\{CH_2CH(OH)CH_2O\}_p—$, wherein p represents an integer of 1 or greater and $R_4$ represents an aliphatic group or an aromatic group.

$R_4$ is preferably an alkyl group having from 1 to 20 carbon atoms or an aryl group having from 6 to 20 carbon atoms.

Specific examples thereof include the following groups:

$CH_3O(CH_2CH_2O)_3—$, $—C_6H_{13}O(CH_2CH_2O)_2—$, $C_4H_9O—(CH_2CH_2CH_2O)_2—$, $C_8H_{17}OCH_2CH(OH)CH_2O—$, $C_{12}H_{25}O\{CH_2CH(CH_3)O\}_2—$, $C_2H_5O(CH_2CH_2O)_6—$.

The saturated heterocyclic group containing a sulfide or disulfide bond is specifically a 5- or 6-membered saturated heterocyclic ring containing an —S— bond or an —S—S— bond. Preferred examples thereof include the following groups:

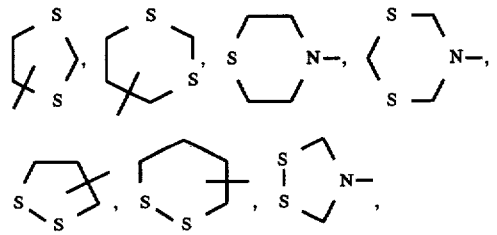

-continued

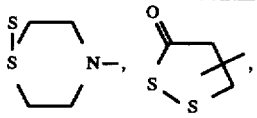

The compound represented by formula (1-a) is described below.

In formula (1-a), $A_1$ represents a divalent aromatic group and has almost the same meaning and the same preferred range as A in formula (I) except that the substituent of $A_0$ is more restricted in formula (1-a).

More specifically, the divalent aromatic group represented by $A_1$ in formula (1-a) is preferably a monocyclic arylene group, more preferably a phenylene group.

When $A_1$ represents a phenylene group, the group may have a substituent. Examples of the substituent of the phenyl group include those described above as the substituent of $A_0$ of formula (I) and among these, preferred are an alkyl group, an alkoxy group, a hydroxy group, an amino group, an alkylamino group, an acylamino group, a sulfonamide group, a ureido group, a halogen atom, a carboxyl group and a sulfo group, each having a total carbon atom number of from 1 to 12, preferably from 1 to 8.

When $A_1$ represents a phenylene group, $A_1$ is particularly preferably an unsubstituted phenylene group.

In formula (1-a), R2 and R3 each represents a divalent aliphatic group or an aromatic group.

The divalent aliphatic group includes substituted or unsubstituted, linear, branched or cyclic alkylene, alkenylene and groups, and the aromatic group includes a monocyclic or bicyclic arylene group.

R2 and R3 each is preferably an alkylene group or an arylene group, and most preferably, R2 is a phenylene group and R3 is a phenylene group or an alkylene group.

These groups each may have a substituent and examples of the substituent include those described above as the substituent of $A_0$ in formula (I).

In formula (1-a), the divalent linking group represented by L1 or L2 is a sole group such as —O—, —S—, —N($R_N$)— (wherein $R_N$ represents a hydrogen atom, an alkyl group or an aryl group), —CO— and —$SO_2$—, or a group comprising a combination of these groups. Specific examples of the group comprising a combination of these groups include —CON($R_N$)—, —$SO_2$N($R_N$)—, —COO—, —N($R_N$)CON($R_N$)—, —$SO_2$N($R_N$)CO—, —$SO_2$N($R_N$)CON($R_N$)—, —N($R_N$)COCON($R_N$)— and —N($R_N$)$SO_2$N($R_N$)—.

In formula (1-a), L1 is preferably —$SO_2$NH—, —NHCONH—, —O—, —S— or —N($R_N$)—, most preferably —$SO_2$NH— or —NHCONH—.

L2 is preferably —CON($R_N$)—, —$SO_2$NH—, —NHCONH—, —N($R_N$)CONH— or —COO—. When L2 represents —CON($R_N$)— or —N($R_N$)CONH—, $R_N$ may represent the —$R_3$—X group in formula (1-a) as a substituted alkyl group.

In formula (1-a), X1 represents a non-diffusible group, an adsorption accelerating group to silver halide, an alkylthio group, an arylthio group, a heterocyclic thio group, a quaternary ammonium group, a nitrogen-containing heterocyclic group containing a quaternized nitrogen atom, an alkoxy group having an ethyleneoxy or propyleneoxy unit, or a heterocyclic group containing a disulfide bond. These groups are the same as those described above as the substituent of $A_0$ in formula (I) or as the group included in the substituent.

In formula (1-a), when X1 represents an alkylthio group, an arylthio group, a heterocyclic thio group, a quaternary ammonium group, an alkoxy group having an ethyleneoxy or propyleneoxy unit, or a heterocyclic group containing a disulfide bond, $R_3$ is preferably an alkylene group and m3 represents 1.

In formula (1-a), when X1 represents a nitrogen-containing heterocyclic group containing a quaternized nitrogen atom, the nitrogen containing heterocyclic group may be quaternized by the bonding of the nitrogen atom to $R_3$ or the nitrogen-containing heterocyclic group which is previously quaternized may be bonded to L2 or L1 without intervention of R3. In the former case, m3 is 1 and R3 is preferably an alkylene group, and in the latter case, m3 is 0.

Among the compounds represented by formula (1-a), more preferred are those represented by formula (1-b):

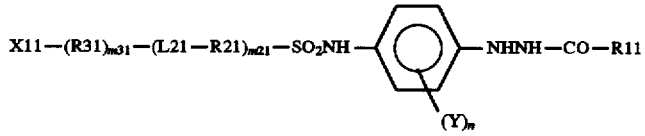

(1-b)

wherein X11, R11, R21, R31, L21, m21 and m31 have the same meanings as X1, R1, R2, R3, L2, m2 and m3 in formula (1-a), respectively, Y represents a substituent, and n represents 0 or an integer of from 1 to 4.

The substituent represented by Y has the same meaning and the same preferred range as those described above for the substituent which A1 of formula (1-a) may have.

n is preferably 0 or 1, more preferably 0.

In the compound represented by formula (1-b), when X11 represents an alkylthio group, the compound is more preferably represented by the following formula (1-c):

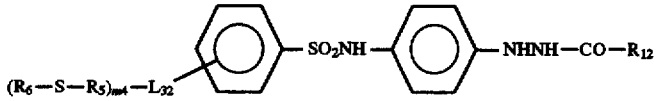

(1-c)

wherein $R_{12}$ has the same meaning as $R_{11}$ in formula (3), and $R_5$ represents an alkylene group.

$L_{32}$ represents, in the linking to a benzene ring, an acylamino group, a carbamoyl group, a ureido group, an oxycarbonyl group or a sulfonamide group.

When $L_{32}$ represents an acylamino group, an oxycarbonyl group or a sulfonamide group, m4 represents 1, and when $L_{32}$ represents a carbamoyl group or a ureido group, $m_4$ represents 1 or 2. When $m_4$ is 1, $R_6$ represents an unsubstituted alkyl group having a total carbon number of 7 or more, a substituted alkyl group having a total carbon number of from 1 to 18 or a cycloalkyl group having a total carbon number of 3 or more, and when m4 is 2, $R_6$ represents a substituted or unsubstituted alkyl group having a total carbon number of from 1 to 18 or a cycloalkyl group having a total carbon number of 3 or more.

Examples of the compound of the present invention are set forth below, however, the present invention is by no means limited thereto.

D-1

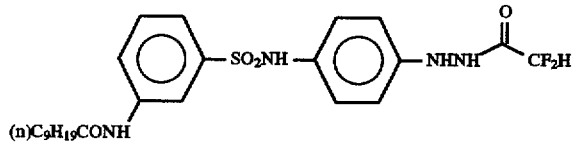

D-2

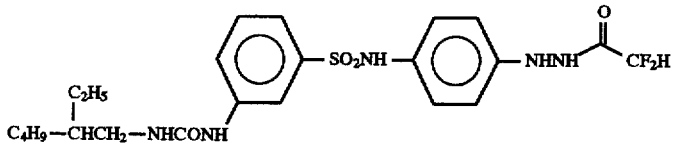

D-3

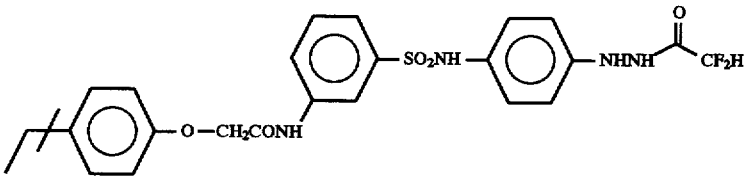

D-4

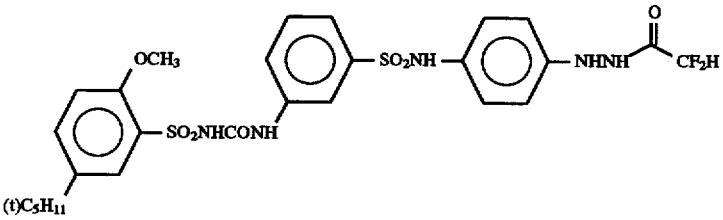

D-5

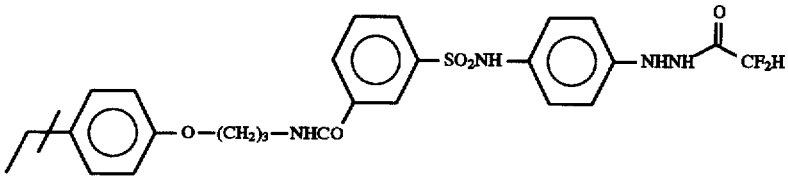

D-6

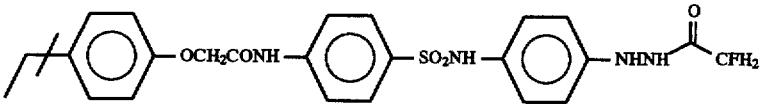

D-7

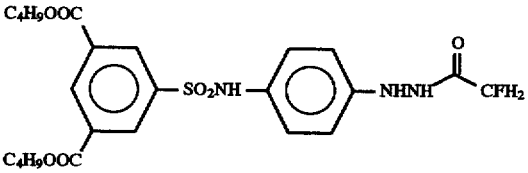

D-8

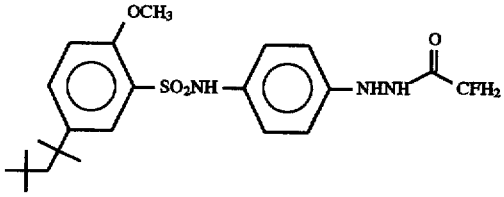

-continued
D-9
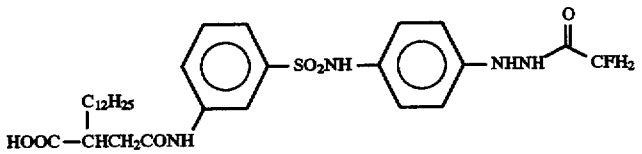
D-10
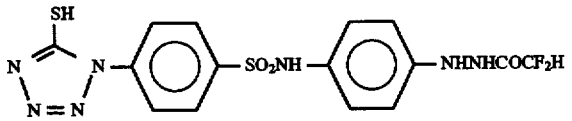
D-11
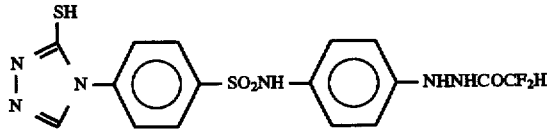
D-12
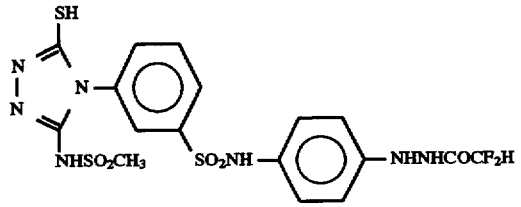
D-13
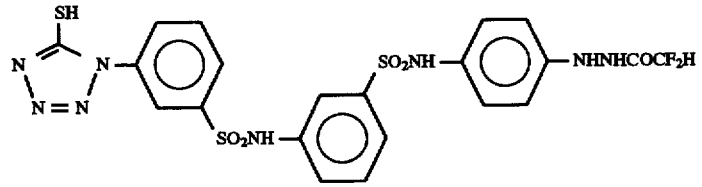
D-14
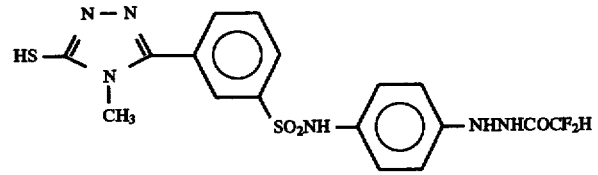
D-15
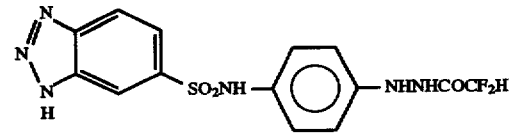
D-16
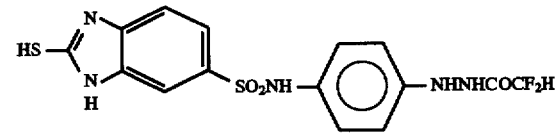
D-17
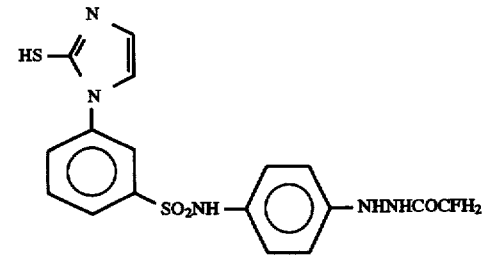

-continued
D-18
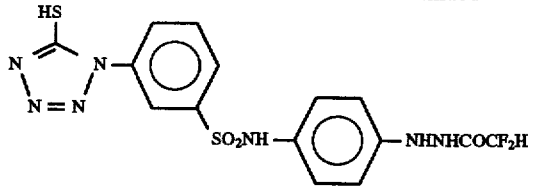
D-19
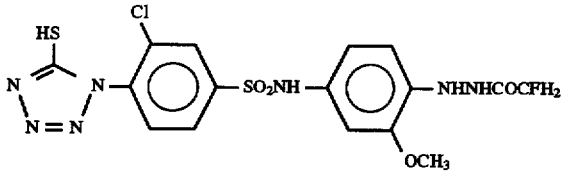
D-20
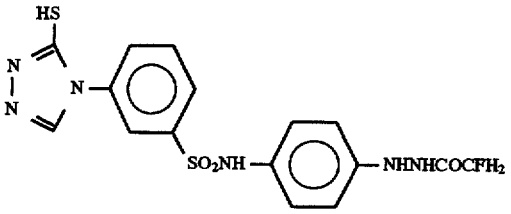
D-21
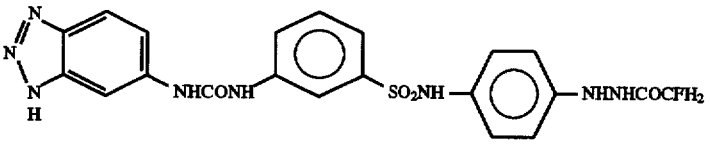
D-22
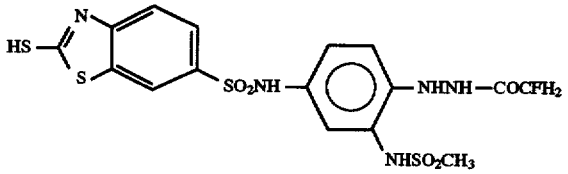
D-23
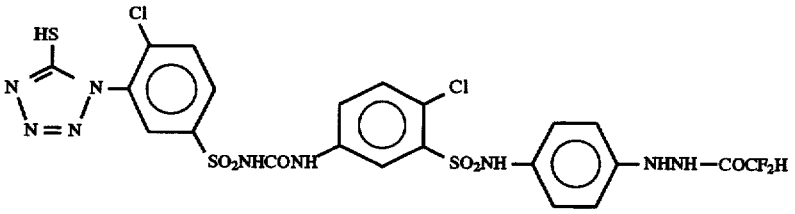
D-24
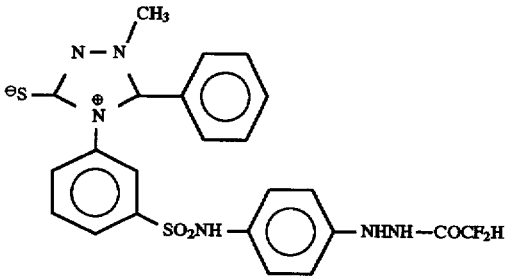
D-25
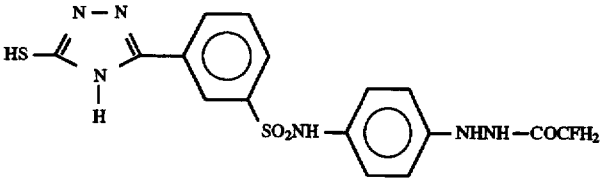

-continued
D-26
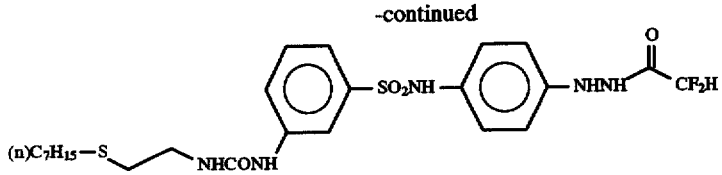
D-27
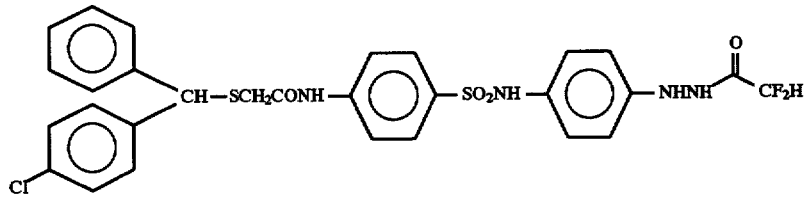
D-28
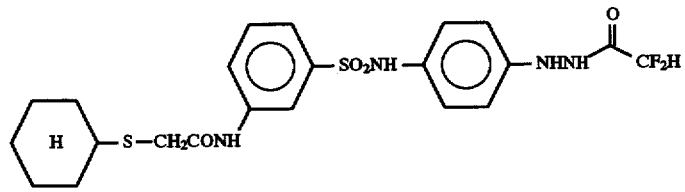
D-29
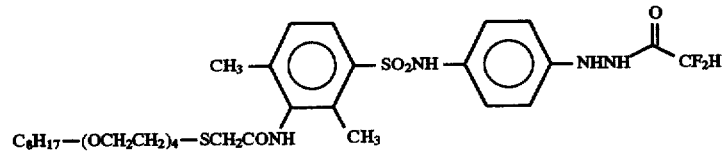
D-30
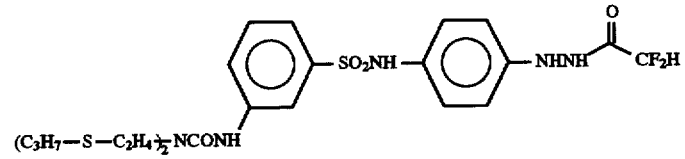
D-31
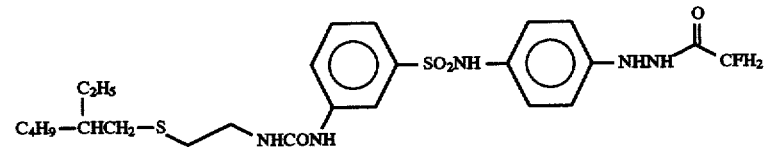
D-32
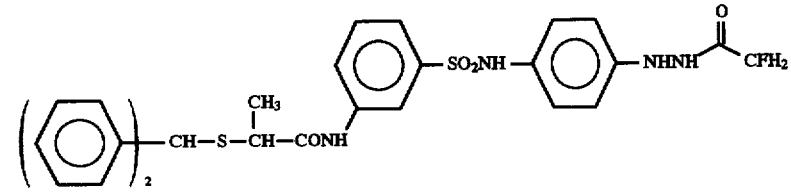
D-33
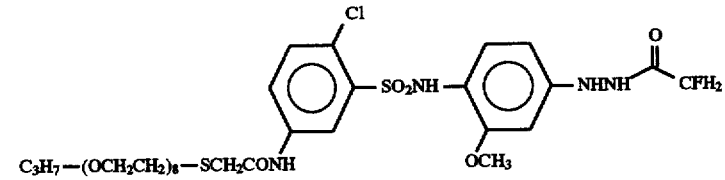
D-34
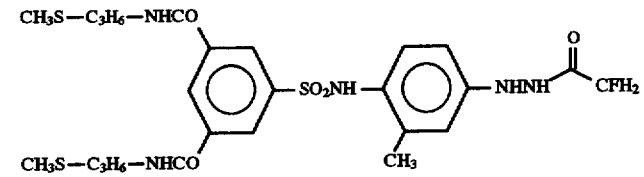

-continued
D-35
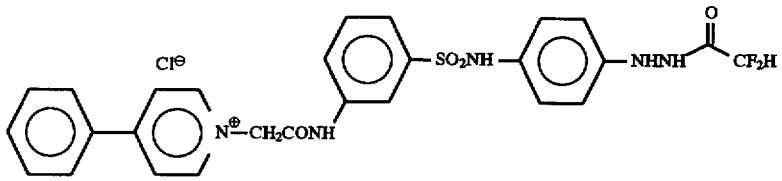
D-36
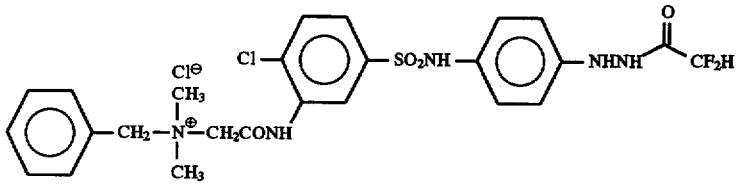
D-37
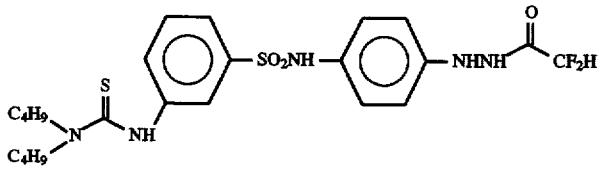
D-38
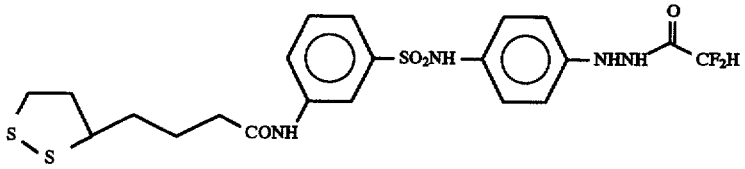
D-39
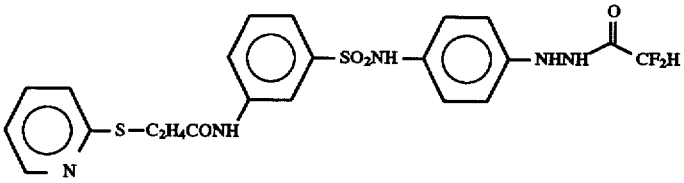
D-40
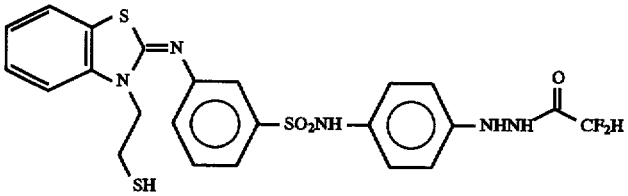
D-41
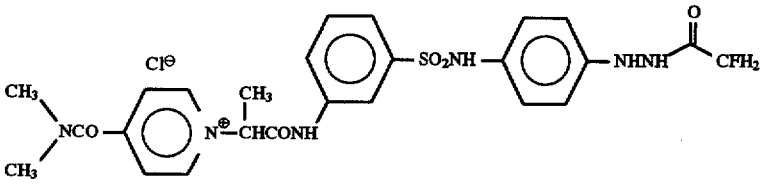
D-42
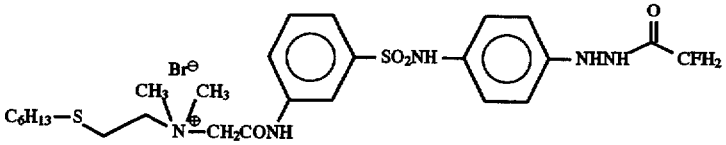

-continued
D-43
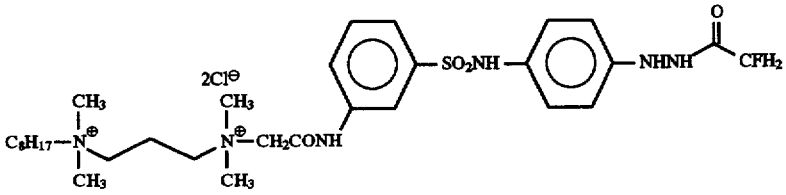
D-44
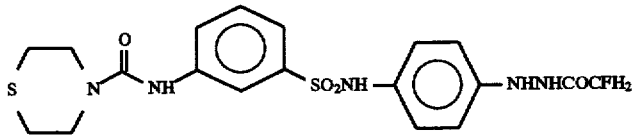
D-45
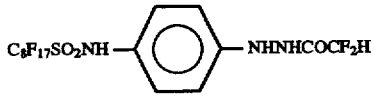
D-46
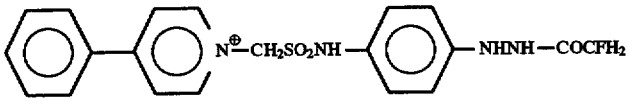
D-47
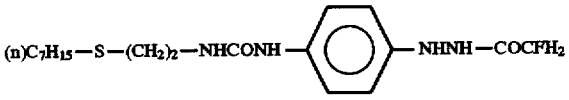
D-48
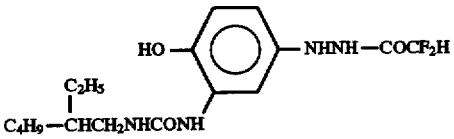
D-49
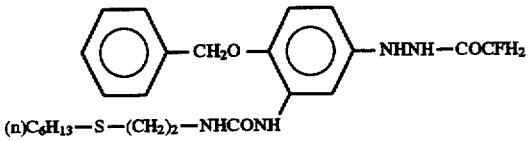
D-50
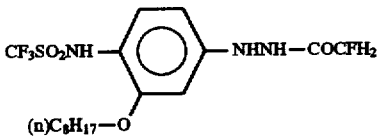
D-51
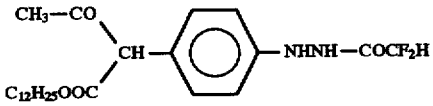
D-52
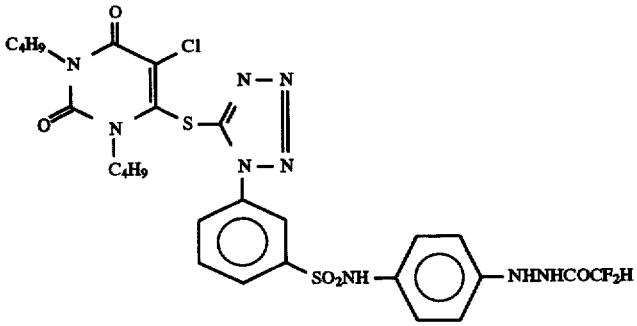

-continued

D-53

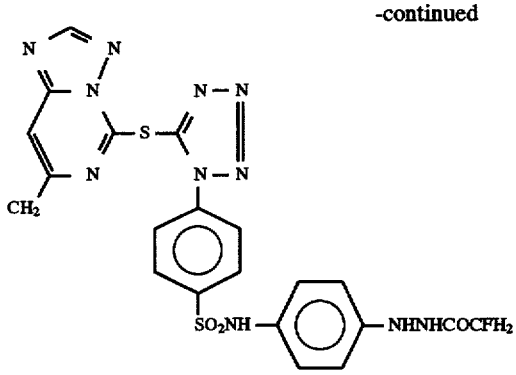

D-54

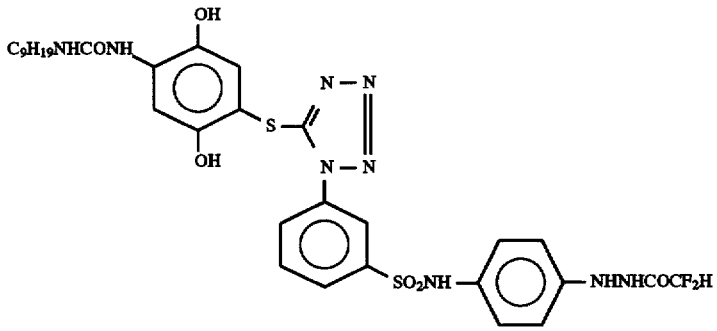

D-55

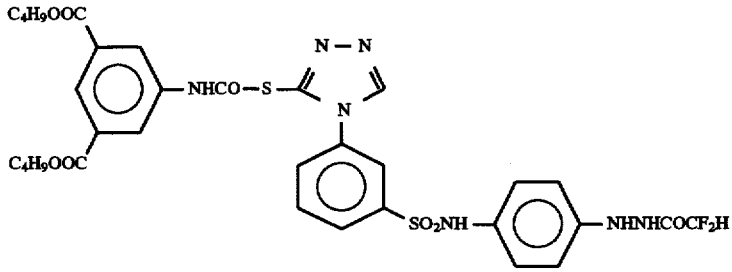

The hydrazine-base nucleating agent of the present invention may be dissolved in an appropriate water-miscible organic solvent such as an alcohol (e.g., methanol, ethanol, propanol, fluorinated alcohol), a ketone (e.g., acetone, methyl ethyl ketone), dimethylformamide, dimethylsulfoxide or methyl cellosolve, before use.

Also, the hydrazine-base nucleating agent of the present invention may be dissolved using an oil such as dibutyl phthalate, tricresyl phosphate, glyceryl triacetate or diethyl phthalate, or an auxiliary solvent such as ethyl acetate or cyclohexanone, by a conventionally known emulsion dispersion method, and mechanically processed into an emulsion dispersion before use. Or, the hydrazine derivative powder may be dispersed in water by means of a ball mill, a colloid mill or ultrasonic waves according to a method known as a solid dispersion method, and used.

The hydrazine-base nucleating agent of the present invention may be added to a silver halide emulsion layer on the silver halide emulsion layer side of a support or to any of other hydrophilic colloid layers, however, it is preferably added to the above-described silver halide emulsion layer or to a hydrophilic colloid layer adjacent thereto.

The addition amount of the nucleating agent of the present invention is preferably from $1\times10^{-6}$ to $1\times10^{-2}$ mol, more preferably from $1\times10^{-5}$ to $5\times10^{-3}$ mol, most preferably from $2\times10^{-5}$ to $5\times10^{-3}$ mol, per mol of silver halide.

The nucleation accelerator for use in the present invention includes an amine derivative, an onium salt, a disulfide derivative and a hydroxymethyl derivative. Examples thereof are described below:

Compounds A-1) to A-73) described in JP-A-7-77783, pp. 49–58; compounds represented by (Chem. 21), (Chem. 22) and (Chem. 23) in JP-A-7-84331, specifically, compounds described at pages 6 to 8; compounds represented by formulae [Na] and [Nb] in JP-A-7-104426, specifically, Compounds Na-1 to Na-22 and Nb-1 to Nb-12 described at pages 16 to 20; and compounds represented by formulae (1), (2), (3), (4), (5), (6) and (7) in Japanese Patent Application No. 7-37817, specifically, Compounds 1-1 to 1-19, Compounds 2-1 to 2-22, Compounds 3-1 to 3-36, Compounds 4-1 to 4-5, Compounds 5-1 to 5-41, Compounds 6-1 to 6-58 and Compounds 7-1 to 7-38.

The nucleation accelerator for use in the present invention is particularly preferably a compound represented by formula (III), (IV) or (V). The nucleation accelerators represented by formulae (III) and (IV) are described in detail below.

(III)

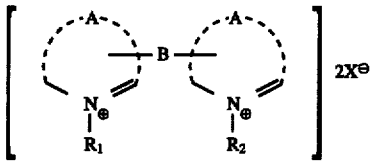

(IV)

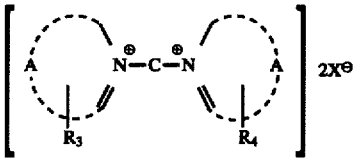

In the formulae, A represents an organic group for completing the heterocyclic ring, which may contain a carbon atom, a hydrogen atom, an oxygen atom, a nitrogen atom or a sulfur atom, or may further be condensed with a benzene ring. A is preferably a 5- or 6-membered ring, more preferably a pyridine ring. B and C each represents alkylene, arylene, alkenylene, $—SO_2—$, —SO—, —O—, —S—, $—N(R_5)—$ (wherein $R_5$ represents an alkyl group, an aryl group or a hydrogen atom) or a group comprising a combination thereof. B and C each is preferably alkylene, arylene, —O—, —S— or a group comprising a combination thereof.

$R_1$ and $R_2$, which may be the same or different, each represents an alkyl group having from 1 to 20 carbon atoms. The alkyl group may be substituted by a substituent and examples of the substituent include a halogen atom (e.g., chlorine, bromine), a substituted or unsubstituted alkyl group (e.g., methyl, hydroxyethyl), a substituted or unsubstituted aryl group (e.g., phenyl, tolyl, p-chlorophenyl), a substituted or unsubstituted acyl group (e.g., benzoyl, p-bromobenzoyl, acetyl), a sulfo group, a carboxy group, a hydroxy group, an alkoxy group (e.g., methoxy, ethoxy), an aryloxy group, an amide group, a sulfamoyl group, a carbamoyl group, a ureido group, an unsubstituted or alkyl-substituted amino group, a cyano group, a nitro group, an alkylthio group and an arylthio group. $R_1$ and $R_2$ each is preferably an alkyl group having from 1 to 10 carbon atoms. Preferred examples of the substituent include an aryl group, a sulfo group, a carboxy group and a hydroxy group. $R_3$ and $R_4$ each represents a substituent and examples of the substituent are the same as those described above as the substituent of $R_1$ or $R_2$. $R_3$ and $R_4$ each preferably has from 0 to 10 carbon atoms and specific examples thereof include an aryl-substituted alkyl group and a substituted or unsubstituted aryl group.

X represents an anion group, however, when an inner salt is formed, X is not required. Examples of X include a chlorine ion, a bromine ion, an iodine ion, a nitrate ion, a sulfate ion, a p-toluene sulfonate ion and an oxalate.

Specific compounds of the present invention are described below, but the present invention is by no means limited thereto. The compound of the present invention can be easily synthesized by a commonly well known method, however, *Quart. Rev.*, 16, 163 (1962) may be referred to for the synthesis.

Specific examples of the compounds represented by formulae (III) and (IV) are set forth below, but the present invention is by no means limited thereto.

A-1

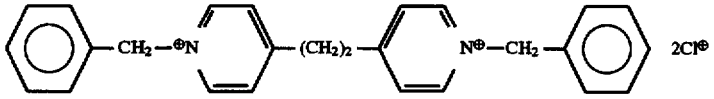

A-2

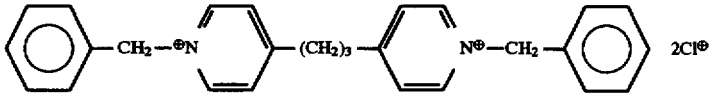

A-3

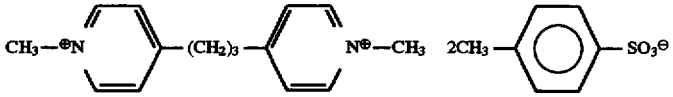

A-4

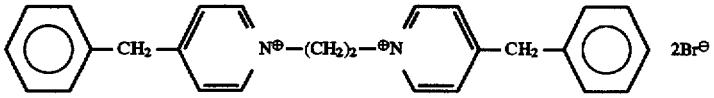

A-5

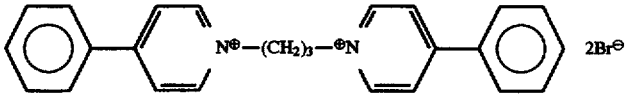

A-6

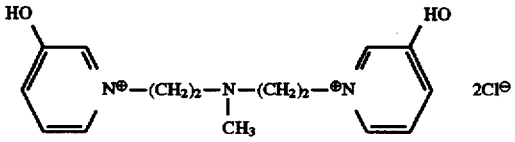

-continued
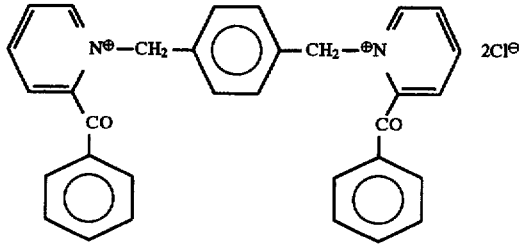
A-7
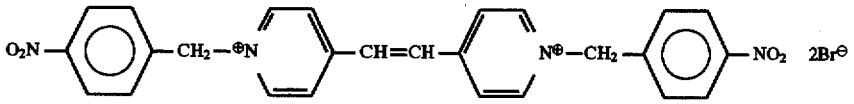
A-8
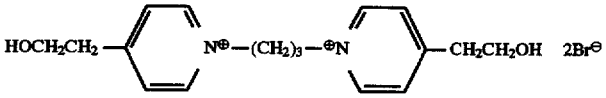
A-9
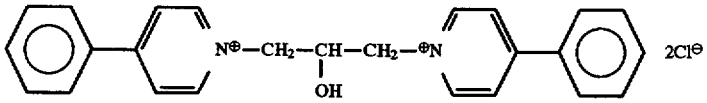
A-10
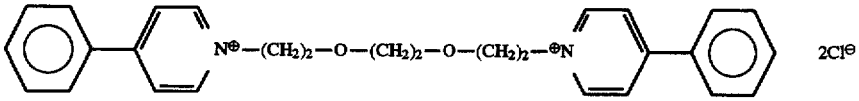
A-11
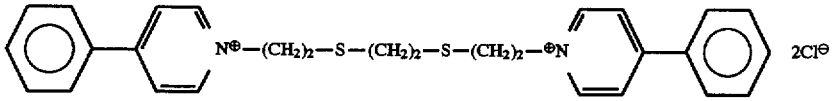
A-12
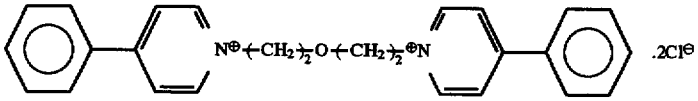
A-13
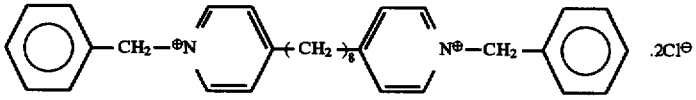
A-14
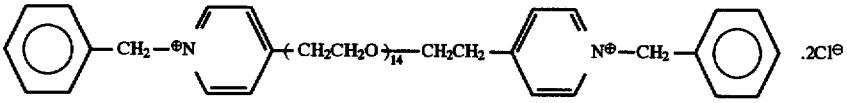
A-15
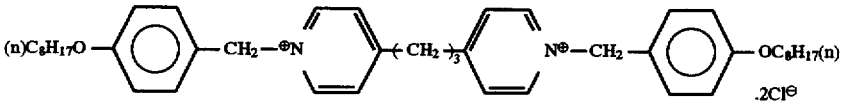
A-16
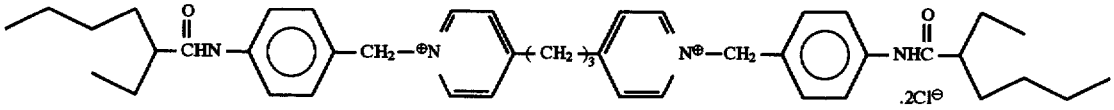
A-17
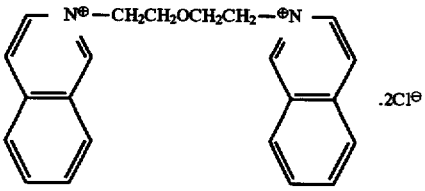
A-18

-continued

A-19

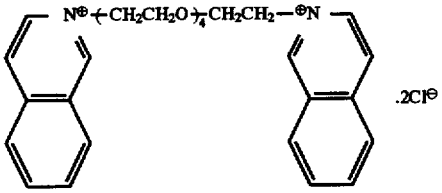

The nucleation accelerator represented by formula (V) is described in detail below.

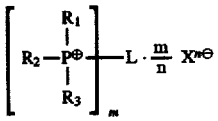

(V)

wherein $R_1$, $R_2$ and $R_3$ each represents an alkyl group, a cycloalkyl group, an aryl group, an alkenyl group, a cycloalkenyl group or a heterocyclic residue, and these groups each may further have a substituent, m represents an integer, L represents an m-valent organic group bonded to the P atom through the carbon atom thereof, n represents an integer of from 1 to 3, and X represents an n-valent anion, provided that X may be linked with L.

Examples of the group represented by $R_1$, $R_2$ or $R_3$ include a linear or branched alkyl group such as a methyl group, an ethyl group, a propyl group, an isopropyl group, a butyl group, an isobutyl group, a sec-butyl group, a tert-butyl group, an octyl group, a 2-ethylhexyl group, a dodecyl group, a hexadecyl group and an octadecyl group; a cycloalkyl group such as a cyclopropyl group, a cyclopentyl group and a cyclohexyl group; an aryl group such as a phenyl group, a naphthyl group and a phenanthryl group; an alkenyl group such as an allyl group, a vinyl group and a 5-hexenyl group; a cycloalkenyl group such as a cyclopentenyl group and a cyclohexenyl group; and a heterocyclic residue such as a pyridyl group, a quinolyl group, a furyl group, an imidazolyl group, a thiazolyl group, a thiadiazolyl group, a benzotriazolyl group, a benzothiazolyl group, a morpholyl group, a pyrimidyl group and a pyrrolidyl group.

Examples of the substituent substituted on each of these groups include, in addition to the groups represented by $R_1$, $R_2$ and $R_3$, a halogen atom such as fluorine atom, chlorine atom, bromine atom and iodine atom, a nitro group, a primary amino group, a secondary amino group, a tertiary amino group, an alkyl ether group, an aryl ether group, an alkyl thioether group, an aryl thioether group, a carbonamide group, a carbamoyl group, a sulfonamide group, a sulfamoyl group, a hydroxyl group, a sulfoxy group, a sulfonyl group, a carboxyl group, a sulfonic acid group, a cyano group and a carbonyl group.

Examples of the group represented by L include, in addition to the groups having the same meaning as $R_1$, $R_2$ and $R_3$, a polymethylene group such as a trimethylene group, a tetramethylene group, a hexamethylene group, a pentamethylene group, an octamethylene group and a dodecamethylene group; a divalent aromatic group such as a phenylene group, a biphenylene group and a naphthylene group; a polyvalent aliphatic group such as a trimethylenemethyl group and a tetramethylenemethyl group; and a polyvalent aromatic group such as a phenylene-1,3,5-toluyl group and a phenylene-1,2,4,5-tetrayl group.

Examples of the anion represented by X include a halogen ion such as chlorine ion, bromine ion and iodine ion; a carboxylate ion such as acetate ion, oxalate ion, fumarate ion and benzoate ion; a sulfonate ion such as p-toluene sulfonate, methane sulfonate, butane sulfonate and benzene sulfonate; a sulfate ion; a perchlorate ion; a carbonate ion; and a nitrate ion.

In formula (V), $R_1$, $R_2$ and $R_3$ each is preferably a group having 20 or less carbon atoms, more preferably an aryl group having 15 or less carbon atoms. m is preferably 1 or 2. When m represents 1, L is preferably a group having 20 or less carbon atoms, more preferably an alkyl or aryl group having a total carbon number of 15 or less, and when m represents 2, the divalent organic group represented by L is preferably an alkylene group, an arylene group, a divalent group formed by combining these groups, or a group formed by combining these groups with a —CO— group, an —O— group, an —$NR_4$— group (wherein $R_4$ represents a hydrogen atom or a group having the same meaning as $R_1$, $R_2$ or $R_3$, and when a plurality of $R_4$ groups are present in a molecule, they may be the same or different or may be combined with each other), an —S— group, an —SO— group or an —$SO_2$— group. When m represents 2, L is more preferably a divalent group having a total carbon number of 20 or less, bonded to the P atom through the carbon atom thereof. When m represents an integer of 2 or greater, $R_1$, $R_2$ and $R_3$ each is present in plurality in the molecule and the $R_1$ groups, the $R_2$ groups or the $R_3$ groups may be the same or different. n is preferably 1 or 2. X may be bonded to $R_1$, $R_2$, $R_3$ or L to form an inner salt.

Many of the compounds represented by formula (V) of the present invention are known and commercially available as a reagent. The general synthesis method thereof include a method of reacting a phosphinic acid with an alkylating agent such as an alkyl halide or a sulfonic acid ester, and a method of exchanging the counter anion of a phosphonium salt by a usual method.

Specific examples of the compound represented by formula (V) are set forth below, however, the present invention is by no means limited to these compounds.

IV-1

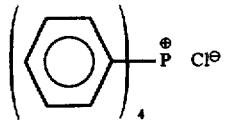

-continued
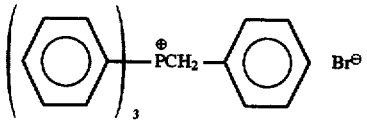
IV-2
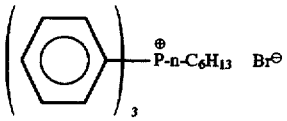
IV-3
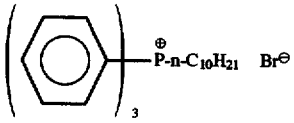
IV-4
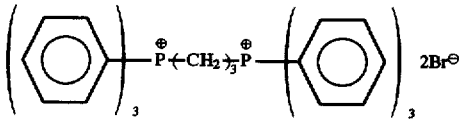
IV-5
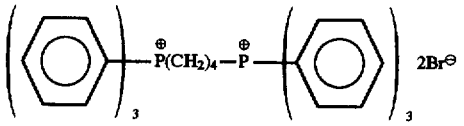
IV-6
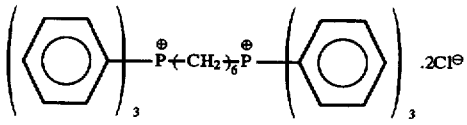
IV-7
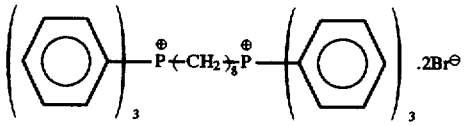
IV-8
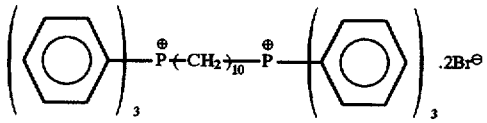
IV-9
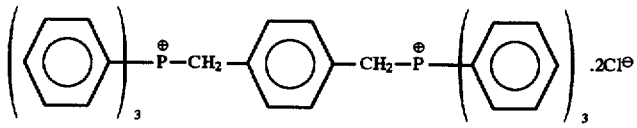
IV-10
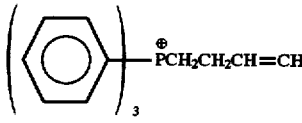
IV-11
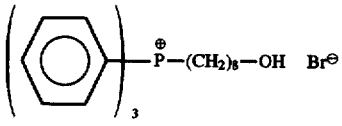
IV-12
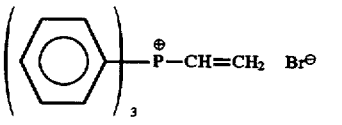
IV-13

-continued
IV-14
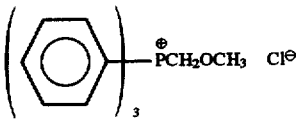
IV-15
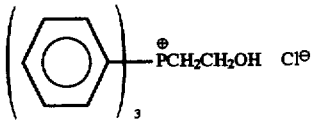
IV-16
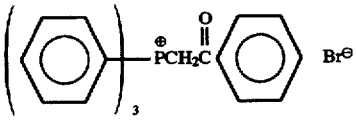
IV-17
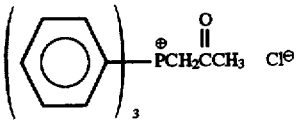
IV-18
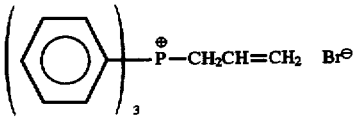
IV-19
$(n\text{-}C_4H_9)_3\overset{\oplus}{P}\text{-}n\text{-}C_{16}H_{33}$ $Br^{\ominus}$
IV-20
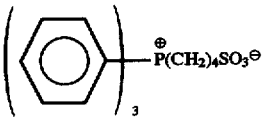
IV-21
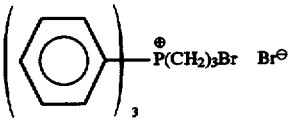
IV-22
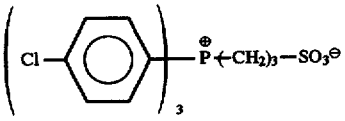
IV-23
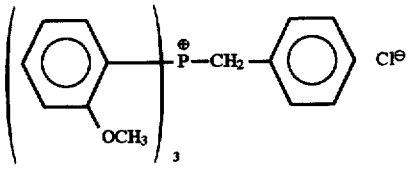
IV-24
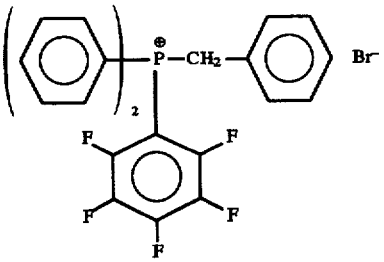

-continued

IV-25

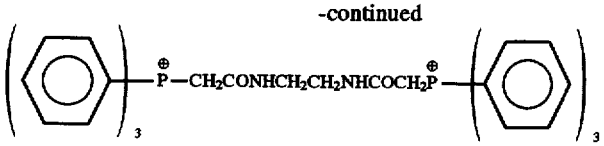

2Cl⁻

IV-26

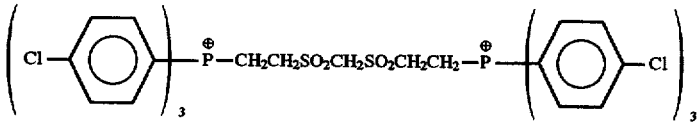

$2BF_4^{\ominus}$

IV-27

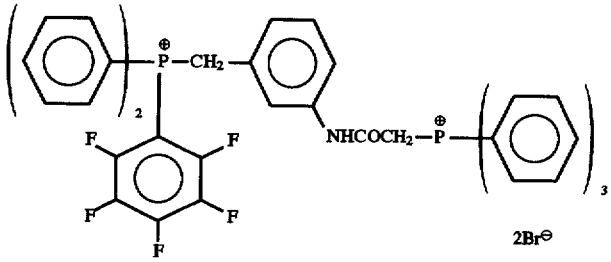

$2Br^{\ominus}$

IV-28

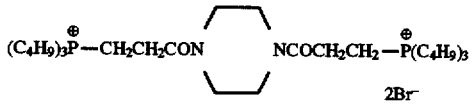

2Br⁻

IV-29

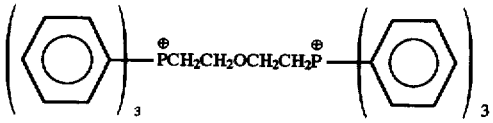

2Cl⁻

IV-30

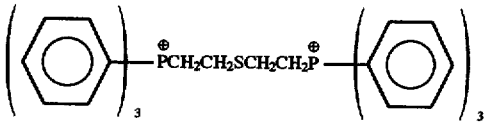

2Br⁻

IV-31

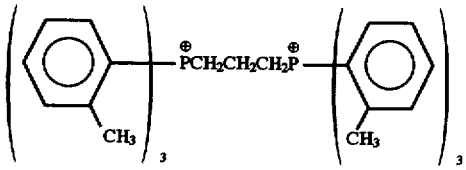

2Br⁻

IV-32

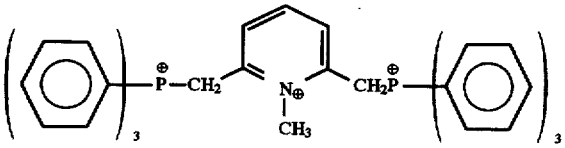

$3CF_3SO_3^{\ominus}$

The nucleation accelerator of the present invention may be dissolved in an appropriate water-miscible organic solvent such as an alcohol (e.g., methanol, ethanol, propanol, fluorinated alcohol), a ketone (e.g., acetone, methyl ethyl ketone), dimethylformamide, dimethyl sulfoxide or methyl cellosolve, before use.

Also, the nucleation accelerator of the present invention may be dissolved using an oil such as dibutyl phthalate, tricresyl phosphate, glyceryl triacetate or diethyl phthalate, or an auxiliary solvent such as ethyl acetate or cyclohexanone, by a conventionally known emulsion dispersion method, and mechanically processed into an emulsion dispersion before use. Or, the nucleation accelerator powder may be dispersed in water by means of a ball mill, a colloid mill or ultrasonic waves according to a method known as a solid dispersion method, and used.

The nucleation accelerator of the present invention may be added to a silver halide emulsion layer on the silver halide emulsion layer side of a support or to any of other hydrophilic colloid layers, however, it is preferably added to the above-described silver halide emulsion layer or to a hydrophilic colloid layer adjacent thereto.

The addition amount of the nucleation accelerator of the present invention is preferably from $1\times10^{-6}$ to $2\times10^{-2}$ mol, more preferably from $1\times10^{-5}$ to $2\times10^{-2}$ mol, most preferably from $2\times10^{-5}$ to $1\times10^{-2}$ mol, per mol of silver halide.

The light-sensitive silver halide emulsion of the present invention may be spectrally sensitized to blue light, green light, red light or infrared light, each having a relatively long wavelength, by a sensitizing dye.

The addition amount of the sensitizing dye for use in the present invention varies depending upon the shape or size of silver halide grains, however, it is usually from $4\times10^{-6}$ to $8\times10^{-3}$ mol per mol of silver halide. For example, when the silver halide grain size is from 0.2 to 1.3 μm, the addition amount is preferably from $2\times10^{-7}$ to $3.5\times10^{-6}$ mol, more preferably from $6.5\times10^{-7}$ to $2.0\times10^{-6}$ mol, per 1 $m^2$ of the surface area of a silver halide grain.

Examples of the sensitizing dye which can be used include a cyanine dye, a merocyanine dye, a complex cyanine dye, a complex merocyanine dye, a holopolar cyanine dye, a styryl dye, a hemicyanine dye, an oxonol dye and a hemioxonol dye.

Useful sensitizing dyes for use in the present invention are described, for example, in *Research Disclosure*, Item 17643, IV-A, page 23 (December, 1978), ibid., Item 1831, X, page 437 (August, 1978), and publications cited therein.

A sensitizing dye having spectral sensitivity suitable for spectral characteristics of various scanner light sources may be advantageously selected.

For example, A) for an argon laser light source, simple merocyanines described in JP-A-60-162247, JP-A-2-48653, U.S. Pat. No. 2,161,331, West German Patent 936,071 and JP-A-5-11389, B) for a helium-neon laser light source, trinuclear cyanine dyes described in JP-A-50-62425, JP-A-54-18726 and JP-A-59-102229, C) for an LED light source and a red semiconductor laser, thiacarbocyanines described in JP-B-48-42172, JP-B-51-9609, JP-B-55-39818, JP-A-62-284343 and JP-A-2-105135, and D) for an infrared semiconductor laser light source, tricarbocyanines described in JP-A-59-191032 and JP-A-60-80841, and dicarbocyanines containing a 4-quinoline nucleus described in JP-A-59-192242 and JP-A-3-67242, formulae (IIIa) and (IIIb), may be advantageously selected.

These sensitizing dyes may be used individually or in combination, and the combination of sensitizing dyes is often used for the purpose of supersensitization. In combination with the sensitizing dye, a dye which itself has no spectral sensitization effect or a material which absorbs substantially no visible light, but exhibits supersensitization may be incorporated into the emulsion.

Useful sensitizing dyes, combinations of dyes which exhibit supersensitization, and materials which show supersensitization are described in *Research Disclosure*, Vol. 176, 17643, page 23, Item IV-J (December, 1978).

For the argon laser light source, the following dyes are preferably used.

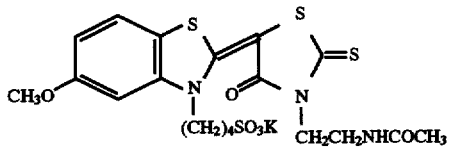

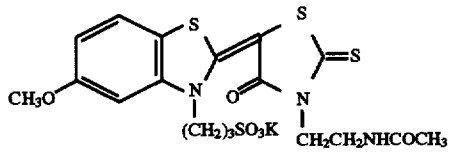

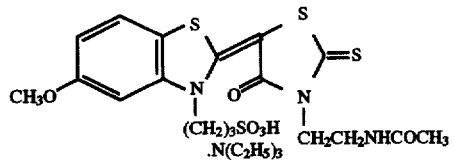

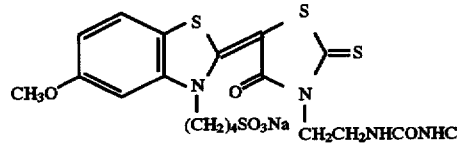

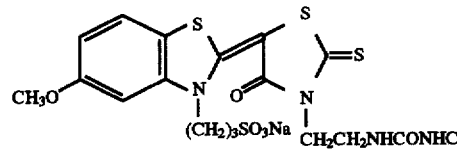

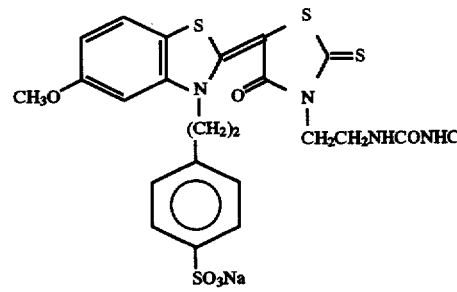

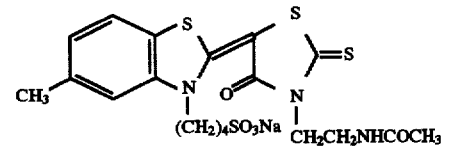

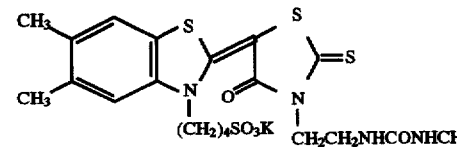

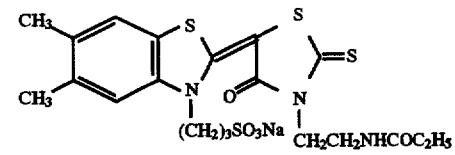

-continued

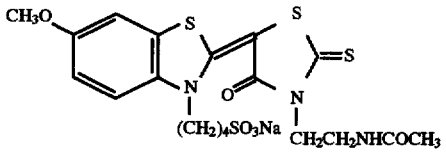

S1-10

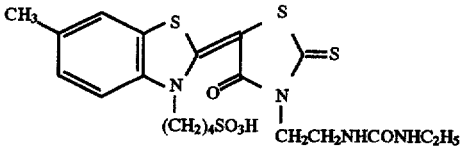

S1-11

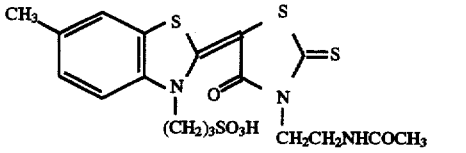

S1-12

-continued

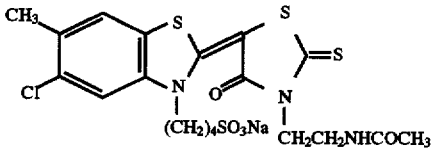

S1-13

For the helium-neon light source, in addition to the above-described dyes, the sensitizing dyes represented by formula (I) at page 8, line 1 from the bottom to page 13, line 4 of Japanese Patent Application No. 4-228745 (corresponding to JP-A-6-75322) are particularly preferred. Specific examples thereof are set forth below, however, other than these dyes, any of the sensitizing dyes represented by formula (I) of Japanese Patent Application No. 4-228745 is preferably used.

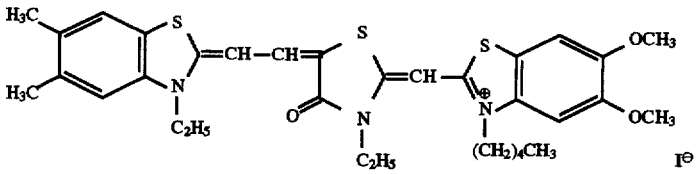

S2-1

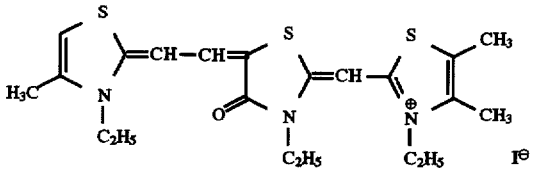

S2-2

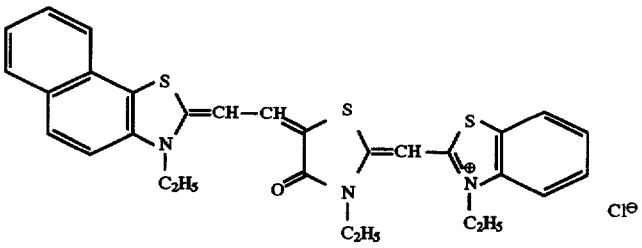

S2-3

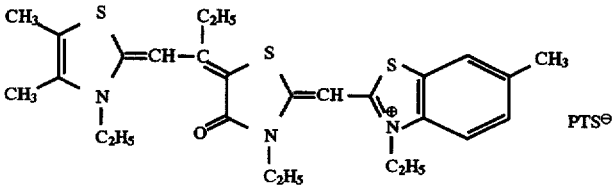

S2-4

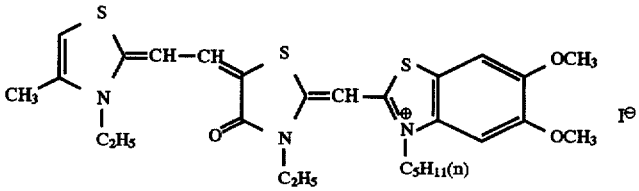

S2-5

-continued
S2-6
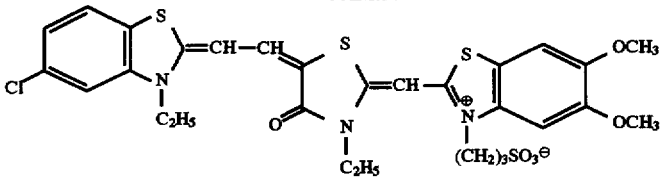
S2-7
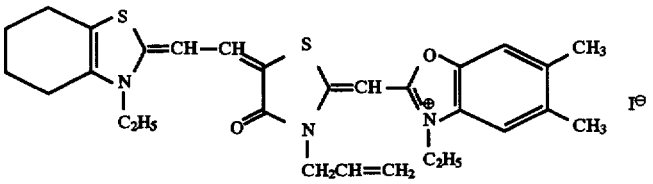
S2-8
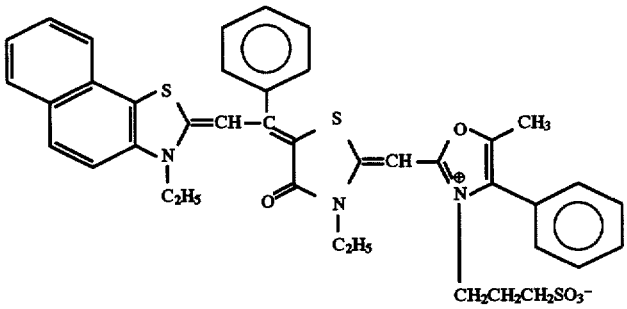
S2-9
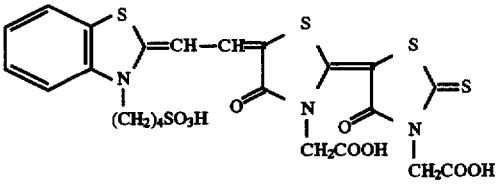
S2-10
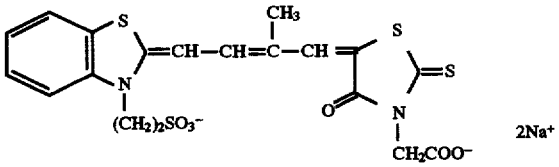
For the LED light source and the infrared semiconductor laser, the following dyes are particularly preferably used.
S3-1
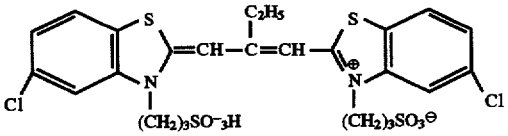
S3-2
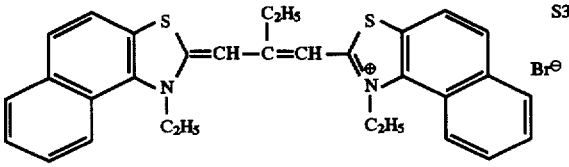
S3-3
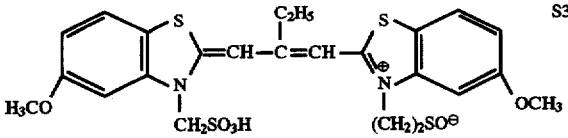
-continued
S3-4
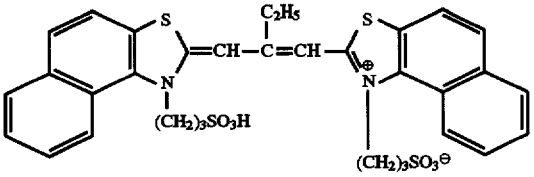
S3-5
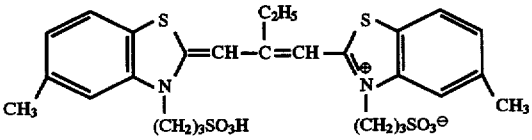
S3-6
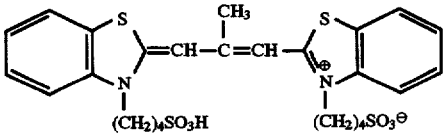

-continued
S3-7
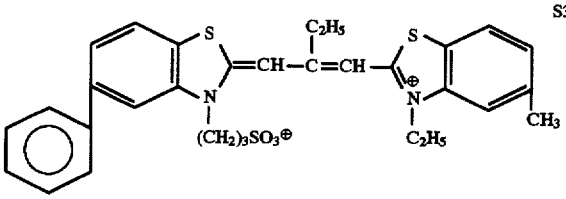
S3-8
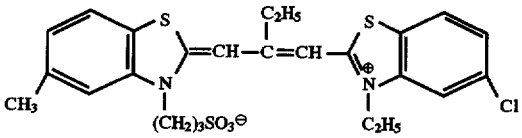
For the infrared semiconductor laser light source, the following dyes are preferably used.
S4-1
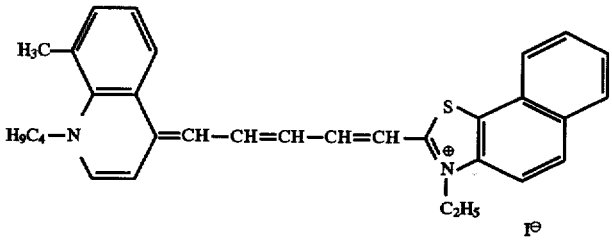
S4-2
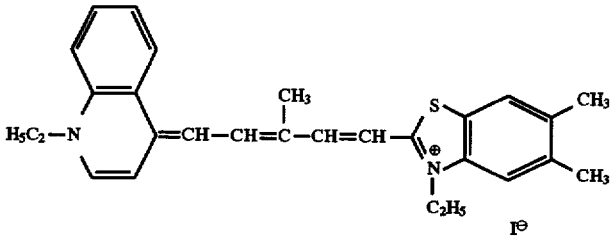
S4-3
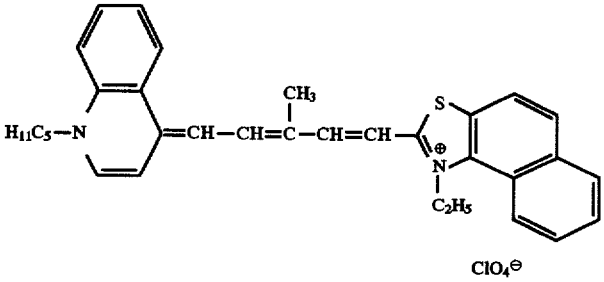
S4-4
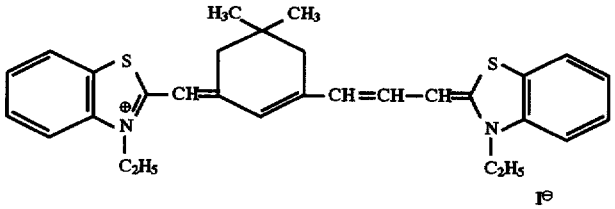
S4-5
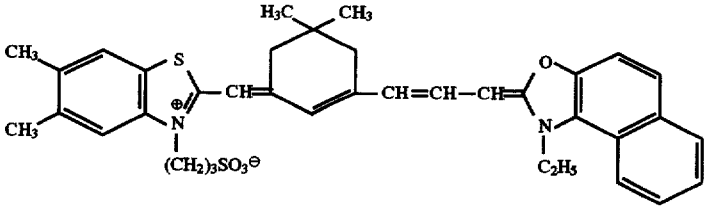

-continued
S4-6
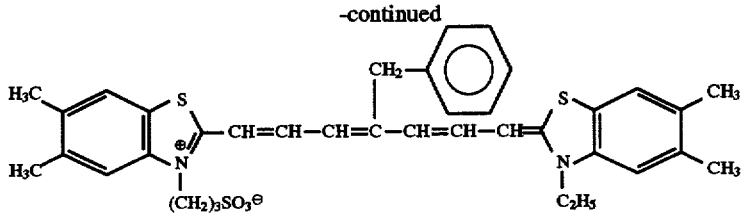
S4-7
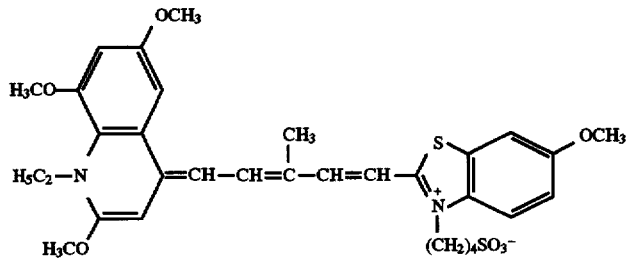
S4-8
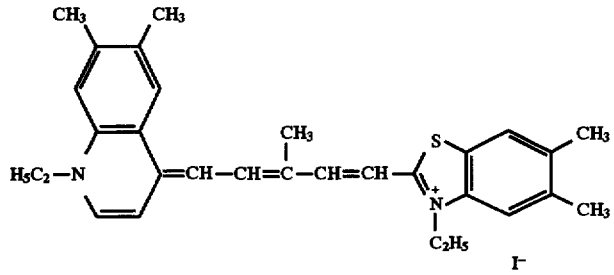
S4-9
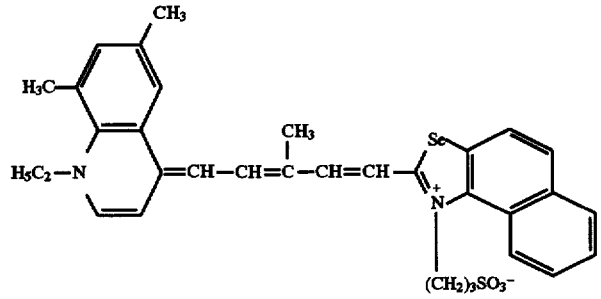
For the white light source in camera work, sensitizing dyes represented by formula (IV) of Japanese Patent Application No. 5-201254 (corresponding to JP-A-7-36139; from page 20, line 14 to page 22, line 23) are preferably used. Specific examples of the compounds are set forth below.
S5-1
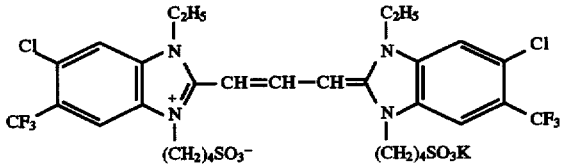
S5-2
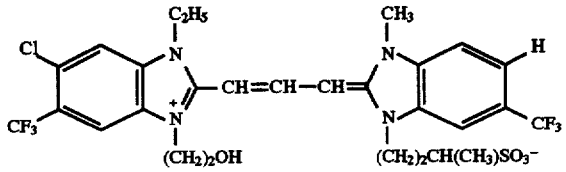

-continued
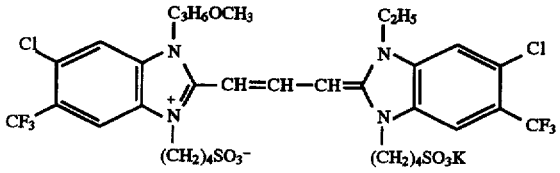
S5-3
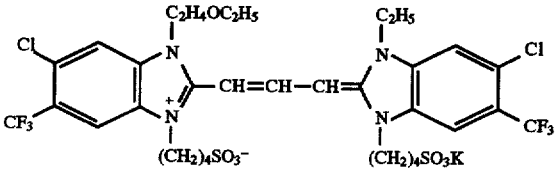
S5-4
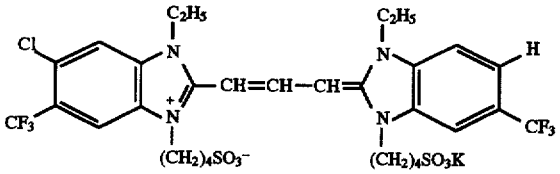
S5-5
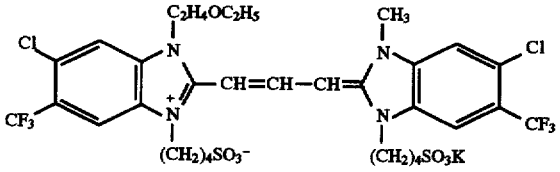
S5-6
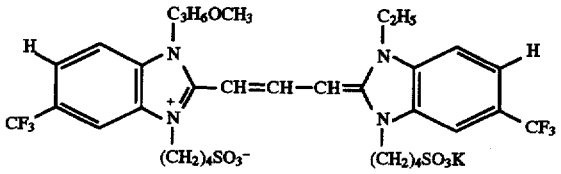
S5-7
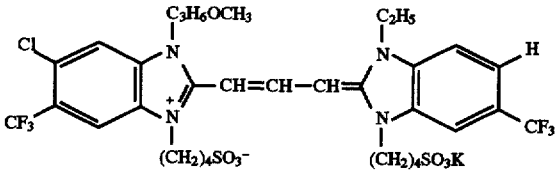
S5-8
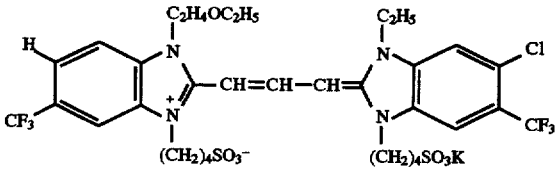
S5-9
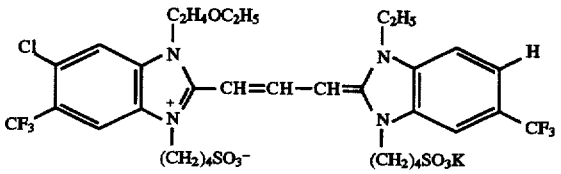
S5-10
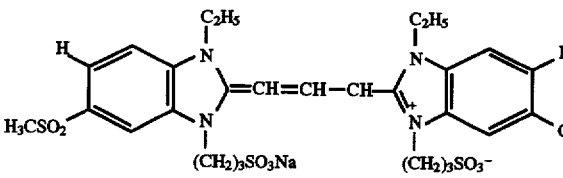
S5-11

-continued
S5-12
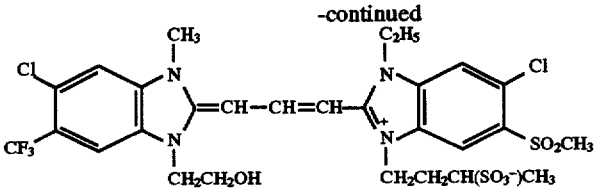
S5-13
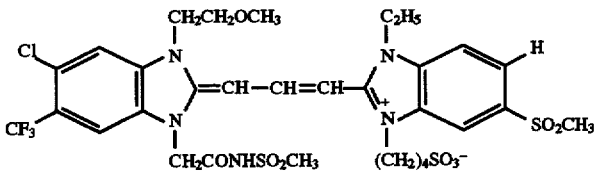
S5-14
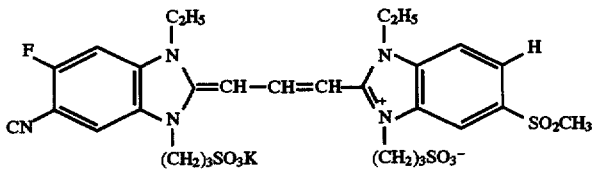
S5-15
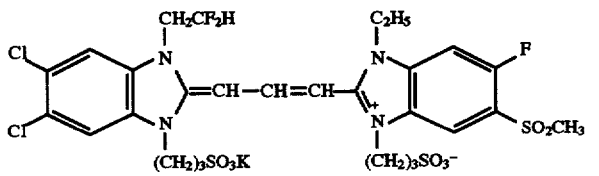
S5-16
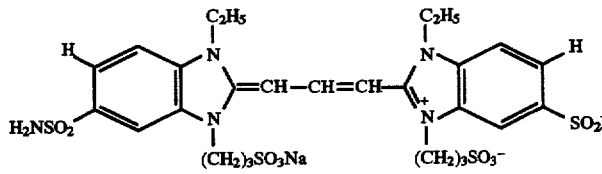
S5-17
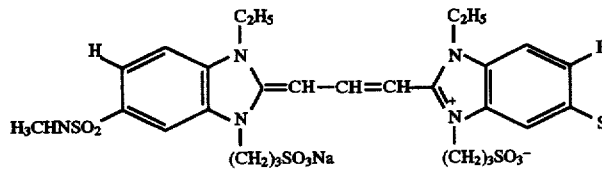
S5-18
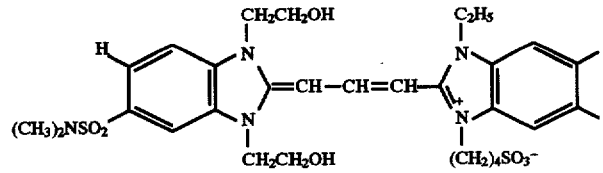
S5-19
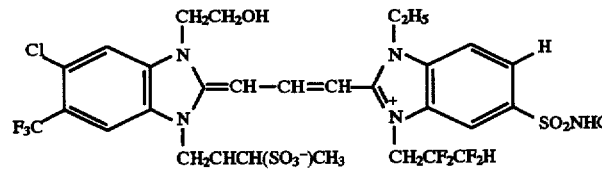
S5-20
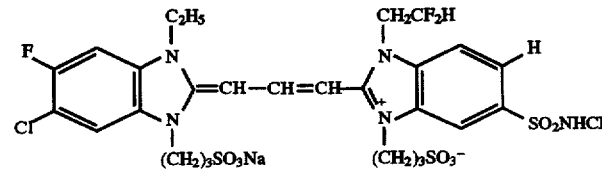
The halogen composition of the silver halide emulsion for use in the present invention is not particularly limited, however, in order to achieve the object of the present invention more effectively, silver chloride, silver chlorobromide and silver chloroiodide, each having a silver chloride content of 50 mol % or more are preferred. The silver iodide content is preferably 5 mol % or less, more preferably 2 mol % or less.

In the present invention, the light-sensitive material suitable for high illumination exposure such as scanner exposure and the light-sensitive material for line camera work contain a rhodium compound so as to achieve high contrast and low fogging.

The rhodium compound for use in the present invention may be a water-soluble rhodium compound. Examples thereof include a rhodium(III) halide compound and a rhodium complex salt having a halogen, an amine or an oxalate as a ligand, such as hexachlororhodium(III) complex salt, hexabromorhodium(III) complex salt, hexaaminerhodium(III) complex salt and trioxalatorhodium (III) complex salt. The above-described rhodium compound is dissolved in water or an appropriate solvent before use and a method commonly used for stabilizing the rhodium compound solution, namely, a method of adding an aqueous solution of hydrogen halogenide (e.g., hydrochloric acid, bromic acid, hydrofluoric acid) or an alkali halide (e.g., KCl, NaCl, KBr, NaBr), may be used. In place of using a water-soluble rhodium, separate silver halide grains which are previously doped with rhodium may be added and dissolved at the time of preparation of silver halide.

The addition amount of the rhodium compound is from $1\times10^{-8}$ to $5\times10^{-6}$ mol/mol, preferably from $5\times10^{-8}$ to $1\times10^{-6}$ mol/mol, per mol of silver of the silver halide emulsion.

The rhodium compound may be added during production of silver halide emulsion grains or at an appropriate stage before coating of the emulsion, however, it is preferably added at the time of formation of the emulsion to incorporate it into a silver halide grain.

The photographic emulsion for use in the present invention can be prepared using a method described in P. Glafkides, *Chimie et Physique Photographique*, Paul Montel (1967), G. F. Duffin, *Photographic Emulsion Chemistry*, The Focal Press (1966), and V. L. Zelikman et al, *Making and Coating Photographic Emulsion*, The Focal Press (1964).

A soluble silver salt may be reacted with a soluble halogen salt by any of a single jet method, a double jet method and a combination thereof.

A method of forming grains in the presence of excessive silver ions (so-called reverse mixing process) may also be used. As one of the double jet method, a method of maintaining the pAg in the liquid phase where silver halide is produced, constant, namely, a so-called controlled double jet method may be used. Further, it is preferred to form grains using a so-called silver halide solvent such as ammonia, thioether or tetra-substituted thiourea, more preferably using a tetra-substituted thiourea compound, and this is described in JP-A-53-82408 and JP-A-55-77737. Preferred examples of the thiourea compound include tetramethyl thiourea and 1,3-dimethyl-2-imidazolidinethione.

According to the controlled double jet method or the method of forming grains using a silver halide solvent, a silver halide emulsion comprising regular crystal form grains and having a narrow grain size distribution can be easily prepared, and these methods are a useful means for preparing the silver halide emulsion for use in the present invention.

In order to achieve a uniform grain size, it is preferred to rapidly grow grains within the range of not exceeding the critical saturation degree, using a method of changing the addition rate of silver nitrate or alkali halide according to the grain growth rate as described in British Patent 1,535,016, JP-B-48-36890 and JP-B-52-16364, or a method of changing the concentration of the aqueous solution as described in British Patent 4,242,445 and JP-A-55-158124.

The emulsion of the present invention is preferably a monodisperse emulsion having a coefficient of variation of 20% or less, more preferably 15% or less.

The grains in the monodisperse silver halide emulsion have an average grain size of 0.5 μm or less, more preferably from 0.1 to 0.4 μm.

The silver halide emulsion of the present invention is preferably subjected to chemical sensitization. The chemical sensitization may be performed using a known method such as sulfur sensitization, selenium sensitization, tellurium sensitization or noble metal sensitization, and these sensitization methods may be used individually or in combination. When these sensitization methods are used in combination, a combination of sulfur sensitization and gold sensitization, a combination of sulfur sensitization, selenium sensitization and gold sensitization, and a combination of sulfur sensitization, tellurium sensitization and gold sensitization are preferred.

The sulfur sensitization for use in the present invention is usually performed by adding a sulfur sensitizer and stirring the emulsion at a high temperature of 40° C. or higher for a predetermined time. The sulfur sensitizer may be a known compound and examples thereof include, in addition to the sulfur compound contained in gelatin, various sulfur compounds such as thiosulfates, thioureas, thiazoles and rhodanines. Preferred sulfur compounds are a thiosulfate and a thiourea compound. The addition amount of the sulfur sensitizer varies depending upon various conditions such as the pH and the temperature at the time of chemical ripening and the size of silver halide grains, however, it is usually from $10^{-7}$ to $10^{-2}$ mol, preferably from $10^{-5}$ to $10^{-3}$ mol, per mol of silver halide.

The selenium sensitizer for use in the present invention may be a known selenium compound. The selenium sensitization is usually performed by adding a labile and/or non-labile selenium compound and stirring the emulsion at a high temperature of 40° C. or higher for a predetermined time. Examples of the labile selenium compound include the compounds described in JP-B-44-15748, JP-B-43-13489, Japanese Patent Application No. 2-13097, JP-A-4-10924 and JP-A-4-324855, and among these, particularly preferred are the compounds represented by formula (VIII) and (IX) of JP-A-4-324855.

The tellurium sensitizer for use in the present invention is a compound of forming silver telluride presumed to be a sensitization speck, on the surface or in the inside of a silver halide grain. The formation rate of silver telluride in a silver halide emulsion can be examined according to a method described in Japanese Patent Application No. 4-146739.

Specific examples of the tellurium sensitizer include the compounds described in U.S. Pat. Nos. 1,623,499, 3,320,069 and 3,772,031, British Patents 235,211, 1,121,496, 1,295,462 and 1,396,696, Canadian Patent 800,958, JP-A-4-204640, JP-A-4-271341, JP-A-4-333043, JP-A-5-303157, *J. Chem. Soc. Chem. Commun.*, 635 (1980), ibid., 1102 (1979), ibid., 645 (1979), *J. Chem. Soc. Perkin. Trans.*, 1, 2191 (1980), S. Patai (compiler), *The Chemistry of Organic Selenium and Tellurium Compounds*, Vol. 1 (1986), and ibid., Vol. 2 (1987). The compounds represented by formulae (II), (III) and (IV) of Japanese Patent Application No. 4-146739 (corresponding to JP-A-5-313284) are particularly preferred.

The use amount of the selenium sensitizer or the tellurium sensitizer for use in the present invention varies depending upon silver halide grains used or chemical ripening conditions, however, it is usually approximately from $10^{-8}$ to $10^{-2}$ mol, preferably approximately from $10^{-7}$ to $10^{-3}$ mol, per mol of silver halide. The conditions for chemical sensitization in the present invention are not particularly restricted, however, the pH is from 5 to 8, the pAg is from 6 to 11, preferably from 7 to 10, and the temperature is from 40° to 95° C., preferably from 45° to 85° C.

Examples of the noble metal sensitizer for use in the present invention include gold, platinum, palladium and iridium, and gold sensitization is particularly preferred. Specific examples of the gold sensitizer for use in the present invention include chlorauric acid, potassium chlorate, potassium aurithiocyanate and gold sulfide, and the gold sensitizer is used in an amount of approximately from $10^{-7}$ to $10^{-2}$ mol per mol of silver halide.

In the silver halide emulsion for use in the present invention, a cadmium salt, a sulfite, a lead salt or a thallium salt may be present together during formation or physical ripening of silver halide grains.

In the present invention, reduction sensitization may be used and examples of the reduction sensitizer which can be used include stannous salt, amines, formamidinesulfinic acid and silane compounds.

To the silver halide emulsion of the present invention, a thiosulfonic acid compound may be added according to a method described in European Unexamined Patent Publication (EP) 293917.

In the light-sensitive material for use in the present invention, one kind of silver halide emulsion may be used or two or more kinds of silver halide emulsions (for example, different in the average grain size, different in the halogen composition, different in the crystal habit, or different in chemical sensitization conditions) may be used in combination.

In the present invention, the silver halide emulsion particularly suitable as a light-sensitive material for dot-to-dot work comprises a silver halide having a silver chloride content of 90 mol % or more, preferably 95 mol % or more, more specifically, silver chlorobromide or silver chloroiodobromide containing from 0 to 10 mol % of silver bromide. If the proportion of silver bromide or silver iodide increases, the safelight safety in a bright room may be worsened or the γ value is disadvantageously lowered.

The silver halide emulsion for use in the dot-to-dot work light-sensitive material of the present invention preferably contains a transition metal complex and examples of the transition metal include Rh, Ru, Re, Os, Ir and Cr.

Examples of the ligand include a nitrosyl cross-linked ligand, a thionitrosyl cross-linked ligand, a halide ligand (e.g., fluoride, chloride, bromide, iodide), a cyanide ligand, a cyanate ligand, a thiocyanate ligand, a selenocyanate ligand, a tellurocyanate ligand, an acid ligand and a core ligand. When a core ligand is present, it is preferred that the core ligand occupies one or more of the ligands.

More specifically, the rhodium atom may be incorporated by forming it into a metal salt in any form, such as a single salt or a complex salt, and adding the salt at the time of preparation of grains.

Examples of the rhodium salt include rhodium monochloride, rhodium dichloride, rhodium trichloride and ammonium hexachlororhodate, and preferred is a water-soluble halogen complex compound of trivalent rhodium, such as hexachlororhodium(III) acid and a salt thereof (e.g., ammonium salt, sodium salt, Potassium salt).

The addition amount of the water-soluble rhodate is from $1.0\times10^{-6}$ to $1.0\times10^{-3}$, Preferably $1.0\times10^{-5}$ to $1.0\times10^{-3}$, more preferably from $5.0\times10^{-5}$ to $5.0\times10^{-4}$ mol, per mol of silver halide.

The following transition metal complexes are also Preferred.

1. $[Ru(NO)Cl_5]^{-2}$
2. $[Ru(NO)_2Cl_4]^{-1}$
3. $[Ru(NO)(H_2O)Cl_4]^{-1}$
4. $[Ru(NO)Cl_5]^{-2}$
5. $[Rh(NO)Cl_5]^{-2}$
6. $[Re(NO)CN_5]^{-2}$
7. $[Re(NO)ClCN_4]^{-2}$
8. $[Rh(NO)_2Cl_4]^{-1}$
9. $[Rh(NO)(H_2O)Cl_4]^{-1}$
10. $[Ru(NO)CN_5]^{-2}$
11. $[Ru(NO)Br_5]^{-2}$
12. $[Ru(NS)Cl_5]^{-2}$
13. $[Os(NO)Cl_5]^{-2}$
14. $[Cr(NO)Cl_5]^{-3}$
15. $[Re(NO)Cl_5]^{-1}$
16. $[Os(NS)Cl_4(TeCN)]^{-2}$
17. $[Ru(NS)I_5]^{-2}$
18. $[Re(NS)Cl_4(SeCN)]^{-2}$
19. $[Os(NS)Cl(SCN)_4]^{-2}$
20. $[Ir(NO)Cl_5]^{-2}$

The compound represented by formula (II) is described in detail below.

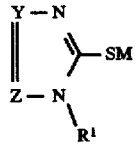

(II)

wherein Y and Z, which may be the same or different, each represents N or $CR^2$ (wherein $R^2$ represents an alkyl group or an aryl group), $R^1$ represents an alkyl, aryl or heterocyclic group substituted by at least one selected from the group consisting of $—SO_3M$, —COOM, —OH, $—NHSO_2R^3$, $—SO_2NR^3R^4$ and $—NR^5CONR^3R^4$, or a group comprising an alkyl, aryl or heterocyclic group through a linking group, $R^3$, $R^4$ and $R^5$, which may be the same or different, each represents a hydrogen atom or a lower alkyl group having from 1 to 4 carbon atoms, and M represents a hydrogen atom, an alkali metal, a quaternary ammonium or a quaternary phosphonium.

Specific examples of the alkyl group represented by $R^1$ include a linear, branched or cycloalkyl group having from 1 to 20 carbon atoms (e.g., methyl, propyl, hexyl, dodecyl, isopropyl) and a cycloalkyl group having from 1 to 20 carbon atoms (e.g., cyclopropyl, cyclohexyl); specific examples of the aryl group include an aryl group having from 6 to 20 carbon atoms (e.g., phenyl, naphthyl); and specific examples of the heterocyclic group include a 5- to 7-membered heterocyclic ring containing one or more atoms selected from nitrogen, oxygen and sulfur atoms and a ring forming a condensed ring at an appropriate site (e.g., pyridine ring, quinoline ring, pyrimidine ring, isoquinoline ring). The alkyl group, the aryl group and the heterocyclic group each may further be substituted by a substituent other than those described above and specific examples of the substituent include a halogen atom (e.g., F, Cl, Br), an alkyl group (e.g., methyl, ethyl), an aryl group (e.g., phenyl, p-chlorophenyl), an alkoxy group (e.g., methoxy, methoxyethoxy), an aryloxy group (e.g., phenoxy), a sulfonyl group (e.g., methanesulfonyl, p-toluenesulfonyl), a carbamoyl group (e.g., unsubstituted carbamoyl, diethylcarbamoyl), an amido group (e.g., acetamide, benzamide), an alkoxycarbonylamino group (e.g., methoxycarbonylamino), an aryloxycarbonylamino group (e.g., phenoxycarbonylamino), an alkoxycarbonyl group (e.g., methoxycarbonyl), an aryloxycarbonyl group (e.g., phenoxycarbonyl), a cyano group, a nitro group, an amino group (e.g., unsubstituted amino, dimethylamino), an alkylsulfinyl group (e.g., methoxysulfinyl), an arylsulfinyl group (e.g., phenylsulfinyl), an alkylthio group (e.g., methylthio) and an arylthio group (e.g., phenylthio). Two or more of these substituents may substitute and when two or more substituents are present, they may be the same or different.

Preferred examples of the linking group which may be contained in $R_1$ include —S—, —O—, —N($R_3$)—, —CO—, —SO—, —$SO_2$—, —$SO_2$N($R_3$)—, —CON($R_3$)— and —COO— (wherein $R_3$ has the same meaning as in —$NHSO_2R_3$ which is described above).

Specific examples of $R_1$ having a linking group are set forth below.

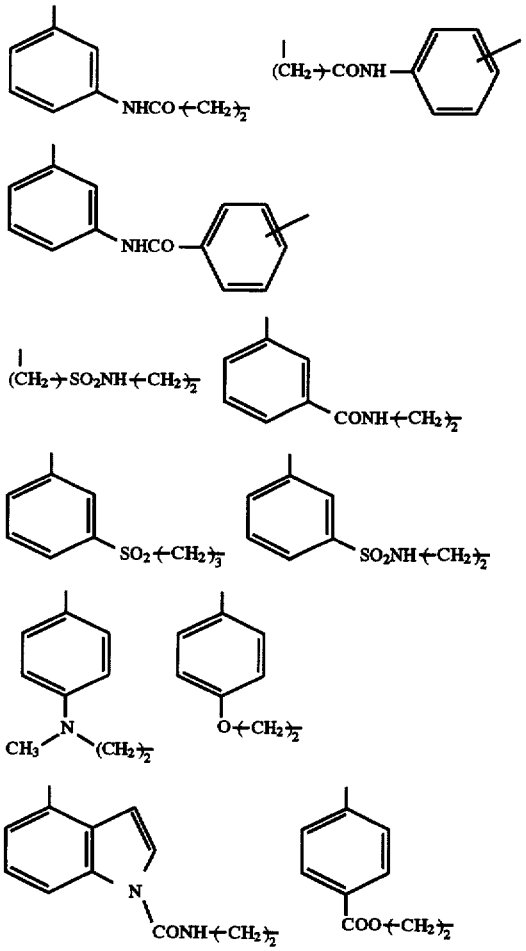

The alkyl group and the aryl group represented by $R_2$ each may have a substituent and examples of the substituent include those described above as the substituent of $R_1$.

Among the compounds represented by formula (II), more preferred are those represented by the following formula (VI):

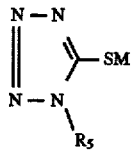

(VI)

In formula (VI), $R_5$ represents a phenyl group substituted by at least one of —COOM, —$SO_3$M, —OH, —$NHSO_2R_3$, —$SO_2NR_3R_4$ and —$NR_3CONR_3R_4$, and the phenyl group may be further substituted by other substituent.

When two or more of —COOM, —$SO_3$M, —OH, —$NHSO_2R_3$, —$SO_2NR_3R_4$ and —$NR_3CONR_3R_4$ are present, they may be the same or different, and among these, —COOM and —$SO_3$M are particularly preferred.

M has the same meaning as defined in formula (II).

Specific examples of the compound represented by formula (II) for use in the present invention are set forth below, however, the present invention is by no means limited to these compounds.

II-(1)

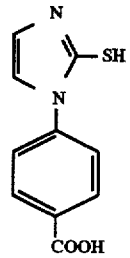

II-(2)

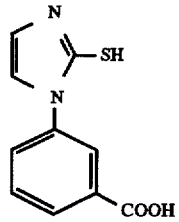

II-(3)

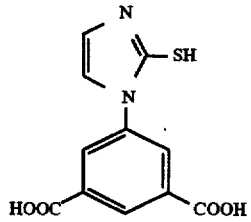

(II-4)

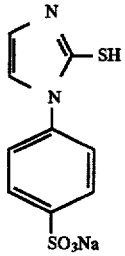

-continued
II-(5)
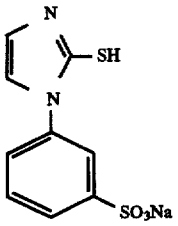
II-(6)
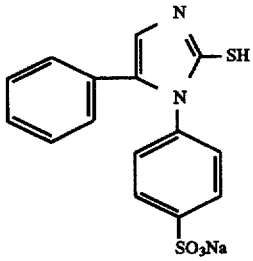
II-(7)
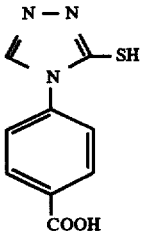
II-(8)
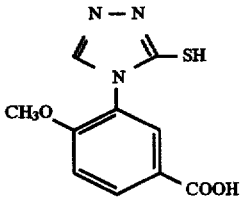
II-(9)
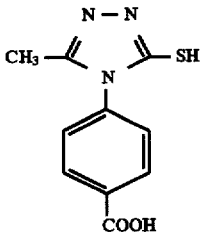
II-(10)
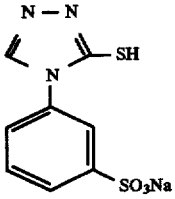
II-(11)
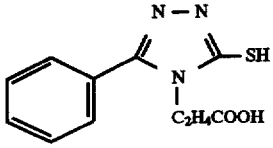
-continued
II-(12)
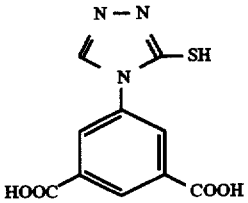
II-(13)
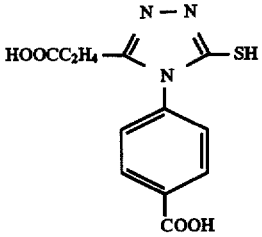
II-(14)
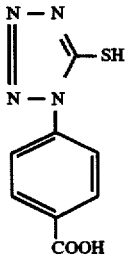
II-(15)
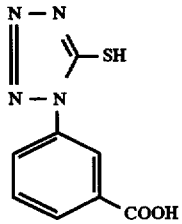
II-(16)
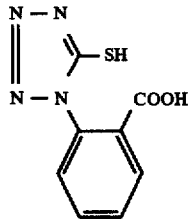
II-(17)
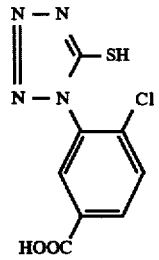

-continued
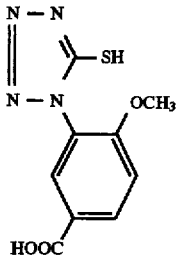
II-(18)
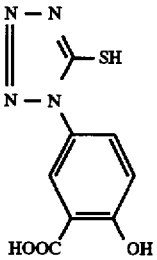
II-(19)
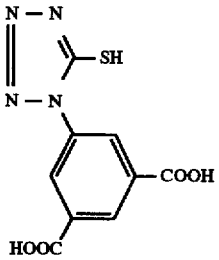
II-(20)
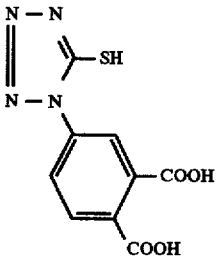
II-(21)
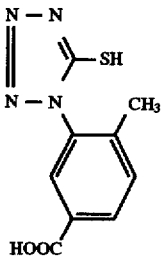
II-(22)
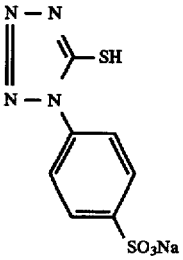
II-(23)
-continued
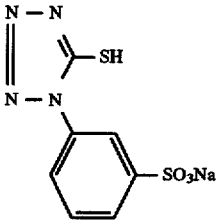
II-(24)
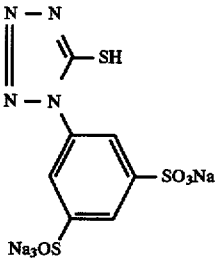
II-(25)
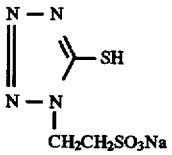
II-(26)
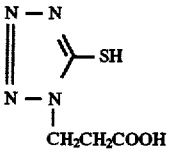
II-(27)
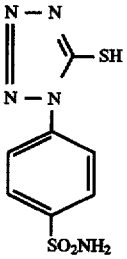
II-(28)
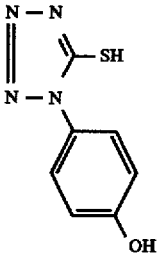
II-(29)
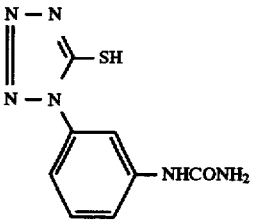
II-(30)

-continued

II-(31)

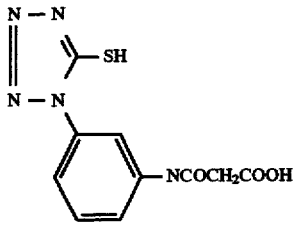

II-(32)

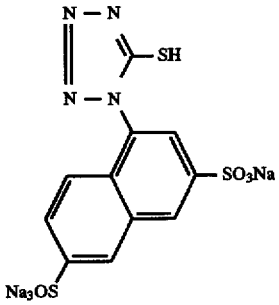

II-(33)

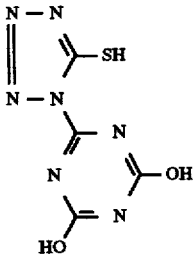

II-(34)

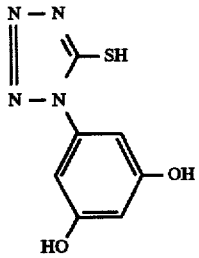

II-(35)

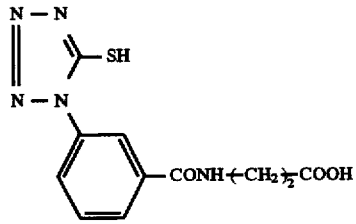

II-(36)

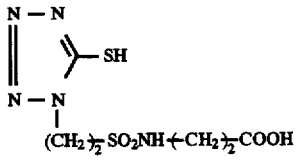

-continued

II-(37)

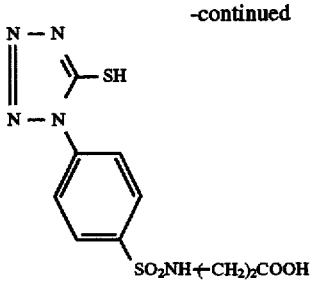

II-(38)

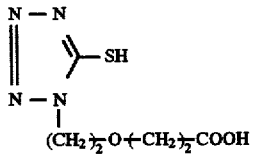

II-(39)

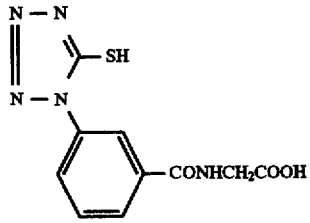

II-(40)

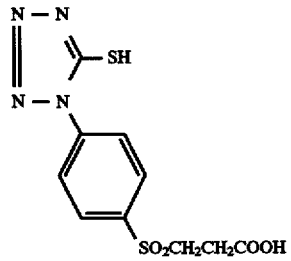

The compound represented by formula (II) can be easily synthesized by a commonly well known method of using isocyanate as a starting material.

Synthesis methods thereof are described in the following patent publications and references:

U.S. Pat. Nos. 2,585,388 and 2,541,924, JP-B-42-21842, U.S. Pat. No. 3,266,897, British Patent 1,275,701, JP-A-56-111846, D. A. Berges et al., *Journal of Heterocyclic Chemistry*, Vol. 15, No. 981 (1978), *The Chemistry of Heterocyclic Chemistry-Imidazole and Derivatives, Part I-*, pp. 336–339, *Chemical Abstract*, 58, No. 7921, p. 394 (1963), E. Hoggarth, *Journal of Chemical Society*, pp. 1160–1167 (1949), S. R. Sandler and W. Karo, *Organic Functional Group Preparation*, Academic Press, pp. 312–315 (1968), I. I. Kovtunovskaya Lovshine, *Tr. Ukr. Inst. Eksperim Endokrinol*, Vol. 18, p. 345 (1961), M. Chamdon et al., *Bull. Chem. Fr.*, 723 (1954), D. A. Shirley and D. W. Alley, *J. Amer. Chem. Soc.*, 79, 4922 (1957), and A. Wohl and W. Marckwald, *Ber.* (*Journal of German Chemical Society*), Vol. 22, 568 (1889).

The compound represented by formula (II) is used in an amount approximately equal to that of a usual additive, however it is preferably used in an amount of from 5 mg/l to 1 g/l, more preferably from 10 to 500 mg/l.

The silver halide light-sensitive material of the present invention is developed with a developer containing a dihydroxybenzene-base developing agent and an auxiliary developing agent which exhibits superadditivity therewith.

In the development processing, a usual automatic developing machine can be used. The developer filled in the developing tank at the initiation of development is called a development initiating solution (mother solution) and the developer replenished to the developing tank upon a continuous development is called a development replenisher. In the present invention, the development initiating solution and the development replenisher both contain a dihydroxybenzene-base developing agent and an auxiliary developing agent which exhibits superadditivity therewith.

Examples of the dihydroxybenzene-base developing agent include hydroquinone, chlorohydroquinone, isopropylhydroquinone, methylhydroquinone and hydroquinone monosulfonate, with hydroquinone being particularly preferred.

Examples of the auxiliary developing agent which exhibits superadditivity with the dihydroxybenzene-base developing agent, include 1-phenyl-3-pyrazolidones and p-aminophenols. Accordingly, in the present invention, a combination of a dihydroxybenzene-base developing agent with a 1-phenyl-3-pyrazolidone and a combination of a dihydroxybenzene-base developing agent with a p-aminophenol are preferably used.

Examples of the 1-phenyl-3-pyrazolidone or a derivative thereof as the developing agent for use in the present invention include 1-phenyl-3-pyrazolidone, 1-phenyl-4,4-dimethyl-3-pyrazolidone and 1-phenyl-4-methyl-4-hydroxymethyl-3-pyrazolidone.

Examples of the p-aminophenol-base developing agent for use in the present invention include N-methyl-p-aminophenol, p-aminophenol, N-(β-hydroxyethyl)-p-aminophenol and N-(4-hydroxyphenyl)glycine, with N-methyl-p-aminophenol being particularly preferred.

The dihydroxybenzene-base developing agent is usually preferably used in an amount of from 0.2 to 0.75 mol/l, however, in the present invention, it is more preferably used in an amount of 0.23 mol/l or more, still more preferably from 0.23 to 0.6 mol/l.

In the case when a combination of a dihydroxybenzene with a 1-phenyl-3-pyrazolidone or with a p-aminophenol is used, the former is preferably used in an amount of from 0.2 to 0.75 mol/l, more preferably 0.23 to 0.6 mol/l, furthermore preferably from 0.23 to 0.5 mol/l, and the latter is preferably used in an amount of 0.001 to 0.06 mol/l, more preferably from 0.03 to 0.003 mol/l.

In the present invention, the development initiating solution and the development replenisher both are required to have a property such that "increase in pH caused when 0.1 mol of sodium hydroxide is added to 1 l of the solution, is 0.25 or less". In verifying whether or not the development initiating solution or the development replenisher used has this property, the development initiating solution or the development replenisher to be examined is adjusted to have a pH of 10.5, 0.1 mol of sodium hydroxide is added to 1 l of the solution, and the pH at this time is measured. When increase in the pH value is 0.25 or less, it is determined that the solution has the above-described property. In the present invention, a development initiating solution or a development replenisher which shows increase in the pH value upon the above-described test of 0.2 or less is preferably used.

In order to impart the above-described property to the development initiating solution or the development replenisher, a buffer is preferably used. Examples of the buffer include a boric acid described in JP-A-62-186259, saccharides (e.g., succarose) described in JP-A-60-93433, oximes (e.g., acetoxime), phenols (e.g., 5-sulfosalicylic acid) and tertiary phosphates (e.g., sodium salt, potassium salt), and a carbonate and a boric acid are preferably used. The use amount of a buffer, particularly a carbonate, is preferably 0.5 mol/l or more, more preferably from 0.5 to 1.5 mol/l.

In the present invention, the development initiating solution has a pH of from 9.0 to 11.0, preferably from 9.5 to 10.7. The development replenisher and the developer in the developing tank upon a continuous development each has a pH within the above-described range.

As the alkali agent used for adjusting the pH, a usual water-soluble inorganic alkali metal salt (e.g., sodium hydroxide, potassium hydroxide, sodium carbonate, potassium carbonate) can be used.

In processing 1 $m^2$ of a silver halide photographic light-sensitive material, the replenishing amount of the developer is 225 ml or less, preferably from 30 to 225 ml, more preferably from 50 to 180 ml.

The development replenisher may have the same composition as the development initiating solution or may have a concentration higher than the initiating solution with respect to the components consumed by the development.

The developer (the development initiating solution and the development replenisher are collectively called a developer, hereinafter the same) for use in developing the light-sensitive material of the present invention may contain additives (e.g., preservative, chelating agent) which are commonly used.

Examples of the preservative for use in the present invention include sodium sulfite, potassium sulfite, lithium sulfite, ammonium sulfite, sodium bisulfite, potassium metabisulfite and sodium formaldehyde bisulfite. The sulfite is used in an amount of 0.3 mol/l or more, however, if it is added in excess, silver stains are caused in the developer. Therefore, the upper limit of the use amount is preferably 1.2 mol/l. The sulfite is more preferably used in an amount of from 0.35 to 0.7 mol/l.

As the preservative of the dihydroxybenzene-base developing agent, a small amount of an ascorbic acid derivative may be used in combination with the sulfite. The ascorbic acid derivative as used herein includes an ascorbic acid, an erythorbic acid as a stereoisomer thereof, and an alkali metal salt thereof (e.g., sodium, potassium salt). Sodium erythorbate is preferred in view of the cost for materials. The addition amount thereof is, in terms of molar ratio to the dihydroxybenzene-base developing agent, preferably from 0.03 to 0.12, more preferably from 0.05 to 0.10. In the case where an ascorbic acid derivative is used as the preservative, the developer preferably contains no boron compound.

Examples of additives other than those described above include a development inhibitor such as sodium bromide and potassium bromide; an organic solvent such as ethylene glycol, diethylene glycol, triethylene glycol and dimethylformamide; a development accelerator such as alkanolamine (e.g., diethanolamine, triethanolamine), imidazole and a derivative thereof; and an antifoggant or a black pepper inhibitor such as a mercapto-base compound, an imidazole-base compound, a benzotriazole-base compound and a benzimidazole-base compound, and specific examples of these compounds include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenztriazole, sodium 4-[(2-mercapto-1,3,4-thiadiazol-2-yl)thio]butanesulfonate, 5-amino-1,3,4-thiadiazole-2-thiol, methylbenzotriazole, 5-methylbenzotriazole and 2-mercaptobenzotriazole. The antifoggant is usually used in an amount of from 0.01 to 10 mmol, preferably from 0.1 to 2 mmol, per l of the developer.

The developer of the present invention can further use various organic or inorganic chelating agent. Examples of the inorganic chelating agent include sodium tetrapolyphosphate and sodium hexametaphosphate.

Examples of the organic chelating agent which is predominantly used, include an organic carboxylic acid, an aminopolycarboxylic acid, an organic phosphonic acid, an aminophosphonic acid and an organic phosphonocarboxylic acid.

Examples of the organic carboxylic acid include an acrylic acid, an oxalic acid, a malonic acid, a succinic acid, a glutaric acid, an adipic acid, a pimelic acid, an azelaic acid, a sebacic acid, a nonanedicarboxylic acid, a decanedicarboxylic acid, an undecanedicarboxylic acid, a maleic acid, an itaconic acid, a malic acid, a citric acid and a tartaric acid, however, the organic carboxylic acid for use in the present invention is not limited thereto.

Examples of the aminopolycarboxylic acid include iminodiacetic acid, nitrilotriacetic acid, nitrilotripropionic acid, ethylenediaminemonohydroxyethyltriacetic acid, ethylenediaminetetraacetic acid, glycolethertetraacetic acid, 1,2-diaminopropanetetraacetic acid, ethylenetriaminepentaacetic acid, triethylenetetraminehexaacetic acid, 1,3-diamino-2-propanoltetraacetic acid, glycoletherdiaminetetraacetic acid, and the compounds described in JP-A-52-25632, JP-A-55-67747, JP-A-57-102624 and JP-B-53-40900.

Examples of the organic phosphonic acid include hydroxyalkylidenediphosphonic acid described in U.S. Pat. Nos. 3,214,454 and 3,794,591 and German Patent Application (OLS) No. 2,227,639, and the compounds described in *Research Disclosure*, Vol. 181, Item 18170 (May, 1979).

Examples of the aminophosphonic acid include aminotris (methylenephosphonic acid), ethylenediaminetetramethylenephosphonic acid, aminotrimethylenephosphonic acid, and the compounds described in *Research Disclosure* (supra), No. 18170, JP-A-57-208554, JP-A-54-61125, JP-A-55-29883 and JP-A-56-97347.

Examples of the organic phosphonocarboxylic acid include the compounds described in JP-A-52-102726, JP-A-53-42730, JP-A-54-121127, JP-A-55-4024, JP-A-55-4025, JP-A-55-126241, JP-A-55-65955, JP-A-55-65956 and *Research Disclosure* (supra), No. 18170.

These chelating agents each may be used in the form of an alkali metal salt or an ammonium salt. The chelating agent is preferably added in an amount of from $1\times10^{-4}$ to $1\times10^{-1}$ mol, more preferably from $1\times10^{-3}$ to $1\times10^{-2}$ mol, per l of the developer.

The developer of the present invention may also contain a silver stain inhibitor and examples thereof include the compounds described in JP-A-56-24347, JP-B-56-46585, JP-B-62-2849 and JP-A-4-362942.

Further, the developer of the present invention may contain a dissolution aid and examples thereof include the compounds described in JP-A-61-267759.

Furthermore, the developer of the present invention may contain a color toner, a surface active agent, a defoaming agent or a hardening agent.

The development processing temperature and the development processing time are correlated with each other and they are determined taking account of the entire processing time, however, the development temperature is generally from about 20° C. to about 50° C., preferably from 25° to 45° C., and the development time is from 5 seconds to 2 minutes, preferably from 7 seconds to 1 minute and 30 seconds.

For the purpose of saving the cost for transportation of processing solutions, the cost for packaging materials or the space for installation, the processing solution are preferably concentrated and diluted upon use. In order to concentrate the developer, it is effective to process the salt components contained in the developer into a potassium salt form.

The fixing solution for use in the fixing step is an aqueous solution containing sodium thiosulfate or ammonium thiosulfate and if desired, tartaric acid, citric acid, gluconic acid, boric acid, iminodiacetic acid, 5-sulfosalicylic acid, glucoheptanoic, tylon, ethylenediaminetetraacetic acid, diethylenetriaminepentaacetic acid, nitrilotriacetic acid or a salt thereof. In view of environmental conservation in recent years, the fixing solution preferably contains no boric acid.

The fixing agent in the fixing solution for use in the present invention includes sodium thiosulfate and ammonium thiosulfate, and in view of the fixing rate, ammonium thiosulfate is preferred, however, when taken account of environmental conservation in recent years, sodium thiosulfate may be used. The use amount of these known fixing agents may be varied appropriately, however, it is generally from about 0.1 to about 2 mol/l, preferably from 0.2 to 1.5 mol/l.

The fixing solution may contain, if desired, a hardening agent (e.g., water-soluble aluminum compound), a preservative (e.g., sulfite, bisulfite), a pH buffer (e.g., acetic acid), a pH adjusting agent (e.g., ammonia, sulfuric acid), a chelating agent, a surface active agent, a wetting agent or a fixing accelerator.

Examples of the surface active agent include an anionic surface active agent such as sulfates and sulfonates, a polyethylene-base surface active agent, and an amphoteric surface active agent described in JP-A-57-6740. A known defoaming agent may also be added to the fixing solution. Examples of the wetting agent include alkanolamine and alkylene glycol. Examples of the fixing accelerator include thiourea derivatives described in JP-B-45-35754, JP-B-58-122535 and JP-B-58-122536, alcohols having a triple bond within a molecule, thioether compounds described in U.S. Pat. No. 4,126,459, meso-ionic compounds described in JP-A-4-229860, and the compounds described in JP-A-2-44355.

Examples of the pH buffer include an organic acid such as acetic acid, malic acid, succinic acid, tartaric acid, citric acid, oxalic acid, maleic acid, glycolic acid and adipic acid, and an inorganic buffer such as boric acid, phosphate and sulfite. Among these, preferred are acetic acid, tartaric acid and sulfite.

The pH buffer is used to prevent increase in the pH value of the fixing agent due to carrying over of the developer, and it is used in an amount of from 0.01 to 1.0 mol/l, preferably approximately from 0.02 to 0.6 mol/l.

The pH of the fixing solution is preferably from 4.0 to 6.5, more preferably from 4.5 to 6.0.

The fixing solution may also contain a dye elution accelerator and examples thereof include the compounds described in JP-A-64-4739.

Examples of the hardening agent for use in the fixing solution of the present invention include a water-soluble aluminum salt and a chromium salt. Of these, a water-soluble aluminum salt is preferred and examples thereof include aluminum chloride, aluminum sulfate and potassium alum. The addition amount thereof is preferably from 0.01 to 0.2 mol/l, more preferably from 0.03 to 0.08 mol/l.

The fixing temperature is from about 20° C. to about 50° C., preferably from 25° to 45° C., and the fixing time is from 5 seconds to 1 minute, preferably from 7 to 50 seconds.

The replenishing amount of the fixing solution is 600 ml/m$^2$ or less, preferably 500 ml/m$^2$ or less, more preferably 300 ml/m$^2$ or less, based on the light-sensitive material processed.

The light-sensitive material processed through development and fixing is then subjected to water washing or stabilization.

The water washing or stabilization is usually performed using water in an amount of 20 l or less per m$^2$ of the silver halide light-sensitive material and they may be performed at a replenishing amount of 3 l or less (including 0, namely, standing water washing). More specifically, the processing not only can be performed with saved water but also can dispense with piping for installation of an automatic developing machine.

As a method for reducing the replenishing amount of washing water, a multi-stage countercurrent system (for example, two stages or three stages) has been known from of old. When the multi-stage countercurrent system is applied to the present invention, the light-sensitive material after fixing is processed gradually toward the correct direction, namely, while coming into contact in sequence with processing solutions unstained with the fixing solution, and as a result, water washing can be performed more efficiently.

When water washing is performed with a small amount of water, a rinsing tank such as squeeze roller or cross-over roller described in JP-A-63-18350 and JP-A-62-287252 is preferably provided. Or, addition of various oxidizing agents or filter filtration may be combined so as to reduce the pollution load which is a problem to be caused in water washing with a small amount of water.

The over-flow solution from the water washing or stabilization bath, which is generated as a result of replenishing water with an antimold means to the water washing or stabilization bath according to the processing, may be partially or wholly used in the processing solution having fixing ability at the previous processing step thereof as described in JP-A-60-235133.

Also, a water-soluble surface active agent or a defoaming agent may be added so as to prevent uneven processing due to bubbling which is liable to occur at the time of water washing with a small amount of water and/or to prevent a processing agent component adhering to the squeeze roller from transferring onto the processed film.

Further, a dye adsorbent described in JP-A-63-163456 may be provided in the water washing tank so as to prevent stain due to a dye dissolved out from the light-sensitive material.

In some cases, stabilization may be performed following the above-described water washing and an example thereof is the use of a bath containing the compound described in JP-A-2-201357, JP-A-2-132435, JP-A-1-102553 or JP-A-46-44446 as a final bath of the light-sensitive material.

The stabilizing bath may also contain, if desired, an ammonium compound, a metal compound such as Bi and Al, a fluorescent brightening agent, various chelating agents, a film pH adjusting agent, a hardening agent, a sterilizer, an antimold, an alkanolamine or a surface active agent. Water for use in the water washing or stabilization step may be tap water but deionized water or water subjected to sterilization with a halogen or ultraviolet bactericidal lamp or various oxidizing agents (e.g., ozone, hydrogen peroxide, chlorate) is preferably used. Further, washing water containing the compound described in JP-A-4-39652 or JP-A-5-241309 may also be used.

The temperature and the time in water washing or stabilization are preferably from 0° to 50° C. and from 5 seconds to 2 minutes, respectively.

The processing solution for use in the present invention is preferably stored in a packaging material having a low oxygen permeability described in JP-A-61-73147.

When the replenishing amount is reduced, the contact area of the processing tank with air is preferably made small so as to prevent evaporation or air oxidation of the solution. The roller transportation-type automatic developing machine is described in U.S. Pat. Nos. 3,025,779 and 3,545,971 and in the present invention, it is simply referred to as a roller transportation-type processor. The roller transportation-type processor consists of four processing steps of development, fixing, water washing and drying and it is most preferred that this four-step system is followed also in the present invention, though other steps (for example, stopping) may not be excluded. In the four-step system, water washing may be replaced by stabilization.

The developer or the fixing solution may be supplied as a solid resulting from removal of water from the composition of the solution and the solid may be dissolved with a predetermined amount of water upon use and used as a developer or a fixing solution. The processing agent in the above-described shape is called a solid processing agent. Examples of the shape of the solid processing agent include powder, tablet, granulated powder, lump and paste, and preferred are the shape described in JP-A-61-259921 and a tablet. The tablet can be produced by a general method described, for example, in JP-A-51-61837, JP-A-54-155038, JP-A-52-88025 and British Patent 1,213,808; the granulated powder processing agent can be produced by a general method described, for example, in JP-A-2-109042, JP-A-2-109043, JP-A-3-39735 and JP-A-3-39739; and the powder processing agent can be produced by a general method described, for example, in JP-A-54-133332, British Patents 725,892 and 729,862, and German Patent 3,733,861.

The solid processing agent has a bulk density of, in view of its solubility and effects as an object of the present invention, preferably from 0.5 to 6.0 g/cm$^3$, more preferably from 1.0 to 5.0 g/cm$^3$.

In preparing the solid processing agent, a method where reactive substances are placed in the layer form such that out of substances constituting the processing agent, at least two granular substances reactive with each other form respective layers separated by at least one intervening separation layer of a substance inactive to the reactive substances, a bag capable of vacuum packaging is used as a packaging material, and the bag housing the processing agent is evacuated and sealed, may be used. The term "inactive" as used herein means that substances physically put into contact with each other do not react under the normal state within the package or even if any reaction is caused, the degree of reaction is not so high. The inactive substance may be sufficient if it is inactive in the state intended to use two reactive substances, to say nothing of a substance which is inactive to the two substances reactive with each other. The inactive substance is a substance used simultaneously with the two reactive substances. For example, hydroquinone and sodium hydroxide react if they come into direct contact and therefore, sodium sulfite may be used as a separation layer between the hydroquinone and the sodium hydroxide in a vacuum package so that they can be stored in the package for a long period of time. Or, hydroquinone may be briquetted to reduce the contact area with the sodium hydroxide and thereby, not only the storability is improved but also they can be used as a mixture. The packaging material for these vacuum packaged materials is a bag formed of an inactive plastic film or formed of a laminate of a plastic material and a metal foil.

Various additives for use in the light-sensitive material of the present invention are not particularly restricted and for example, those described in the following portions may be preferably used.

| Item | Pertinent Portion |
|---|---|
| 1) | Nucleation accelerator compounds represented by formulae (I), (II), (III), (IV), (V) and (VI) of JP-A-6-82943; compounds represented by formulae (II-m) to (II-p) of JP-A-2-103536, from page 9, right upper column, line 13 to page 16, left upper column, line 10 and Compounds II-1 to II-22; and compounds described in JP-A-1-179939 |
| 2) | Spectral sensitizing dye spectral sensitizing dyes described in JP-A-2-12236, page 8, from left lower column, line 13 to right lower column, line 4, JP-A-2-103536, from page 16, right lower column, line 3 to page 17, left lower column, line 20, JP-A-1-112235, JP-A-2-124560, JP-A-3-7928, JP-A-5-11389 and Japanese Patent Application No. 3-411064 |
| 3) | Surface active agent JP-A-2-12236, page 9, from right upper column line 7 to right lower column line 7, and JP-A-2-18542, from page 2, left lower column, line 13 to page 4, right lower column, line 18 |
| 4) | Antifoggant thiosulfinic acid compounds described in JP-A-2-103536, from page 17, right lower column, line 19 to page 18, right upper column, line 4 and page 18, right lower column, lines 1 to 5, and JP-A-1-237538 |
| 5) | Polymer latex JP-A-2-103536, page 18, left lower column, lines 2 to 20 |
| 6) | Compound having acid JP-A-2-103536, from page 18, radical right lower column to page 19, left upper column, line 1 |
| 7) | Matting agent, slipping JP-A-2-103536, from page 19, agent and plasticizer left upper column, line 15 to right upper column, line 15 |
| 8) | Hardening agent JP-A-2-103536, page 18, right upper column, lines 5 to 17 |
| 9) | Dye dyes described in JP-A-2-103536, page 17, right lower column, lines 1 to 18, and solid dyes described in JP-A-2-294638 and JP-A-5-11382 |
| 10) | Binder JP-A-2-18542, page 3, right lower column, lines 1 to 20 |
| 11) | Black pepper inhibitor compounds described in U.S. Pat. No. 4,956,257 and JP-A-1-118832 |
| 12) | Redox compound compounds represented by formula (I) of JP-A-2-301743 (particularly, Compounds 1 to 50), compounds represented by formulae (R-1), (R-2) and (R-3) and Compounds 1 to 75 of JP-A-3-174143, pages 3 to 20, and compounds described in Japanese Patent Application Nos. 3-69466 and 3-15648 |
| 13) | Monomethine compound compounds represented by formula (II) of JP-A-2-287532 (particularly Compounds II-1 to II-26) |
| 14) | Dihydroxybenzenes compounds described in JP-A-3-39948, from page 11, left upper column to page 12, left column, and EP 452772A |

The present invention is described in greater detail below by referring to Examples, however, the present invention should not be construed as being limited thereto.

The following nucleating agents were used as Comparative Compounds A and B for comparison with the nucleating agent of the present invention.

Comparative Compound A

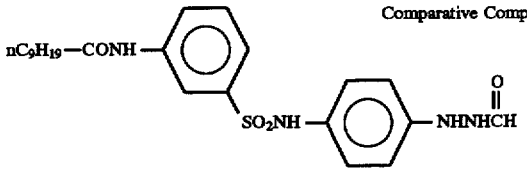

Comparative Compound B

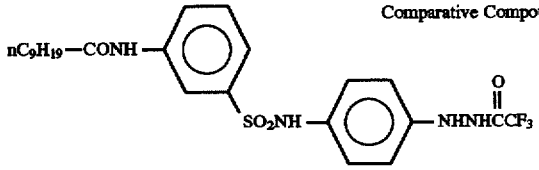

EXAMPLE 1

Preparation of Silver Halide Photographic Light-Sensitive Material

Preparation of Emulsion

Emulsion A was prepared in the following manner.

Emulsion A

An aqueous silver nitrate solution and an aqueous halogen salt solution containing potassium bromide, sodium chloride, $3.5\times10^{-7}$ mol/mol-Ag of $K_3IrCl_6$ and $2.0\times10^{-7}$ mol/mol-Ag of $K_2Rh(H_2O)Cl_5$ were added to an aqueous gelatin solution containing sodium chloride and 1,3-dimethyl-2-imidazolidinethione, while stirring by a double jet method to prepare silver chlorobromide grains having an average grain size of 0.25 μm and each having a silver chloride content of 70 mol %.

Thereafter, the grains were washed with water by flocculation according to a usual method, 40 g/mol-Ag of gelatin was added thereto, then 7 mg/mol-Ag of sodium benzenethiosulfonate and 2 mg/mol-Ag of benzenesulfinic acid were further added, and the pH and the pAg were adjusted to 6.0 and 7.5, respectively. Thereto, 2 mg/mol-Ag of sodium thiosulfate and 4 mg/mol-Al of chloroauric acid were added, and the mixture was subjected to chemical sensitization to have an optimal sensitivity at 60° C. Then, 150 mg of 4-hydroxy-6-methyl-1,3,3a,7-tetraazaindene as a stabilizer and 100 mg of proxel as an antiseptic were added. The resulting grains had an average grain size of 0.25 μm and each was a silver chlorobromide cubic grain having a silver chloride content of 70 mol % (coefficient of variation: 10%).

Preparation of Coated Sample

On a polyethylene terephthalate film support undercoated by a moisture-proofing layer containing vinylidene chloride, a UL layer, an EM layer, a PC layer and an OC layer were coated in this order from the support side to prepare a sample.

The preparation method and the coating amount of each layer are described below.

(UL Layer)

To an aqueous gelatin solution, a dispersion of polyethyl acrylate was added in an amount of 30 wt % based on the gelatin and the mixture was coated to have a gelatin coverage of 0.5 g/m$^2$.

(EM Layer)

To Emulsion A prepared above, $5\times10^{-4}$ mol/mol-Ag of Compound (S-1) shown below and $5\times10^{-4}$ mol/mol-Ag of Compound (S-2) shown below were added as sensitizing dyes, and further $3\times10^{-4}$ mol/mol-Ag of a mercapto compound shown below as Compound (a), $4\times10^{-4}$ mol/mol-Ag of a mercapto compound shown below as Compound (b), $4\times10^{-4}$ mol/mol-Ag of a triazine compound shown below as Compound (c), $2\times10^{-3}$ mol/mol-Ag of 5-chloro-8-hydroxyquinoline, $5\times10^{-4}$ mol/mol-Ag of Compound (p) shown below, and $4\times10^{-4}$ mol/mol-Ag of Compound (A) shown below as a nucleation accelerator were added. Furthermore, 100 mg of hydroquinone was added and N-oleyl-N-methyltaurine sodium salt was added to give a coated amount of 30 mg/m$^2$. Then, $1\times10^{-5}$ mol/m$^2$ of a nucleating agent (hydrazine derivative) shown in Table 2, 200 mg/m$^2$ of a water-soluble latex shown below as Compound (d), 200 mg/m$^2$ of a polyethyl acrylate latex, 600 mg/m$^2$ of a core-shell latex having a core/shell ratio of 50/50 and consisting of a core comprising styrene/butadiene=37/63 (wt %) and a shell comprising styrene/2-acetoxyethyl methacrylate=84/16 (wt %), 200 mg/m$^2$ of colloidal silica having an average particle size of 0.02 μm, and 200 mg/m$^2$ of 1,3-divinylsulfonyl-2-propanol as a hardening agent were added. The resulting solution was adjusted to have a pH of 5.65 using an acetic acid and then coated to have a coated silver amount of 3.5 g/m$^2$ (gelatin coated amount: 1.3 g/m$^2$).

(PC Layer)

To an aqueous gelatin solution, a dispersion of ethyl acrylate was added in an amount of 50 wt % based on the gelatin. Thereto, 5 mg/m$^2$ of Surface Active Agent (w) shown below was added and 1,5-dihydroxy-2-benzaldoxime was added to give a coated amount of 10 mg/m$^2$. The resulting mixture was coated to give a gelatin coverage of 0.5 g/m$^2$.

(OC Layer)

The layer was provided by coating 0.5 g/m$^2$ of gelatin, 40 mg/m$^2$ of an amorphous $SiO_2$ matting agent having an average particle size of about 3.5 μm, 0.1 g/m$^2$ of methanol silica, 100 mg/m$^2$ of polyacrylamide and 20 mg/m$^2$ of silicone oil, and further by coating, as coating aids, 5 mg/m$^2$ of a fluorine surface active agent shown by the following structural formula (e) and 100 mg/m$^2$ of sodium dodecylbenzenesulfonate.

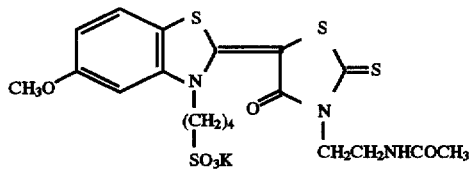

(S-1)

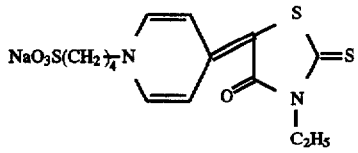

(S-2)

-continued

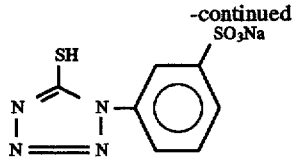

(a)

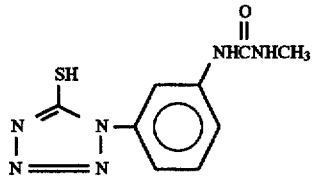

(b)

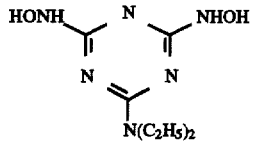

(c)

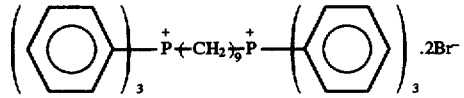

(A)

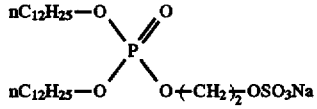

(p)

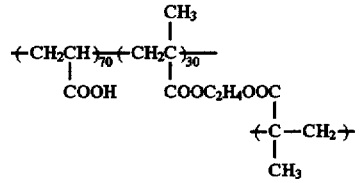

(d)

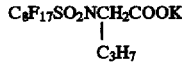

(e)

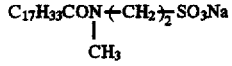

(w)

The thus-obtained coated samples each had a back layer and a back-protective layer having the following compositions.

| Formulation of Back Layer: | |
|---|---|
| Gelatin | 3 g/m$^2$ |
| Latex polyethyl acrylate | 2 g/m$^2$ |
| Surface active agent: | |
| Sodium p-dodecylbenzenesulfonate | 40 mg/m$^2$ |
| $CH_2{=}CHSO_2CH_2CONH$ ┐ $(CH_2)_2$ $CH_2{=}CHSO_2CH_2CONH$ ┘ | 110 mg/m$^2$ |
| $SnO_2$/Sb (weight ratio: 90/10, average particle size: 0.20 μm) | 200 mg/m$^2$ |
| Dye: Mixture of Dye [a], Dye [b] and Dye [c] | |
| Dye [a] | 70 mg/m$^2$ |
| Dye [b] | 70 mg/m$^2$ |
| Dye [c] | 90 mg/m$^2$ |

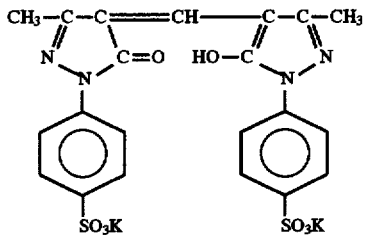

Dye [a]

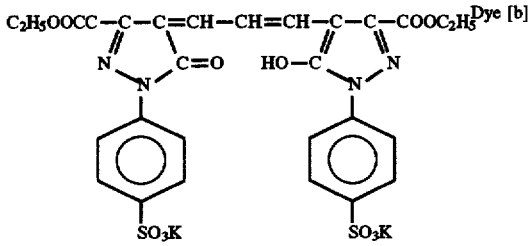

Dye [b]

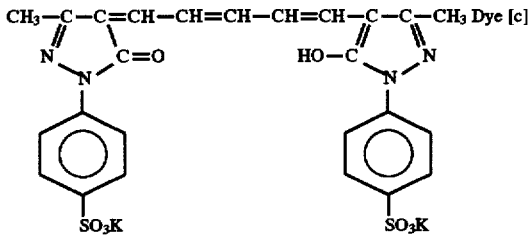

Dye [c]

| Back Protective layer: | |
|---|---|
| Gelatin | 0.8 mg/m$^2$ |
| Polymethyl methacrylate fine particles particles (average particle size: 4.5 μm) | 30 mg/m$^2$ |
| Dihexyl-α-sulfosuccinate sodium salt | 15 mg/m$^2$ |
| Sodium p-dodecylbenzenesulfonate | 15 mg/m$^2$ |
| Sodium acetate | 40 mg/m$^2$ |

The kind of the nucleating agent and Sample No. are shown in Table 2. The samples obtained above each was exposed to a xenon flash light for an emission time of $10^{-5}$ sec using a step wedge through an interference filter having a peak at 488 nm and used for evaluation of photographic capabilities. The layer surface on the side having an emulsion layer had a pH of 5.6 and a swelling rate ((thickness of swollen layer/thickness of dry layer)×100) of 100.

The samples were evaluated by examining change in the photographic properties in a running test. The running test was performed under conditions such that 100 sheets of half exposed film in a size of 50.8 cm×60.1 cm were processed per day and the operation was continued for one week. The automatic developing machine used was FG-680A manufactured by Fuji Photo Film Co., Ltd., where the development temperature was 35° C. and the development time was 30 seconds.

The developer and the fixing solution each had the following composition

| (Composition of Developer) | |
|---|---|
| Potassium hydroxide | 40.0 g |
| Diethylenetriaminepentaacetic acid | 2.0 g |
| Potassium carbonate | 60.0 g |
| Sodium metabisulfite | 70.0 g |
| Potassium bromide | 7.0 g |

-continued

| | |
|---|---|
| Hydroquinone | 40.0 g |
| 5-Methylbenzotriazole | 0.35 g |
| 4-Hydroxymethyl-4-methyl-1-phenyl-3-pyrazolidone | 1.50 g |
| Sodium 2-mercaptobenzimidazole-5-sulfonate | 0.30 g |
| Sodium erythorbate | 6.0 g |
| Diethylene glycol | 5.0 g |

pH was adjusted to 10.65 by adding potassium hydroxide and water was added to make 1 l.

Based on the thus-obtained developer, developers for test shown in Table 1 were prepared.

TABLE 1

| | Developer a | Developer b | Developer c | Developer d |
|---|---|---|---|---|
| Compound II-14 of Invention | — | 0.111 g (0.5 mM) | — | — |
| Compound II-24 of Invention | — | — | 0.129 g (0.5 mM) | — |
| Comparative Compound C | — | — | — | 0.089 g (0.5 mM) |

Comparative Compound C:

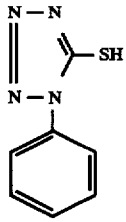

| (Formulation of Fixing Solution) | |
|---|---|
| Ammonium thiosulfate | 360.0 g |
| Disodium ethylenediaminetetraacetate dihydrate | 0.09g |
| Sodium thiosulfate pentahydrate | 32.8 g |
| Sodium sulfite | 64.8 g |
| NaOH | 37.2 g |
| Glacial acetic acid | 87.3 g |
| Tartaric aid | 8.76g |
| Sodium gluconate | 6.6 g |
| Aluminum sulfate | 25.3 g |
| pH (adjusted by sulfuric acid or sodium hydroxide) | 4.85 |
| Water to make | 3 l |

The replenishing amount of the fixing solution was 260 ml/m$^2$.

Evaluation of photographic properties was performed as follows.

As an index (gradation) showing contrast of an image, a point of (fog+density of 0.1) and a point of (fog+density of 3.0) on a characteristic curve was connected by a straight line and the gradient of this straight line was expressed as a gamma (γ) value. More specifically, gamma (gradation)=(3.0–0.1)/[log(exposure amount necessary for giving density of 3.0)–(exposure amount necessary for giving density of 0.1)], and the larger the gamma value, the higher contrast the photographic property. The light-sensitive material for graphic arts preferably has a gamma value of 10 or more, more preferably 15 or more.

The sensitivity was evaluated by a value after running, which was shown as a relative value, assuming that the reciprocal of the exposure amount necessary for obtaining a density of 1.5 when each sample was processed with a fresh solution, was 100. The relative value is preferably from 95 to 105.

Unevenness in development was evaluated by a 5-stage rating method, more specifically, the state where the film surface was completely free of occurrence of uneven development was rated at "5" and the state where uneven development was generated throughout the film surface was rated at "1". The rank "4" is a practically allowable level though uneven development was generated on very a part of the film surface and samples of the rank "3" or lower cannot be used in practice.

The test of unevenness in development was performed using an unexposed light-sensitive material of each sample in the end of running. The kind of the nucleation agent, the replenishing amount and the test results on unevenness in development after running are shown in Table 2.

Emulsion B

Emulsion B was prepared in the same manner as Emulsion A except that 1 mg/mol-Ag of a selenium sensitizer having the following structural formula, 1 mg/mol-Ag of sodium thiosulfate and 4 mg/mol-Ag of chloroauric acid were added and then the emulsion was subjected to chemical sensitization to show optimal sensitivity at 60° C.

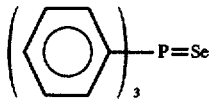

Preparation of Coated Sample

TABLE 2

| Test No. | Sample No. | Nucleating Agent No. | Developer No. | Replenishing amount (ml/m²) | Photographic Properties: Fresh Solution | | Photographic Properties: Solution after Running | | Unevenness in Processing | Remarks |
|---|---|---|---|---|---|---|---|---|---|---|
| 1 | 1 | A | b | 325 | Gradation | 22.4 | Gradation | 21.0 | 4 | Comparison |
| | | | | | Sensitivity | 100 | Sensitivity | 98 | | |
| 2 | 1 | A | b | 225 | Gradation | 22.4 | Gradation | 14.5 | 5 | Comparison |
| | | | | | Sensitivity | 100 | Sensitivity | 89 | | |
| 3 | 2 | B | b | 325 | Gradation | 20.1 | Gradation | 19.8 | 4 | Comparison |
| | | | | | Sensitivity | 100 | Sensitivity | 99 | | |
| 4 | 2 | B | b | 225 | Gradation | 21.0 | Gradation | 13.9 | 5 | Comparison |
| | | | | | Sensitivity | 100 | Sensitivity | 86 | | |
| 5 | 3 | N-2 | b | 225 | Gradation | 24.2 | Gradation | 24.0 | 4 | Invention |
| | | | | | Sensitivity | 100 | Sensitivity | 101 | | |
| 6 | 4 | N-3 | b | 225 | Gradation | 24.7 | Gradation | 24.2 | 5 | Invention |
| | | | | | Sensitivity | 100 | Sensitivity | 98 | | |
| 7 | 4 | N-3 | b | 162 | Gradation | 24.7 | Gradation | 22.3 | 4 | Invention |
| | | | | | Sensitivity | 100 | Sensitivity | 96 | | |
| 8 | 4 | N-3 | a | 162 | Gradation | 26.5 | Gradation | 23.3 | 2 | Comparison |
| | | | | | Sensitivity | 100 | Sensitivity | 94 | | |
| 9 | 4 | N-3 | a | 225 | Gradation | 26.5 | Gradation | 24.0 | 3 | Comparison |
| | | | | | Sensitivity | 100 | Sensitivity | 97 | | |
| 10 | 4 | N-3 | d | 162 | Gradation | 13.2 | Gradation | 9.7 | 4 | Comparison |
| | | | | | Sensitivity | 100 | Sensitivity | 84 | | |
| 11 | 4 | N-3 | d | 225 | Gradation | 13.2 | Gradation | 10.1 | 4 | Comparison |
| | | | | | Sensitivity | 100 | Sensitivity | 88 | | |
| 12 | 4 | N-3 | c | 225 | Gradation | 22.6 | Gradation | 21.9 | 4 | Invention |
| | | | | | Sensitivity | 100 | Sensitivity | 98 | | |
| 13 | 4 | N-3 | c | 162 | Gradation | 22.6 | Gradation | 22.2 | 5 | Invention |
| | | | | | Sensitivity | 100 | Sensitivity | 96 | | |
| 14 | 5 | N-8 | b | 162 | Gradation | 25.5 | Gradation | 22.2 | 4 | Invention |
| | | | | | Sensitivity | 100 | Sensitivity | 95 | | |
| 15 | 6 | N-10 | b | 225 | Gradation | 24.0 | Gradation | 21.5 | 5 | Invention |
| | | | | | Sensitivity | 100 | Sensitivity | 97 | | |

As is clearly seen from Table 2, in samples using a nucleating agent for comparison, gradation obtained in the running with a reduced replenishing amount became soft and the sensitivity was on an NG level, whereas in samples using a nucleating agent of the present invention, even when a low replenishing system was used, changes in the sensitivity and in the gradation were small and advantageous results could be obtained.

Further, even if a nucleating agent of the present invention was used, when development was performed with Comparative Developer a or d, unevenness in development was generated or the photographic properties were greatly affected, whereas when Developer b or c of the present invention was used, unevenness in development was reduced and at the same time, the adverse effect on photographic properties was small.

EXAMPLE 2

Preparation of Silver Halide Photographic Light-Sensitive Material

Preparation of Emulsion

Emulsion B was prepared in the following manner.

Samples were prepared in the same manner as in Example 1 except that $2.1\times10^{-4}$ mol/mol-Ag of Compound (S-3) was added in place of the sensitizing dyes in EM layer of Example 1 and Emulsion B was used as the emulsion of EM layer.

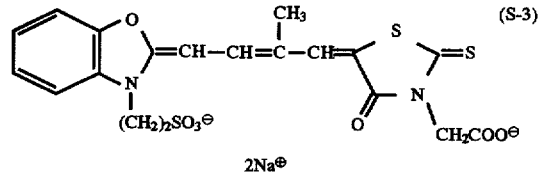

(1) Exposure and Development

Each of the thus-obtained samples was exposed to a xenon flash light for an emission time of $10^{-6}$ sec using a step wedge through an interference filter having a peak at 633 nm.

A solid developer was produced by packing development components as solids in an amount corresponding to 10 l of the solution on use, into a container (average wall thickness: 50 μm, partially from 200 to 1,000 μm) formed of a high density polyethylene. At this time, respective components were mixed and then packed into the container.

The developer had the following composition.

| | |
|---|---|
| Sodium hydroxide (beads) 99.5% | 11.5 g |
| Potassium sulfite (raw material) | 71.8 g |
| Sodium sulfite (raw material) | 35.0 g |
| Potassium carbonate (raw material) | 62.0 g |
| Hydroquinone (briquet) | 40.0 g |

The following components were collectively briquetted.

| | |
|---|---|
| Diethylenetriaminepentaacetic acid | 2.0 g |
| 5-Methylbenzotriazole | 0.35 g |
| 4-Hydroxymethyl-4-methyl-1-phenyl-3-pyrazolidone | 1.50 g |
| Sodium 2-mercaptobenzimidazole-5-sulfonate | 0.30 g |
| Sodium erythorbate | 6.0 g |
| Potassium bromide | 6.6 g |

Based on this formulation, a compound in Table 1 was added and developers for test were prepared. When this formulation was dissolved in up to 1 l of water, the pH was 10.65.

With respect to the shape of raw materials, the raw material was a general industrial product as it is and the alkali metal salt beads were a commercially available product.

The raw materials in the shape of a briquet each was compressed under pressure using a briquetting machine to have an undefined Rugby ball form having a length of approximately from 4 to 6 mm, and the briquet was crushed and used. With respect to components in a small amount, respective components were blended and then briquetted.

The fixing solution having the following formulation was packed, including both the solid agent part and the liquid agent part, in a container (average wall thickness: 500 μm, width: from 200 to 1,000 μm) formed of a high density polyethylene. After dissolving, the amount of solution was 10 l and the pH was 4.85. The replenishing amount of the fixing solution was 260 ml/m$^2$.

| | |
|---|---|
| Solid agent part: | |
| Ammonium thiosulfate | 1,300 g |
| Sodium acetate | 400 g |
| Sodium metabisulfate | 200 g |
| Liquid agent part: | |
| Aluminum sulfate (27%) | 300 g |
| Sulfuric acid (75%) | 30 g |
| Sodium gluconate | 20 g |
| EDTA | 0.3 g |
| Citric acid | 40 g |

The solid agent parts were mixed and then packed.

Evaluation of photographic properties and running properties are performed in the same manner as in Example 1. As a result, similar results to those in Example 1 were obtained, more specifically, superior running property was obtained when the nucleating agent of the present invention is used and unevenness in development could be improved without impairing the photographic properties when development was performed with a developer containing the compound represented by formula (II) of the present invention.

EXAMPLE 3

Preparation of Emulsion

A 1.5% aqueous gelatin solution kept at 38° C., having a pH of 2.0 and containing sodium chloride, $3\times10^{-5}$ mol/mol-Ag of sodium benzene thiosulfonate and $5\times10^{-3}$ mol/mol-Ag of 4-hydroxy-6-methyl-1,3,3a,7-tetraazaindene, and an aqueous sodium chloride solution containing $4\times10^{-5}$ mol/mol-Ag of $K_2Ru(NO)Cl_5$ were added simultaneously by a double jet method at an electric potential of 95 mV over 3 minutes and 30 seconds to use a half of the silver amount of a final grain to thereby prepare core grains each having a size of 0.10 μm. Thereafter, an aqueous silver nitrate solution and an aqueous sodium chloride solution containing $4\times10^{-5}$ mol/mol-Ag of $K_2Ru(NO)Cl_5$ were added in the same manner as above over 7 minutes to prepare silver chloride cubic grains having an average grain size of 0.13 μm (coefficient of variation: 13%).

Thereafter, the grains were washed with water by a flocculation method well known in the art to remove soluble salts, then gelatin was added, 60 mg/mol-Ag of Compound C as an antiseptic was added, the pH and the pAg were adjusted to 5.7 and 7.5, respectively, further $1\times10^{-5}$ mol/mol-Ag of sodium thiosulfate, $1\times10^{-5}$ mol/mol-Ag of Selenium Sensitizer SE-1 and $4\times10^{-5}$ mol/mol-Ag of chloroauric acid were added, the emulsion was subjected to chemical sensitization by heating at 65° C. for 60 minutes, and thereto, $1\times10^{-3}$ mol/mol-Ag of 4-hydroxy-6-methyl-1,3,3a,7-tetraazaindene as a stabilizer was added (as a final grain, pH=5.7, pAg=7.5, Ru=$4\times10^{-5}$ mol/mol-Ag).

Compound-C

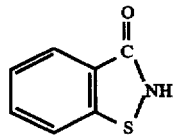

SE-1

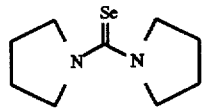

Preparation of Coating Solution For Emulsion Layer and Coating Thereof

The following compounds were added to the emulsion prepared above and a silver halide emulsion layer was coated on a support described below having an undercoat layer to give a gelatin coated amount of 0.9 g/m$^2$ and a silver coated amount of 2.7 g/m$^2$.

| | |
|---|---|
| 1-Phenyl-5-mercaptotetrazole | 1 mg/m$^2$ |
| Compound W | 20 mg/m$^2$ |
| N-Oleyl-N-methyltaurine sodium salt | 10 mg/m$^2$ |
| Compound D | 10 mg/m$^2$ |
| Compound E | 10 mg/m$^2$ |
| Compound F | 10 mg/m$^2$ |
| n-Butylacrylate/2-acetoacetoxyethyl methacrylate/acrylic acid copolymer (89/8/3) | 760 mg/m$^2$ |
| Compound G (hardening agent) | 105 mg/m$^2$ |
| Sodium polystyrene sulfonate | 57 mg/m$^2$ |

Further, a hydrazine-base nucleating agent of the present invention was added as shown in Table 3.

On the upper layer of the above-described emulsion layer, emulsion protective lower and upper layers were coated.

Preparation of Coating Solution for Emulsion Protective Lower Layer and Coating Thereof The following compounds were added to an aqueous gelatin solution and coated to give a gelatin coated amount of 0.6 g/m$^2$.

| | |
|---|---|
| Gelatin ($Ca^{++}$ content: 2,700 ppm) | 0.6 g/m$^2$ |
| Sodium p-dodecylbenzenesulfonate | 10 mg/m$^2$ |
| Sodium polystyrenesulfonate | 6 mg/m$^2$ |
| Compound C | 1 mg/m$^2$ |
| Compound H | 14 mg/m$^2$ |
| n-Butylacrylate/ 2-acetoacetoxyethyl methacrylate/acrylic acid copolymer (69/8/3) | 250 mg/m$^2$ |

Preparation of Coating Solution for Emulsion Protective Upper Layer and Coating Thereof The following compounds were added to an aqueous gelatin solution and coated to give a gelatin coated amount of 0.45 g/m$^2$.

| | |
|---|---|
| Gelatin ($Ca^{++}$ content: 2,700 ppm) | 0.45 g/m$^2$ |
| Amorphous silica matting agent (average particle size: 3.5 μm, pore diameter: 25 Å, surface area: 700 m$^2$/g) | 40 mg/m$^2$ |
| Amorphous silica matting agent (average particle size: 2.5 μm, pore diameter: 170 Å, surface area: 300 m$^2$/g) | 10 mg/m$^2$ |
| N-Perfluorooctanesulfonyl-N-propylglycine potassium | 5 mg/m$^2$ |
| Sodium p-dodecylbenzenesulfonate | 30 mg/m$^2$ |
| Compound C | 1 mg/m$^2$ |
| Liquid paraffin | 40 mg/m$^2$ |
| Solid Disperse Dye $G_1$ | 30 mg/m$^2$ |
| Solid Disperse Dye $G_2$ | 150 mg/m$^2$ |
| Sodium polystyrenesulfonate | 4 mg/m$^2$ |

Then, on the opposite side of the support, the following electrically conductive layer and backing layer were simultaneously coated.

Preparation of Coating Solution for Electrically Conductive Layer and Coating Thereof The following compounds were added to an aqueous gelatin solution and coated to give a gelatin coated amount of 0.06 g/m$^2$.

| | |
|---|---|
| $SnO_2$/Sb (9/1 by weight, average particle size: 0.25 μm) | 186 mg/m$^2$ |
| Gelatin ($Ca^{++}$ content: 3,000 ppm) | 60 mg/m$^2$ |
| Sodium p-dodecylbenzenesulfonate | 13 mg/m$^2$ |
| Sodium dihexyl-α-sulfosuccinate | 12 mg/m$^2$ |
| Sodium polystyrenesulfonate | 10 mg/m$^2$ |
| Compound C | 1 mg/m$^2$ |

Preparation of Coating Solution for Back Layer and Coating Thereof

The following compounds were added to an aqueous gelatin solution and coated to give a gelatin coated amount of 1.94 g/m$^2$.

| | |
|---|---|
| Gelatin ($Ca^{++}$ content: 30 ppm) | 1.94 mg/m$^2$ |
| Polymethyl methacrylate fine particle (average particle size: 3.4 μm) | 15 mg/m$^2$ |

-continued

| | |
|---|---|
| Compound i | 146 mg/m$^2$ |
| Compound J | 140 mg/m$^2$ |
| Compound K | 30 mg/m$^2$ |
| Compound L | 40 mg/m$^2$ |
| Sodium p-dodecylbenzenesulfonate | 7 mg/m$^2$ |
| Sodium dihexyl-α-sulfosuccinate | 29 mg/m$^2$ |
| Compound M | 5 mg/m$^2$ |
| N-Perfluorooctanesulfonyl-N-propylglycine potassium | 5 mg/m$^2$ |
| Sodium sulfate | 150 mg/m$^2$ |
| Sodium acetate | 40 mg/m$^2$ |
| Compound E (hardening agent) | 105 mg/m$^2$ |

Support and Undercoat Layer

A first undercoat layer and a second undercoat layer each having the following composition were coated on both surfaces of a biaxially stretched polyethylene terephthalate support (thickness: 100 μm).

| Undercoat First Layer: | |
|---|---|
| Core-shell type vinylidene chloride copolymer (1) | 15 g |
| 2,4-Dichloro-6-hydroxy-s-triazine | 0.25 g |
| Polystyrene fine particle (average particle size: 3 μm) | 0.05 g |
| Compound N | 0.20 g |
| Colloidal silica (Snowtex ZL, produced by Nissan Kagaku KK, particle size: 70 to 100 μm) | 0.12 g |
| Water to make | 100 g |

Further, 10 wt % of KOH was added thereto and the resulting coating solution adjusted to have a pH of 6 was coated at a drying temperature of 180° C. within 2 minutes to have a dry thickness of 0.9 μm.

| Undercoat Second Layer: | |
|---|---|
| Gelatin | 1 g |
| Methyl cellulose | 0.05 g |
| Compound O | 0.02 g |
| $C_{12}H_{25}O(CH_2CH_2O)_{10}H$ | 0.03 g |
| Compound C | $3.5 \times 10^{-3}$ g |
| Acetic acid | 0.2 g |
| Water to make | 100 g |

The resulting coating solution was coated at a drying temperature of 170° C. within 2 minutes to have a dry thickness of 0.1 μm to thereby prepare a support having undercoat layers. Thus, samples were prepared.

Compound D

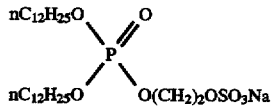

Compound E

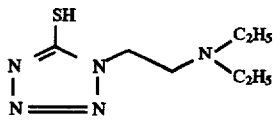

Compound F

-continued

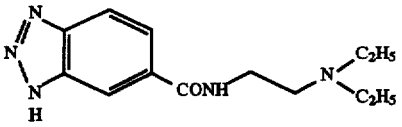

Compound G

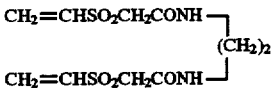

Compound H

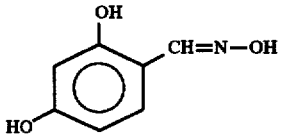

Solid Disperse Dye $G_1$

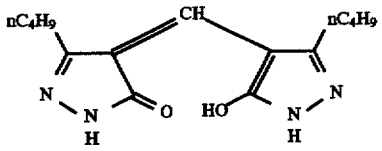

Solid Disperse Dye $G_2$

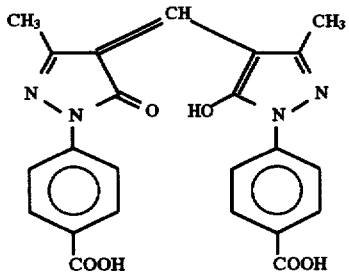

Compound W

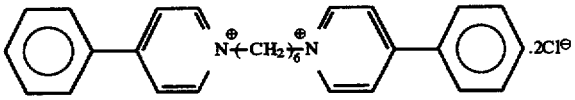

Compound i

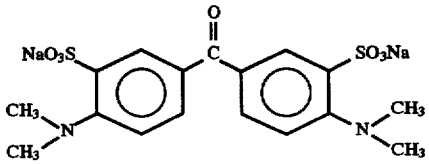

Compound J

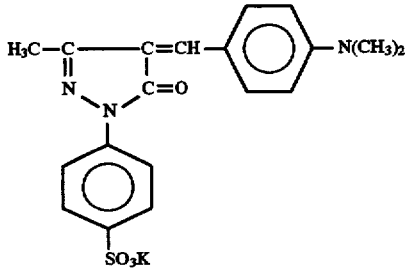

-continued

Compound K

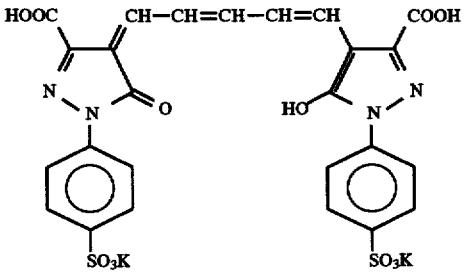

Compound L

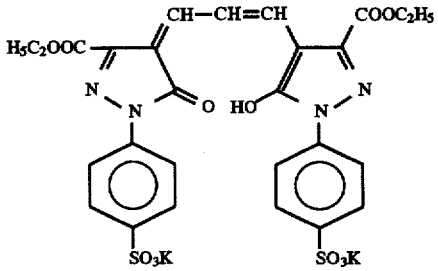

Compound M $C_8F_{17}SO_2Li$

Core-shell-type vinylidene chloride copolymer (1)

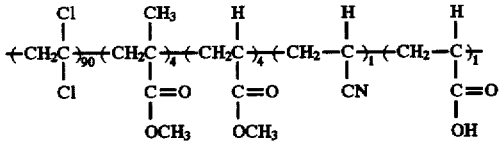

VDC MMA MA AN AA

Core: VDC/MMA/MA (80 wt %)
Shell: VDC/AN/AA (20 wt %)
Average grain size: 70 nm

Compound N

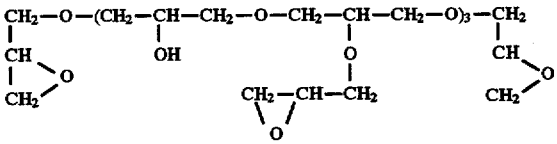

Compound O

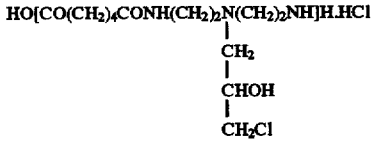

Evaluation of Photographic Properties (1) Exposure and Development

Each of the thus-obtained samples was exposed through an optical wedge in a printer, P-627FM manufactured by Dainippon Screen Mfg., Co., Ltd., processed with the developer in Example 1 at 38° C. for 20 seconds in an automatic developing machine, FG-680AG manufactured by Fuji Photo Film Co., Ltd., and then fixed, water washed and dried. The fixing solution used was the same as in Example 1.

Evaluation of unevenness in the running property was performed in the same manner as in Example 1 except that the development temperature and the development time were changed to 38° C. and 20 seconds, respectively. The results obtained are shown in Table 3 below.

TABLE 3

| Test No. | Sample No. | Nucleating Agent No. | Developer No. | Replenishing amount (ml/m²) | Photographic Properties: Fresh Solution | | Photographic Properties: Solution after Running | | Unevenness in Processing | Remarks |
|---|---|---|---|---|---|---|---|---|---|---|
| 16 | 7 | A | b | 325 | Gradation | 15.2 | Gradation | 14.7 | 5 | Comparison |
| | | | | | Sensitivity | 100 | Sensitivity | 99 | | |
| 17 | 7 | A | b | 225 | Gradation | 15.2 | Gradation | 10.0 | 5 | Comparison |
| | | | | | Sensitivity | 100 | Sensitivity | 88 | | |
| 18 | 8 | B | b | 325 | Gradation | 14.8 | Gradation | 14.5 | 4 | Comparison |
| | | | | | Sensitivity | 100 | Sensitivity | 99 | | |
| 19 | 8 | B | b | 225 | Gradation | 14.8 | Gradation | 9.8 | 5 | Comparison |
| | | | | | Sensitivity | 100 | Sensitivity | 83 | | |
| 20 | 9 | D-11 | b | 225 | Gradation | 16.8 | Gradation | 16.3 | 4 | Invention |
| | | | | | Sensitivity | 100 | Sensitivity | 100 | | |
| 21 | 10 | D-10 | b | 225 | Gradation | 17.5 | Gradation | 17.0 | 5 | Invention |
| | | | | | Sensitivity | 100 | Sensitivity | 98 | | |
| 22 | 10 | D-10 | b | 162 | Gradation | 17.5 | Gradation | 16.5 | 5 | Invention |
| | | | | | Sensitivity | 100 | Sensitivity | 97 | | |
| 23 | 10 | D-10 | a | 162 | Gradation | 18.3 | Gradation | 16.5 | 2 | Comparison |
| | | | | | Sensitivity | 100 | Sensitivity | 94 | | |
| 24 | 10 | D-10 | a | 225 | Gradation | 18.3 | Gradation | 17.1 | 2 | Comparison |
| | | | | | Sensitivity | 100 | Sensitivity | 97 | | |
| 25 | 10 | D-10 | d | 162 | Gradation | 12.4 | Gradation | 9.6 | 4 | Comparison |
| | | | | | Sensitivity | 100 | Sensitivity | 83 | | |
| 26 | 10 | D-10 | d | 225 | Gradation | 12.4 | Gradation | 9.9 | 4 | Comparison |
| | | | | | Sensitivity | 100 | Sensitivity | 87 | | |
| 27 | 10 | D-10 | c | 225 | Gradation | 16.9 | Gradation | 16.4 | 5 | Invention |
| | | | | | Sensitivity | 100 | Sensitivity | 98 | | |
| 28 | 10 | D-10 | c | 162 | Gradation | 16.9 | Gradation | 16.3 | 4 | Invention |
| | | | | | Sensitivity | 100 | Sensitivity | 96 | | |
| 29 | 11 | D-15 | b | 162 | Gradation | 16.4 | Gradation | 15.0 | 4 | Invention |
| | | | | | Sensitivity | 100 | Sensitivity | 96 | | |
| 30 | 12 | D-16 | b | 225 | Gradation | 16.7 | Gradation | 15.2 | 5 | Invention |
| | | | | | Sensitivity | 100 | Sensitivity | 96 | | |

As is clearly seen from Table 3, in samples using a nucleating agent for comparison, gradation obtained in the running with a reduced replenishing amount became soft and the sensitivity was on an NG level, whereas in samples using a nucleating agent of the present invention, even when a low replenishing system was used, changes in the sensitivity and in the gradation were small and advantageous results could be obtained. Further, even if a nucleating agent of the present invention was used, when development was performed with Comparative Developer a or d, unevenness in development was generated or the photographic properties were greatly affected, whereas when Developer b or c of the present invention was used, unevenness in development was reduced and at the same time, the adverse effect on photographic properties was small.

Using a light-sensitive material containing a nucleating agent of the present invention and a developer containing the compound represented by formula (II) of the present invention, a processing method of a silver halide black-and-white photographic light-sensitive material, where a stable developer having a pH of less than 11.0 is provided, change in the photographic properties is small, unevenness is not generated, and stable photographic performance can be constantly achieved, can be provided.

While the invention has been described in detail and with reference to specific embodiments thereof, it will be apparent to one skilled in the art that various changes and modifications can be made therein without departing from the spirit and scope thereof.

What is claimed is:

1. A process for developing a silver halide photographic light-sensitive material comprising processing, after exposure, a silver halide photographic light-sensitive material with a developer (i) having a pH of from 9.0 to 11.0 and (ii) containing:

(1) from 0.2 to 0.75 mol/l of a dihydroxybenzene-base developing agent;

(2) from 0.001 to 0.06 mol/l of a 1-phenyl-3-pyrazolidone-base or p-aminophenol-base auxiliary developing agent;

(3) from 0.3 to 1.2 mol/l of free sulfite ions; and (4) a compound represented by the following formula (II):

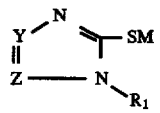

(II)

wherein Y and Z each represents N or $CR_2$, wherein $R_2$ represents an alkyl group or an aryl group; $R_1$ represents an alkyl, aryl or heterocyclic group substituted by at least one selected from the group consisting of $-SO_3M$, $-COOM$, $-OH$, $-NHSO_2R_3$, $-SO_2NR_3R_4$ and $-NR_5CONR_3R_4$, or a group comprising an alkyl, aryl or heterocyclic group bonded through a linking group; $R_3$, $R_4$ and $R_5$ each represents a hydrogen atom or a lower alkyl group having from 1 to 4 carbon atoms; and M represents a hydrogen atom, an alkali metal atom, a quaternary ammonium or a quaternary phosphonium;

wherein the replenishing amount of the developer is 225 ml/m² or less; and wherein said silver halide photographic light-sensitive material comprises a support having provided thereon at least one light-sensitive emulsion layer, wherein said emulsion layer or another hydrophilic colloid layer contains:

(i) a hydrazine-base nucleating agent having, in the vicinity of the hydrazine group thereof, at least one of an anion group or a nonion group which forms an intramolecular hydrogen bond with the hydrogen atom of the hydrazine; or at least one hydrazine nucleating agent selected from the compounds represented by the following formula (I)

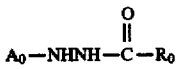

(I)

wherein $R_0$ represents a difluoromethyl group or a mono-fluoromethyl group; and $A_0$ represents an aromatic group, provided that $A_0$ contains, as a substituent, at least one of a non-diffusible group, an adsorption accelerating group to silver halide, an alkylthio group, an arylthio group, a heterocyclic thio group, a quaternary ammonium group, a nitrogen-containing heterocyclic group containing a quaternized nitrogen atom, an alkoxy group containing an ethyleneoxy or propyleneoxy unit, a saturated heterocyclic group having a sulfide bond or a disulfide bond, and a combination thereof; and (ii) a nucleating accelerator.

2. A development process as claimed in claim 1, wherein the developer is prepared using a solid processing agent.

3. A development process as claimed in claim 1, wherein the nucleating accelerator is at least one compound selected from the compounds represented by formulae (III), (IV) and (V):

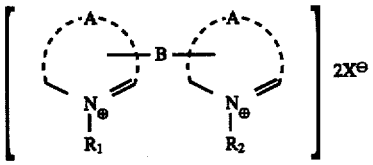

(III)

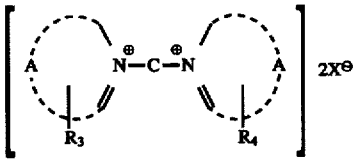

(IV)

wherein A represents an organic group for completing a heterocyclic ring; B and C each represents an alkylene, an arylene, an alkenylene, —$SO_2$—, —SO—, —O—, —S—, —N($R_5$)— or a combination thereof, wherein $R_5$ represents an alkyl group, an aryl group or a hydrogen atom; $R_1$ and $R_2$ each represents an alkyl group; $R_3$ and $R_4$ each represents a substituent; and X represents an anion group, provided that when an inner salt is formed, X is not required;

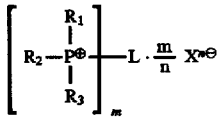

(V)

wherein $R_1$, $R_2$ and $R_3$ each represents an alkyl group, a cycloalkyl group, an aryl group, an alkenyl group, a cycloalkenyl group or a heterocyclic residue; m represents an integer; L represents a m-valent organic group bonding to the P atom through the carbon atom thereof; n represents an integer of from 1 to 3; and X represents an n-valent anion, provided that X may be linked with L.

* * * * *